US006493527B1

(12) United States Patent
Higeta et al.

(10) Patent No.: US 6,493,527 B1
(45) Date of Patent: Dec. 10, 2002

(54) PROCESS CARTRIDGE

(75) Inventors: Akira Higeta, Funabashi; Yoshiyuki Kakumi, Tuchiura, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/696,003

(22) Filed: Oct. 26, 2000

(30) Foreign Application Priority Data

Oct. 29, 1999 (JP) ..... 11-309902

(51) Int. Cl.[7] ..... G03G 15/00
(52) U.S. Cl. ..... 399/111; 399/113
(58) Field of Search ..... 399/111, 113, 399/110, 107, 109

(56) References Cited

U.S. PATENT DOCUMENTS

| | | | | |
|---|---|---|---|---|
| 5,060,016 A | | 10/1991 | Wanou et al. | 399/175 |
| 5,153,640 A | * | 10/1992 | Okabe | 399/113 |
| 5,331,373 A | | 7/1994 | Nomura et al. | 399/111 |
| 5,452,056 A | | 9/1995 | Nomura et al. | 399/111 |
| 5,455,665 A | | 10/1995 | Baba et al. | 399/358 |
| 5,485,249 A | | 1/1996 | Higeta et al. | 399/105 |
| 5,502,547 A | | 3/1996 | Shirai | 399/102 |
| 5,528,341 A | | 6/1996 | Shishido et al. | 399/109 |
| 5,585,889 A | | 12/1996 | Shishido et al. | 399/113 |
| 5,697,021 A | | 12/1997 | Watanabe et al. | 399/102 |
| 5,740,499 A | | 4/1998 | Higeta et al. | 399/105 |
| 5,752,134 A | * | 5/1998 | Hazama et al. | 399/113 |
| 5,774,766 A | * | 6/1998 | Karakama et al. | 399/111 |
| 5,809,374 A | | 9/1998 | Tsuda et al. | 399/111 |
| 5,899,602 A | * | 5/1999 | Noda et al. | 399/111 |
| 6,101,348 A | | 8/2000 | Nonaka et al. | 399/103 |
| 6,185,393 B1 | | 2/2001 | Karakama et al. | 399/103 |

FOREIGN PATENT DOCUMENTS

| | | |
|---|---|---|
| JP | 63-244063 | 10/1988 |
| JP | 64-20579 | 1/1989 |
| JP | 3-249781 | 11/1991 |
| JP | 4-134458 | 5/1992 |
| JP | 5-80601 | 4/1993 |
| JP | 5-232752 | 9/1993 |
| JP | 6-195000 | 7/1994 |
| JP | 6-308819 | 11/1994 |
| JP | 7-92887 | 4/1995 |
| JP | 7-181857 | 7/1995 |
| JP | 7-219295 | 8/1995 |
| JP | 8-190251 | 7/1996 |
| JP | 8-202242 | 8/1996 |
| JP | 0 743 570 | 11/1996 |
| JP | 8-305258 | 11/1996 |
| JP | 9-16057 | 1/1997 |
| JP | 9-81013 | 3/1997 |
| JP | 11-24533 | 1/1999 |
| JP | 11-143225 | 5/1999 |
| JP | 11-237821 | 8/1999 |

* cited by examiner

*Primary Examiner*—Sophia S. Chen
(74) *Attorney, Agent, or Firm*—Fitzpatrick, Cella, Harper & Scinto

(57) ABSTRACT

A process cartridge detachably mountable to a main assembly of an electrophotographic image forming apparatus, includes an electrophotographic photosensitive drum; a drum gear provided at one longitudinal end of the drum; a developing roller for developing with toner an electrostatic latent image formed on the drum; a developing roller gear, provided at one longitudinal end of the developing roller, for meshing engagement with the drum gear to transmit a driving force for rotating the developing roller from the drum gear; a cleaner container supporting the drum; a toner developing container supporting the developing roller; a coupling member for rotatably connecting the cleaner container and the toner developing container with each other; an urging member for urging the cleaner container and the toner developing container coupled by the coupling member in the direction of engagement of the drum gear and the developing roller gear with each other; and a tape stuck continuously on the cleaner container and the toner developing container to maintain, against an urging force provided by the urging member, a state in which the drum gear and the developing roller gear are disengaged from each other or in which a back clearance between the drum gear and the developing roller gear is larger than that during an image forming operation.

29 Claims, 58 Drawing Sheets

PROCESS CARTRIDGE

FIELD OF THE INVENTION AND RELATED ART

The present invention relates to a process cartridge.

Here, the process cartridge is a cartridge containing at least a developing roller as developing means and an electrophotographic photosensitive member as a unit, the cartridge being detachably mountable to a main assembly of an electrophotographic image forming apparatus.

The electrophotographic image forming apparatus is an apparatus in which an image is formed on a recording material (recording paper, textile or the like) using an electrophotographic image forming process, and includes an electrophotographic copying machine, an electrophotographic printer (a LED printer, laser beam printer and so on), an electrophotographic printer type facsimile machine, an electrophotographic word processor and the like.

In an electrophotographic image forming apparatus using an electrophotographic image forming process, a process cartridge is used that integrally contains an electrophotographic photosensitive member and process means actable on the electrophotographic photosensitive member, the process cartridge being detachably mountable to the main assembly of the electrophotographic image forming apparatus. With this process- cartridge type, the maintenance of the apparatus can be carried out in effect without service people. Therefore, the process cartridge type is widely used in the field of the electrophotographic image forming apparatus.

Such a process cartridge forms an image on recording material with toner. In the process cartridge, the developing roller of the developing means and the electrophotographic photosensitive member are coupled with other by gears.

During transportation of the process cartridge, the photosensitive drum is press-contacted to the spacer rollers at the end of portions of the developing roller.

And, the gear fixed coaxially to the photosensitive drum and the gear coaxially fixed to the developing roller are in a regular meshing engagement with each other. By impact or vibration imparted to the process cartridge during transportation, the gear teeth of the gears abut each other with a result of rotation of the photosensitive drum and the developing roller. If the directions of the rotations are all opposite from the directions during the image forming operation, the blow-out preventing sheet counter-directionally contacted to the peripheral surface of the developing roller may be turned over.

SUMMARY OF THE INVENTION

Accordingly, it is a principal object of the present invention to provide a process cartridge in which the developing roller is prevented from or suppressed in rotating in the direction opposite from the regular direction (the direction in which the developing roller rotates during the image formation operation), during the transportation of the process cartridge.

It is another object of the present invention to provide a process cartridge in which the toner leakage to the outside is effectively prevented.

According to an aspect of the present invention, there is provided a process cartridge detachably mountable to a main assembly of an electrophotographic image forming apparatus, comprising: an electrophotographic photosensitive drum; a drum gear provided at one longitudinal end of the photosensitive drum; a developing roller for developing with toner an electrostatic latent image formed on the photosensitive drum; a developing roller gear, provided at one longitudinal end of developing roller, for meshing engagement with the drum gear to transmit a driving force for rotating the developing roller from the drum gear; a cleaner container supporting the photosensitive drum; a toner developing container supporting developing roller; a coupling member for rotatably connecting the cleaner container and the toner developing container with each other; an urging member for urging the cleaner container and the toner developing container coupled by the coupling member in the direction of engagement of the drum gear and the developing roller gear with each other; a tape stuck continuously on the cleaner container and the toner developing container to maintain, against an urging force provided by the urging member, a state in which the drum gear developing roller gear are disengaged from each other or in which a back clearance between the drum gear and the developing roller gear is larger than that during image forming operation.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preferred Embodiments of the present invention will be described in conjunction with the accompanying drawings.

(Embodiment 1)

A description will be provided as to general arrangements of the image forming apparatus and a process cartridge according to an embodiment of the present invention, and then as to an assembling method of the process cartridge. The process steps of disassembling and reassembling the process cartridge and the reassembled process cartridge will be described finally.

A description will be provided first as to the general arrangements of an image forming apparatus and a process cartridge according to an embodiment of the present invention and then of the manufacturing method of the process cartridge. A description will be provided then as to the steps of disassembling and reassembling of the process cartridge and of the reassembled a process cartridge.

The remanufacturing of the process cartridge from which the toner has been used up comprises the steps of disassembling of the process cartridge into the toner developing container and the cleaner container, and the toner developing container is partly disassembled, and they are reassembled to provide a process cartridge having the toner developing container that is similar in function to the new process cartridge but has a partly different structure from the new process cartridge.

Referring to FIGS. 1 to 5, a description will be provided as to the process cartridge and an image forming apparatus to which the process cartridge is detachably mountable. A description will be provided as to the general arrangements of the process cartridge and the image forming apparatus, and then of the structure of the cartridge frames and the coupling of the frames.

(General Arrangement)

Figure 1:
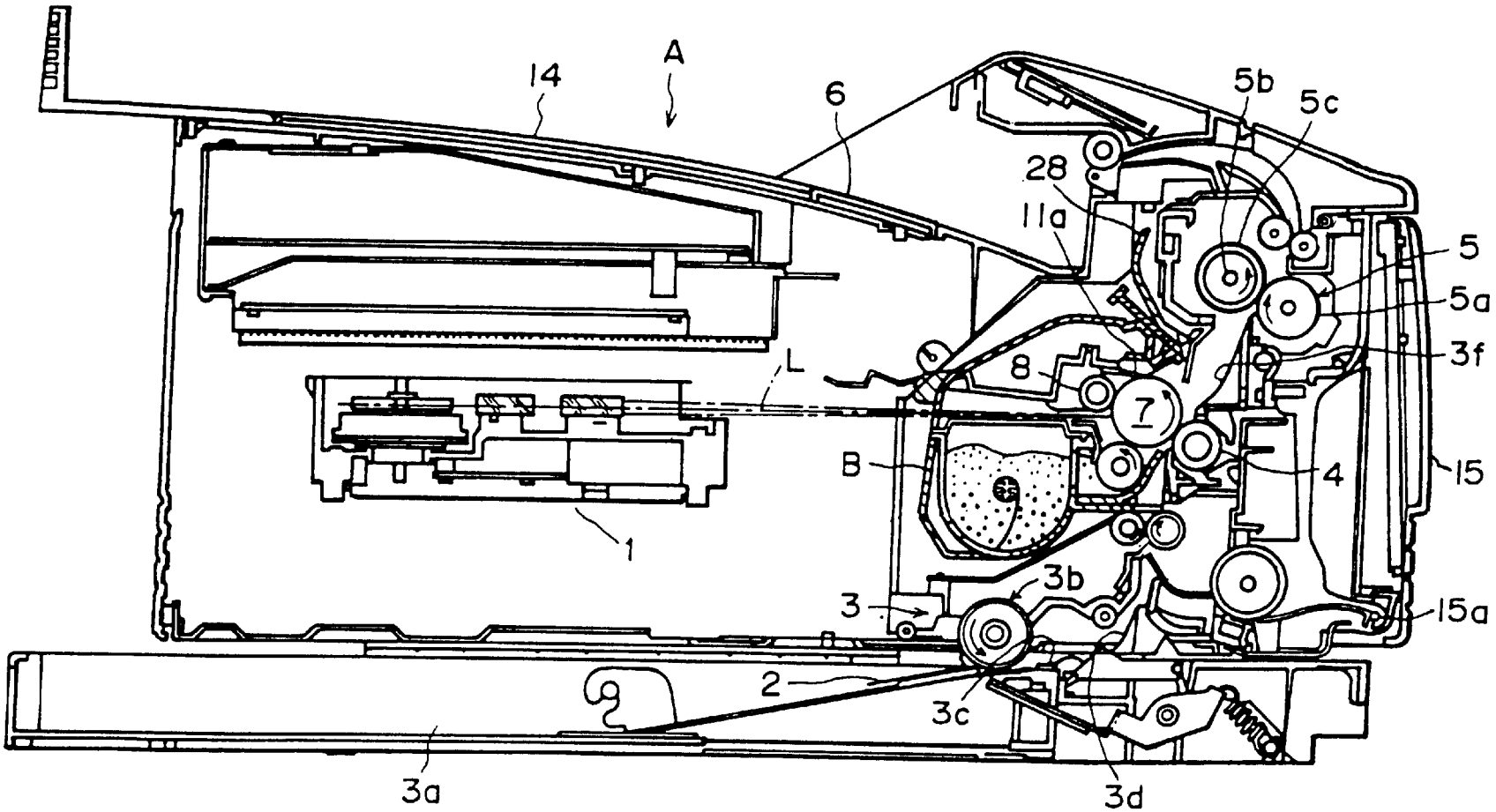
FIG. 1 is a longitudinal sectional view of an electrophotographic image forming apparatus.

The image forming apparatus in this embodiment is an electrophotographic image forming apparatus (laser beam printer) A, as shown in FIG. 1, wherein an electrophotographic photosensitive member in the form of a drum is exposed to information light modulated in accordance with image information from an optical system 1, so that a latent image is formed on the photosensitive member, and the latent image is developed into a toner image. In synchronism with the formation of the toner image, the recording material 2 is fed out, one by one, from a sheet feeding cassette 3*a* using a pick-up roller 3*b* and separation claws 3*c* press-contacted at the corners of the top surface of the recording material 2, and the sheet is fed by feeding means 3 including a feeding path 3*d* and a pair of registration rollers. The toner image formed on the electrophotographic photosensitive member in the process cartridge B is transferred onto the recording material 2 by applying a voltage to transfer means in the form of a transfer roller 4, and then the recording material 2 is fed to fixing means 5 on a feeding path 3*f*. The fixing means 5 comprises a driving roller 5*a* and a fixing roller 5*c* containing a heater 5*b* therein, and a pressure and heat are imparted to the recording material 2, which is passing therethrough, by which the transferred toner image is fixed on the recording material. The recording material 2 is further fed by discharging rollers, and is discharged to a discharging portion 6 through a reverse feeding path.

Figure 4:
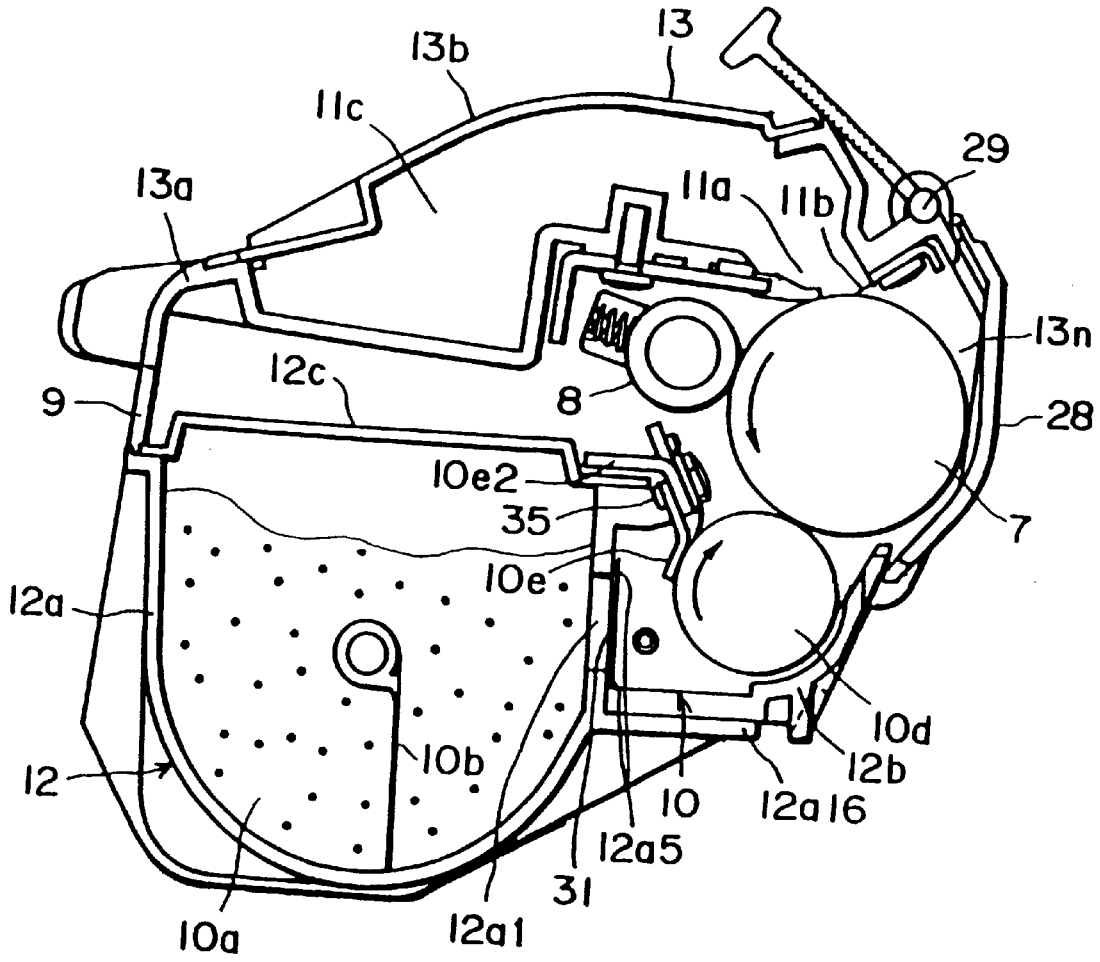
FIG. 4 is a longitudinal sectional view of a process cartridge.

On the other hand, the process cartridge B contains the electrophotographic photosensitive member and at least one process means. Here, the process means includes charging means for electrically charging the electrophotographic photosensitive member, the developing means for developing a latent image formed on the electrophotographic photosensitive member, and cleaning means for cleaning the surface of the electrophotographic photosensitive member to remove residual toner. As shown in FIG. 4, in the process cartridge B of this embodiment, the electrophotographic photosensitive member in the form of an electrophotographic photosensitive drum 7 having a photosensitive layer is rotated, and a voltage is applied on the charging roller 8, which is the charging means, so that the surface of the photosensitive drum 7 is uniformly charged, and the photosensitive drum 7 is exposed to a light image from the optical system 1 through an opening 9, by which and electrostatic latent image is formed, and the image is developed by developing means 10.

In the developing means 10, the toner in a toner accommodating portion 10*a* is fed out by feeding means in the form of a rotatable toner feeding member 10*b,* and a developing roller 10*d,* containing therein a stationary magnet, is rotated, by which a layer of toner particles, triboelectrically charged by the developing blade 10*e,* is formed on the surface of the developing roller 10*d.* The toner is selectively transferred onto the photosensitive drum 7 so that a toner image is formed. The developing roller 10*d* functions to supply the toner to the photosensitive drum 7. The developing blade 10*e* functions to regulate a thickness of the toner layer on the surface of the developing roller 10*d.*

The transfer roller 4 is supplied with a voltage having a polarity opposite from the polarity of the toner image, by which the toner image is transferred onto the recording material 2. Thereafter, the residual toner remaining on the photosensitive drum 7 is scraped off by the cleaning blade 11*a,* and the removed toner is received by a receptor sheet 11*b,* and the received toner is collected into a removed toner accommodating portion 11*c.*

(Cartridge Mounting Means)

Various parts, such as photosensitive drum 7, are supported and accommodated in a cartridge frame, which is provided by coupling the toner developing container 12 and the cleaner container 13. The cartridge is mounted to the main assembly 14 of the apparatus.

Figure 2:
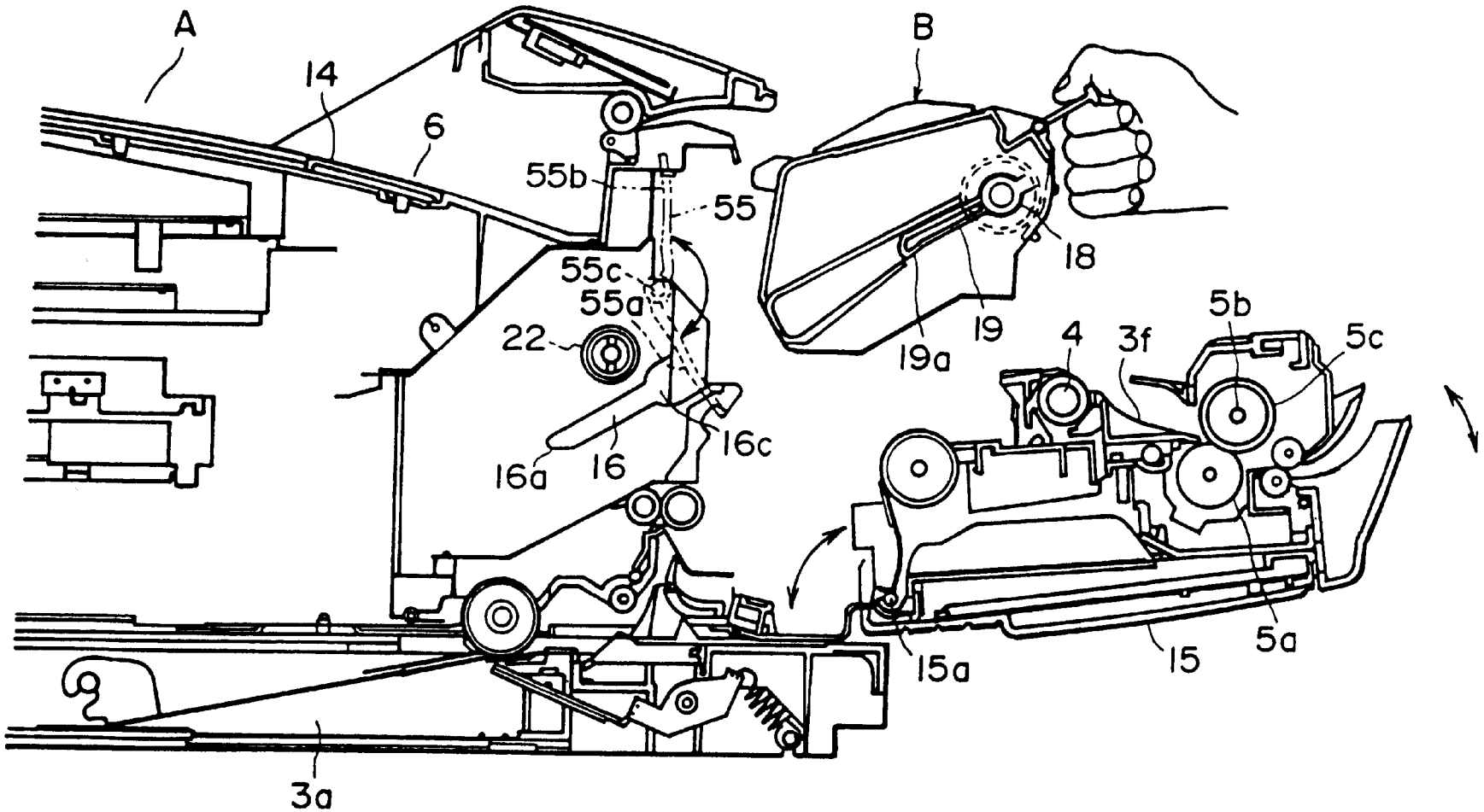
FIG. 2 is a longitudinal sectional view of an electrophotographic image forming apparatus.
Figure 3:
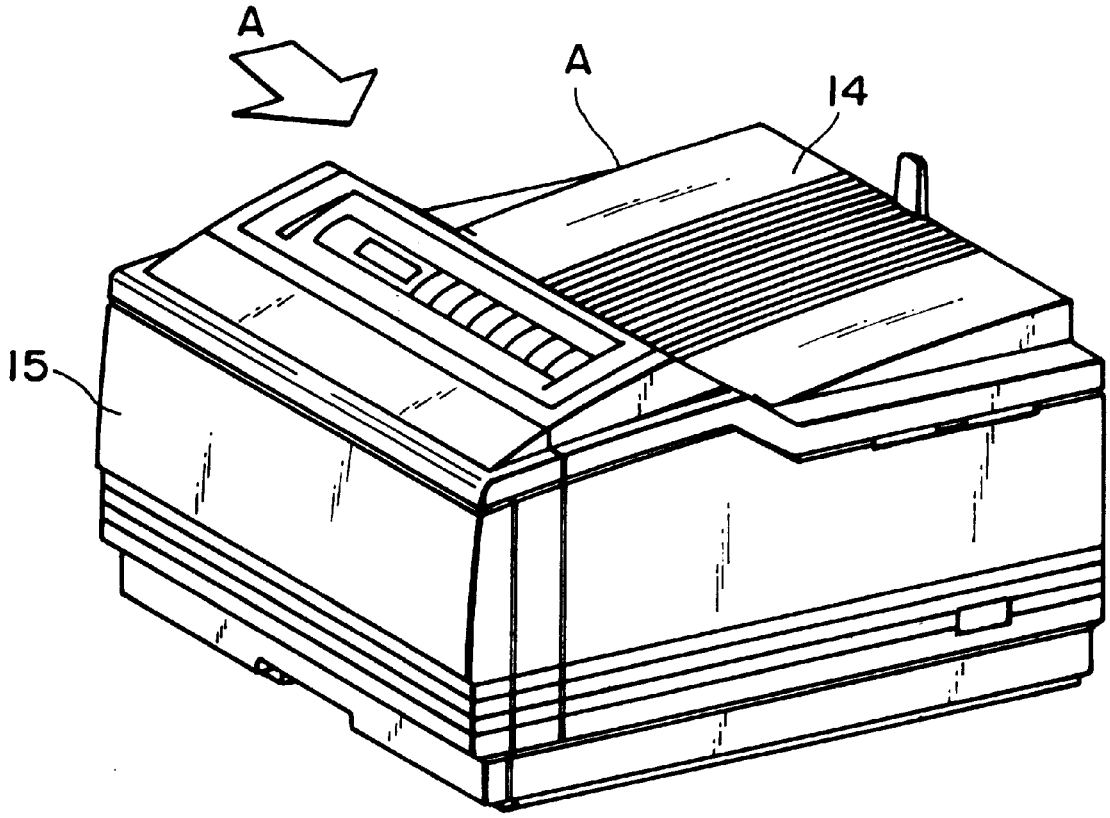
FIG. 3 is a perspective view of an electrophotographic image forming apparatus.

In the cartridge mounting means, when the cover member 15 is opened by rotating it about the shaft 15*a* (FIGS. 1, 2), there are guide grooves 16, which are inclined toward the rear side at each of the left and right sides of the cartridge mounting space as shown in FIG. 2. The guide grooves 16 are disposed substantially symmetrically. The guide grooves 16 are substantially linear. At the inlet side of the guide grooves 16 there are provided a positioning portion 16*c* (main assembly side positioning portion 16*c*).

Figure 5:
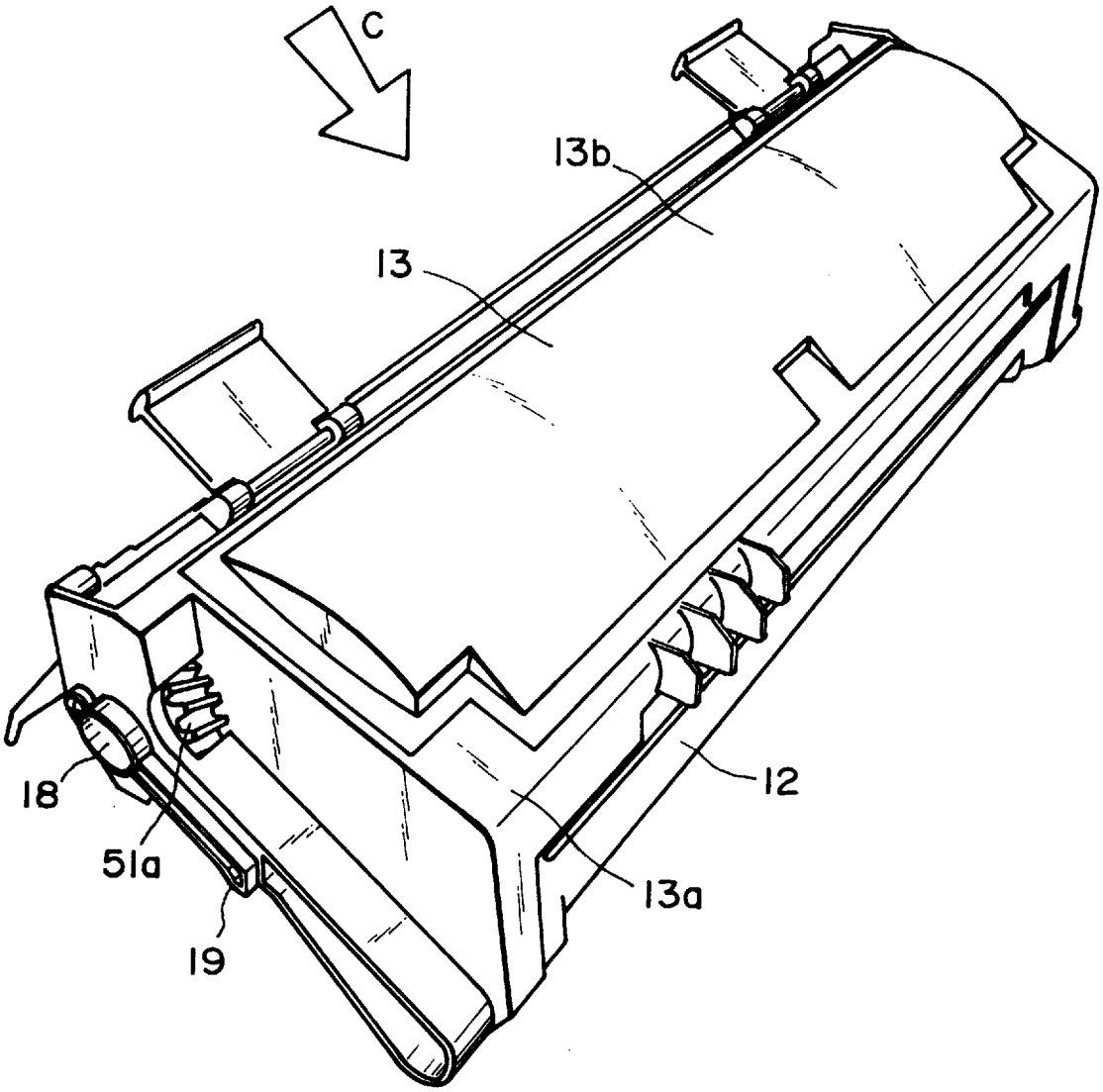
FIG. 5 is a perspective view of a process cartridge.
Figure 6:
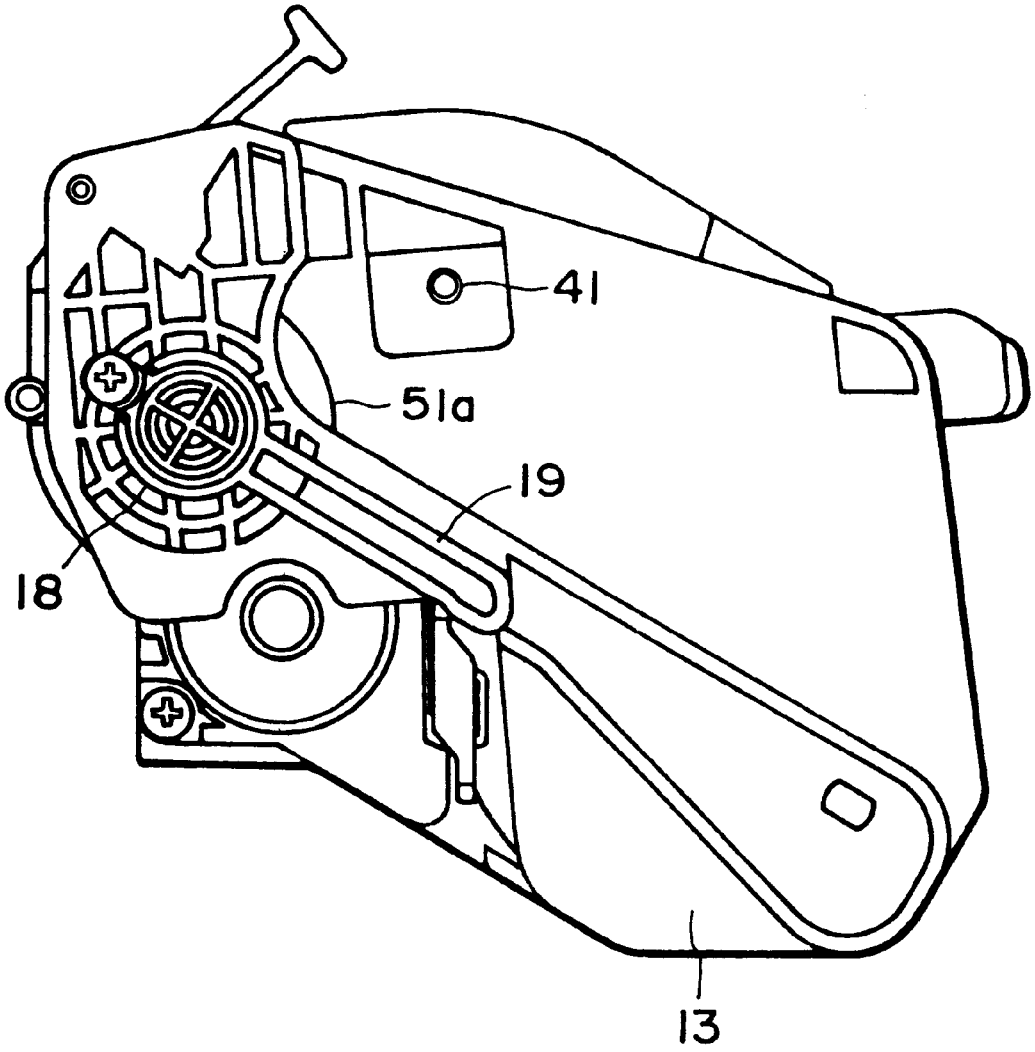
FIG. 6 is a side view of a process cartridge.

On the other hand, at the of the opposite outer ends of the process cartridge, there are provided guide portions correspondingly to the guide grooves 16 to be guided by the guide grooves 16. The guide portions are projected substantially symmetrically at the opposite longitudinal ends, respectively. As shown in FIG. 5, it comprises a boss 18 and a rib 19, which are integral. The boss 18 and the rib 19 are integrally formed with the cleaner container 13 to which the photosensitive drum 7 is mounted, and the boss 18 is disposed on an extension of a rotational excess of the photosensitive drum 7, and the rib 19 is extended from the boss 18 in an inserting direction of the process cartridge B as indicated by an arrow C in FIG. 5. The rib 19 extends inclined downwardly in conformity with the 5 guide grooves 16.

With this structure, when the process cartridge is to be mounted to the main assembly, as shown in FIG. 2, the cover member 15 is open, and the ribs 19 are engaged into the guide grooves 16, and then, the process cartridge B is inserted into the main assembly 14 of the apparatus. With the insertion, the process cartridge B makes a translational motion, that is, a linear motion inclined downward. When the process cartridge B is further inserted, the boss 18 of the process cartridge B is seated on the main assembly side positioning portion 16*c* in the inlet of one of the guide grooves 16. Simultaneously, the free end 19*a* of the rib 19 abuts a stopper surface 16*a* of one of the guide grooves 16 by a moment about the boss 18 produced by the weight of the process cartridge B. The gravity center of the process cartridge B is at the rib 19 side of the boss 18. Thus, the drum gear 51*a* (FIG. 5) fixed to an end of the photosensitive drum 7 is brought into meshing engagement with a driving gear 22 (FIG. 2) provided in the main assembly 14, so that driving force can be transmitted to the process cartridge B.

Figure 10:
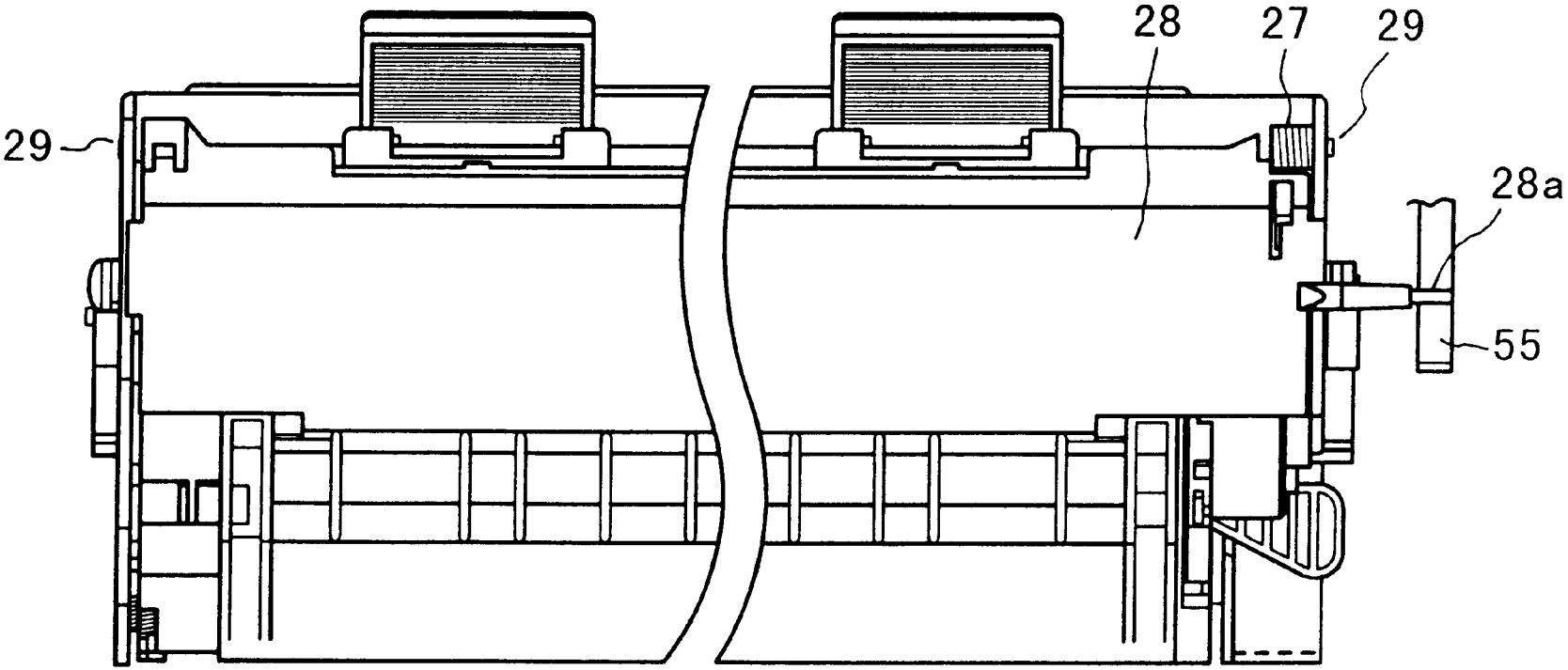
FIG. 10 is a top plan view of a process cartridge.

Then, the cover member 15 is closed, by which the shutter opening lever 55, which is interrelated with the cover member, is rotated in the clockwise direction about the shaft 55*c* from a position 55*a* to a position 55*b,* so that it is engaged with a pin 28*a* provided on the drum shutter member 28, as shown in FIG. 10, and the drum shutter member 28 is opened about a pin 29 mounted to the cleaner container 13 against a spring force of a spring 27, thus opening a transfer opening 13*n.* The coil spring 27 is fitted around the pin 29, and one end thereof is engaged to the cleaner container 13, and the other end is engaged to the drum shutter member 28, and therefore, when the cover member 15 is open or when the process cartridge B is outside the main assembly 14, the drum shutter member 28 closes the transfer opening 13*n* by the spring force of the coil spring 27.

When the process cartridge B is to be taken out, the cover member 15 is opened, and the shutter opening lever 55 is rotated about the shaft 55*c* to return from the position 55*b* to the position 55*a.* Then, drum shutter member 28 rotates about the pin 29 by the spring force of the coil spring 27, thus closing the transfer opening 13*n.* The process cartridge B is pulled up such that the boss 18 is away from the positioning portion 16*c,* and thereafter, the process cartridge B is further pulled up such that ribs 19 are guided by the guide grooves 16.

(Structure of Cartridge Frame)

A description will be provided as to the structure of the cartridge frame. The cartridge frame is made of polystyrol resin material by injection molding, and as shown in FIG. 4, a lower developing frame 12*b* is welded to a side of the developing device frame 12*a,* and a cap member 12*c* is welded to the upper portion, thus constituting a toner developing container 12. A cap member 13*b* is welded to a top of a cleaning frame 13*a* to constitute an integral cleaner container 13. Then, the cleaner container 13 is coupled with the toner developing container 12 to constitute a cartridge frame.

The developing device frame 12*a* is provided at an end thereof with a toner supply opening 12*a*1, as shown in FIG.

13, 14, and is also provided at one longitudinal end with a toner filling opening 12*a*2. The developing device frame 12*a* is provided therein with a plurality of erected supporting members (not shown) in the longitudinal direction. The toner supply opening 12*a*1 permits the supply of the toner from the toner accommodating portion 10*a* to the developing roller 10*d*. The toner in the toner accommodating portion 10*d* is supplied to the developing roller 10*d* through the toner supply opening 12*a*1.

Figure 13:
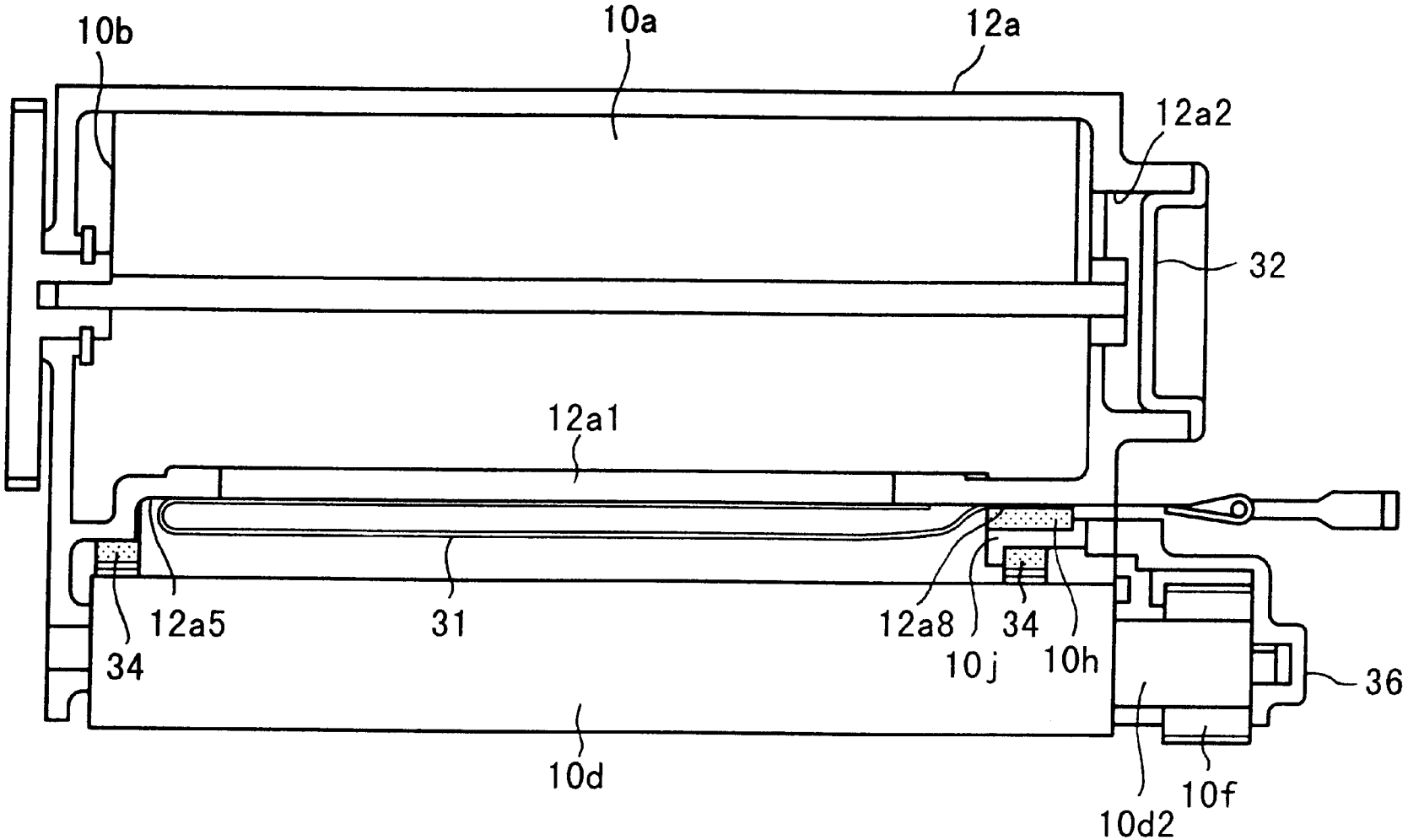
FIG. 13 is a horizontal sectional view of a toner developing container.
Figure 14:
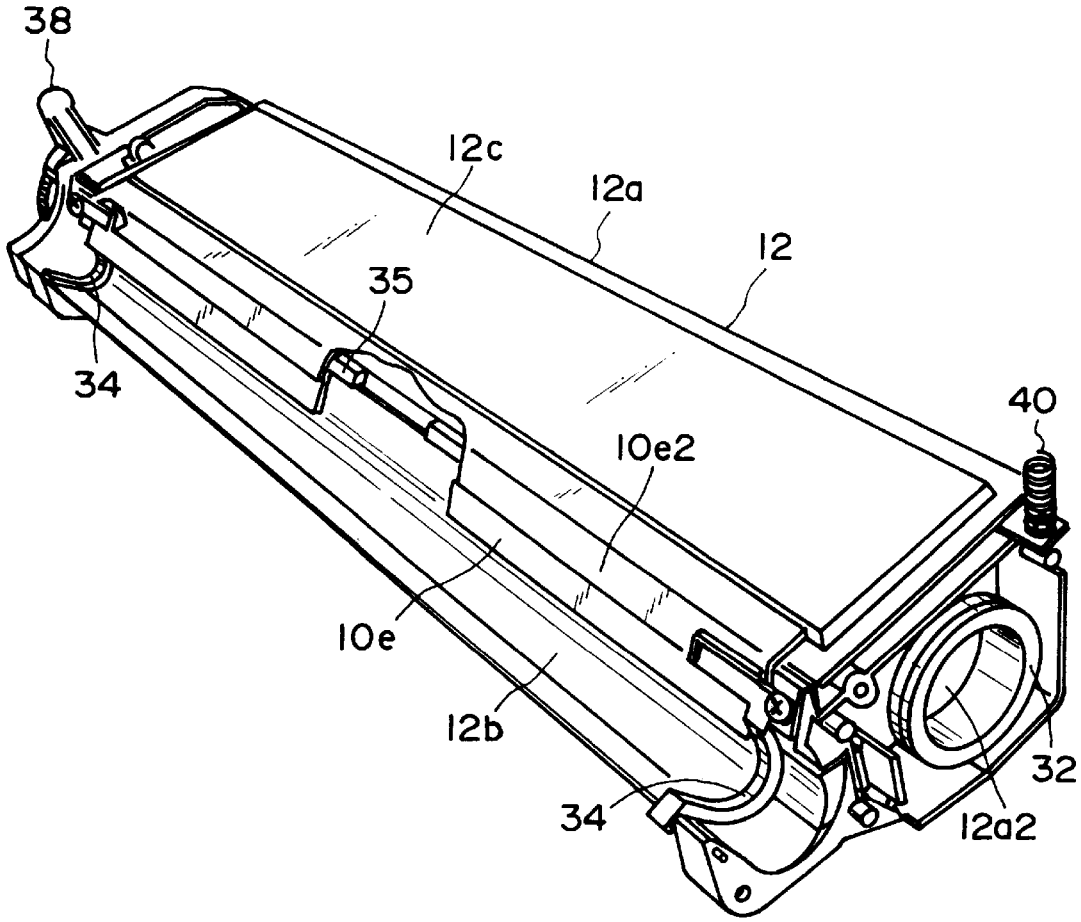
FIG. 14 is a perspective view of a toner developing container without a developing roller.

When the developing means is mounted in place, as shown in FIGS. 4, 13, a toner feeding member 10*b* is mounted in the developing device frame 12*a*, and thereafter, the cap member 12*c* is welded to the developing device frame 12*a*. Subsequently, a toner seal 31 in the form of a film is welded on a surface 12*a*5 of the seat formed around the circumference of the toner supply opening 12*a*1 of the toner developing container 12 to seal the opening 12*a*1. Then, the toner is filled through the toner filling opening 12*a*2, and thereafter, the filling opening 12*a*2 is plugged by a cap 32 to seal the toner accommodating portion 10*a*. The toner seal 31 sealing the toner supply opening 12*a*1, as shown in FIG. 13, is folded back at one longitudinal end of the opening 12*a*1, and the free end thereof is extended out through a slit 12*a*8 of the developing device frame 12*a*. The free end of the toner seal 31 is nipped by fingers of the user and is pulled out when the user starts the use of the process cartridge B.

When it is pulled out, the sealing is not complete at the portion where the toner seal 31 extends through the toner developing container 12.

Therefore, as shown in FIG. 13, an elastic sealing material 10*h* such a felt is provided in the slit 12*a*8 at an end, closer to the free end, of the toner seal 31.

As shown in FIG. 13, the elastic sealing material 10*h* is overlaid on the toner seal 31 and applies an urging force to the toner seal 31. Therefore, when the toner seal 31 is pulled out, the elastic sealing material 10*h* occupies the slit 12*a*8, which has been occupied by the toner seal 31 to be press-contacted to a wall of the developing device frame 12*a*, thus preventing leakage of the toner to the outside.

Figure 15:
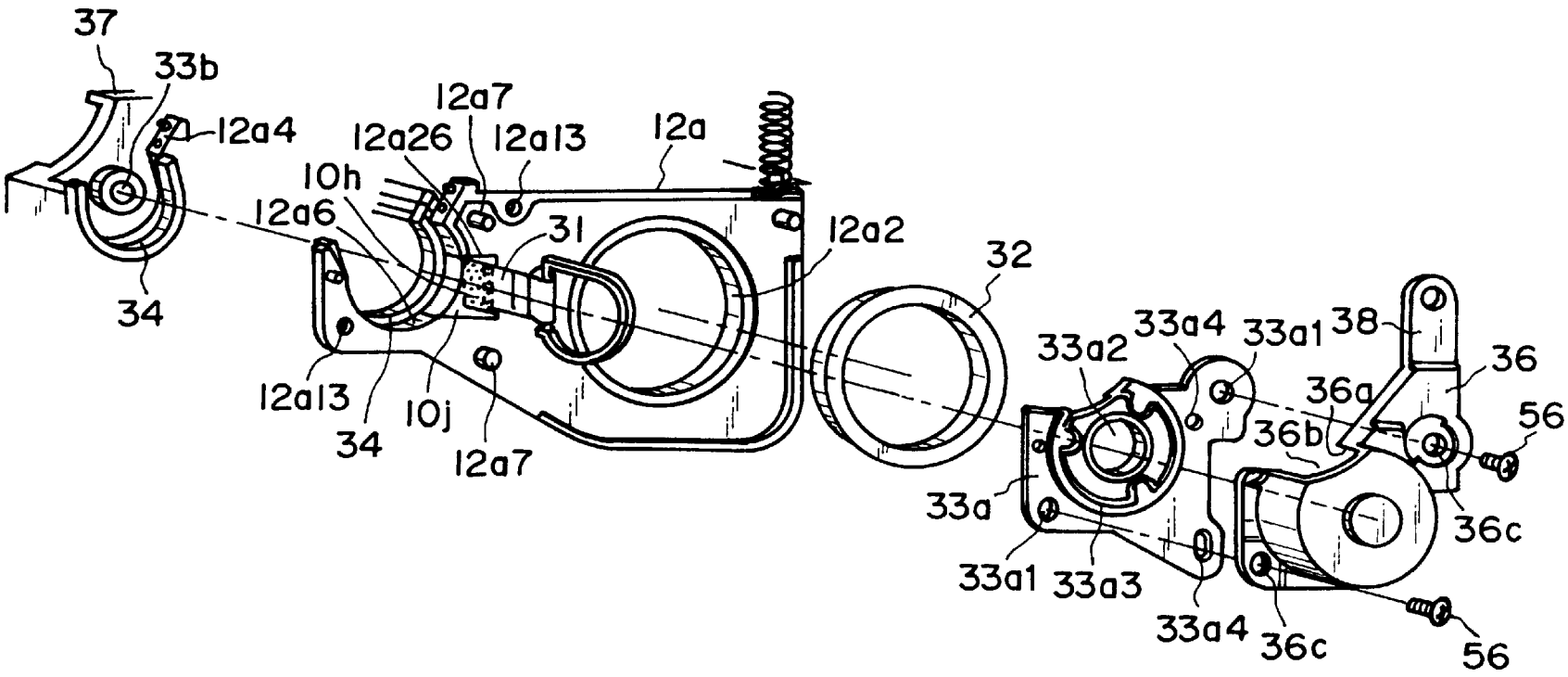
FIG. 15 is an exploded perspective view of supporting means for the developing roller.

A description will be provided as to the mounting of the elastic sealing material 10*h*. As shown in FIG. 15, a part of the arcuate portion 12*a*6 of the developing device frame 12*a* is provided with an angle groove 12*a*26 extending in the longitudinal direction. The bottom of the angle groove 12*a*26 is flush with the toner seal sticking seat surface 12*a*5. An elastic sealing material 10*h*, such as a felt or the like, is stuck on a piece 10*j* engaged in the angle groove 12*a*26.

With this structure even when the toner seal 31 is pulled out, the toner is prevented from leaking to the outside of the toner developing container 12 through the slit 12*a*8.

Figure 8:
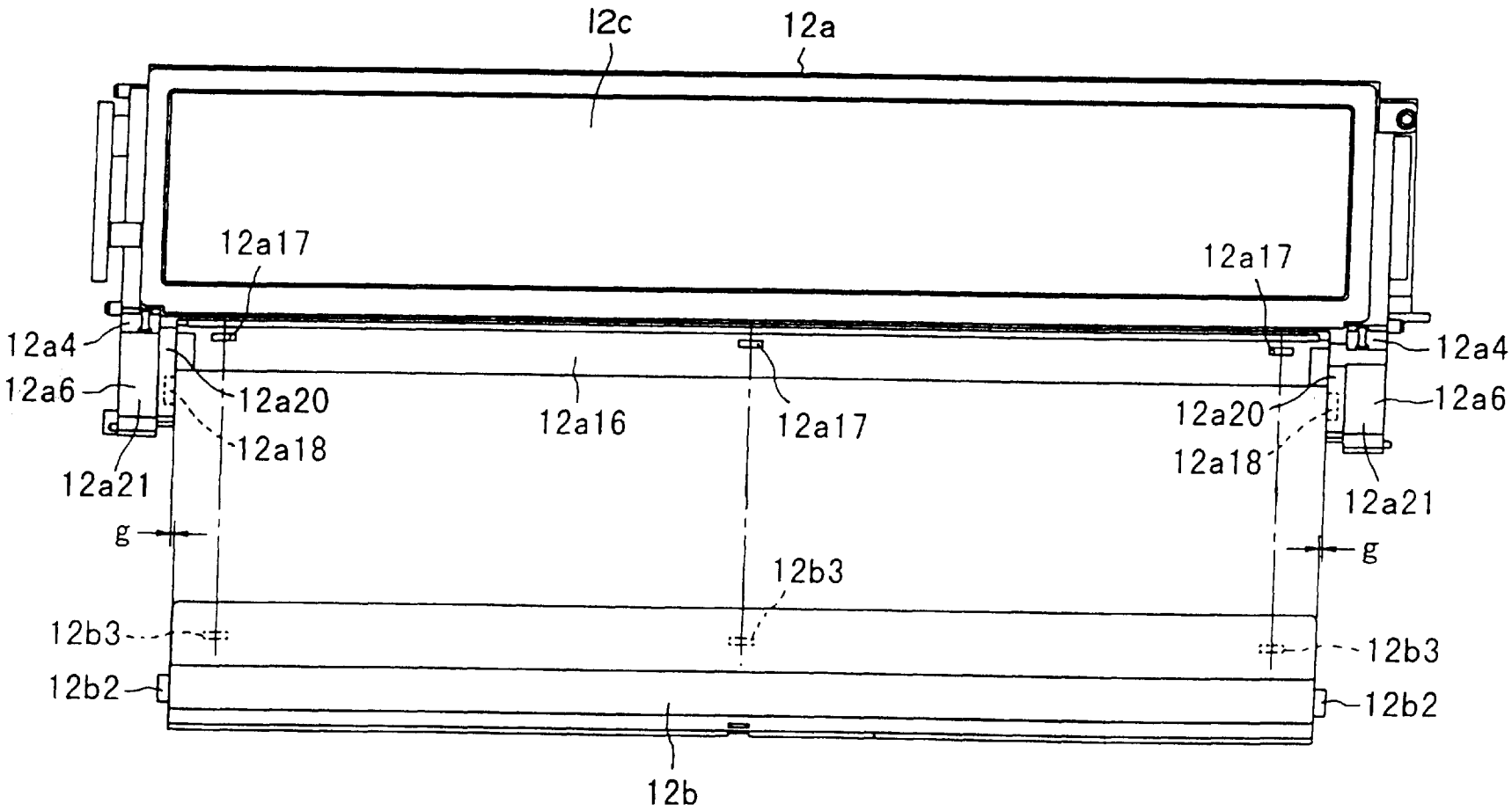
FIG. 8 is a top plan view of a frame of a toner developing container.
Figure 9:
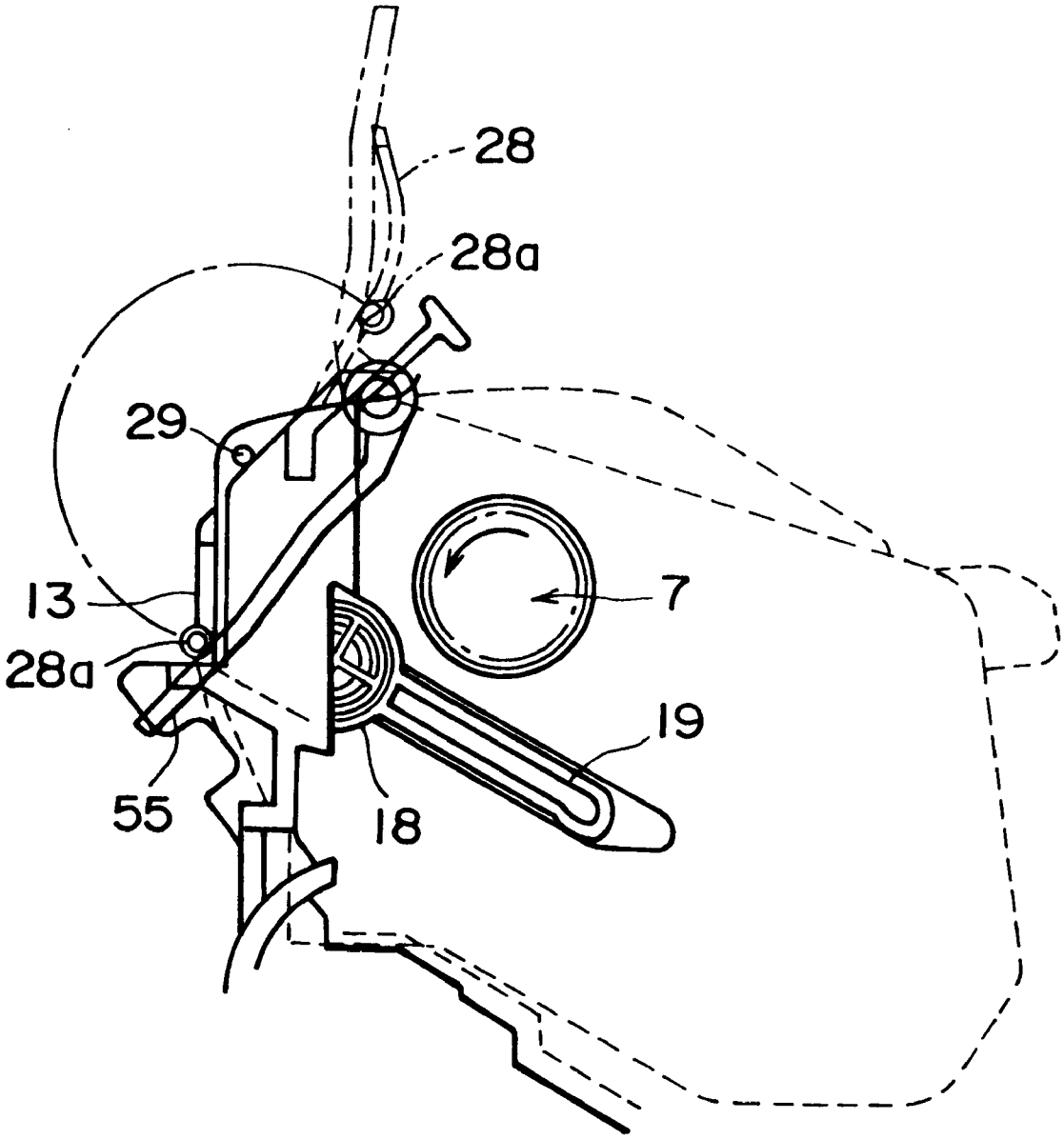
FIG. 9 is a side view of a drum shutter.

Then, the lower developing frame 12*b* is welded to the developing device frame 12*a*. As shown in FIG. 8, the developing device frame 12*a* is provided at the opposite longitudinal ends of the toner supply opening 12*a*1 with arcuate portions 12*a*6 at which the end seals 34 are to be mounted. A flat flange 12*a*16 is extended between the arcuate portions 12*a*6 below the seal sticking seat surface 12*a*5, and the flange 12*a*16 is substantially perpendicular to the seal sticking seat surface 12*a*5. On the other hand, lower developing frame 12*b* is engaged with the longitudinally opposing surfaces of the arcuate portions 12*a*6. Therefore, in consideration of manufacturing errors, the lower developing frame 12*b* has a length which is smaller than the distance between the opposing surfaces of the arcuate portion 12*a*6 by 2×g, where g is a gap at each of the ends. The flange 12*a*16 is provided with holes 12*a*17, and the lower developing frame 12*b* is provided with dowels 12*b*3 for engagement with the holes 12*a*17, respectively. With the dowels 12*b*3 being in engagement with the respective hole 12*a*17, the bottom surface of the lower developing frame 12*b* and the top surface of the flange 12*a*16 of the developing device frame 12*a* are welded to each other. By doing so, gap g is formed between the arcuate portion 12*a*6 and the lower developing frame 12*b* at each end. The dimension of the gap g is not constant when the lower developing frame 12*b* is fixed to the developing device frame 12*a*.

Figure 20:
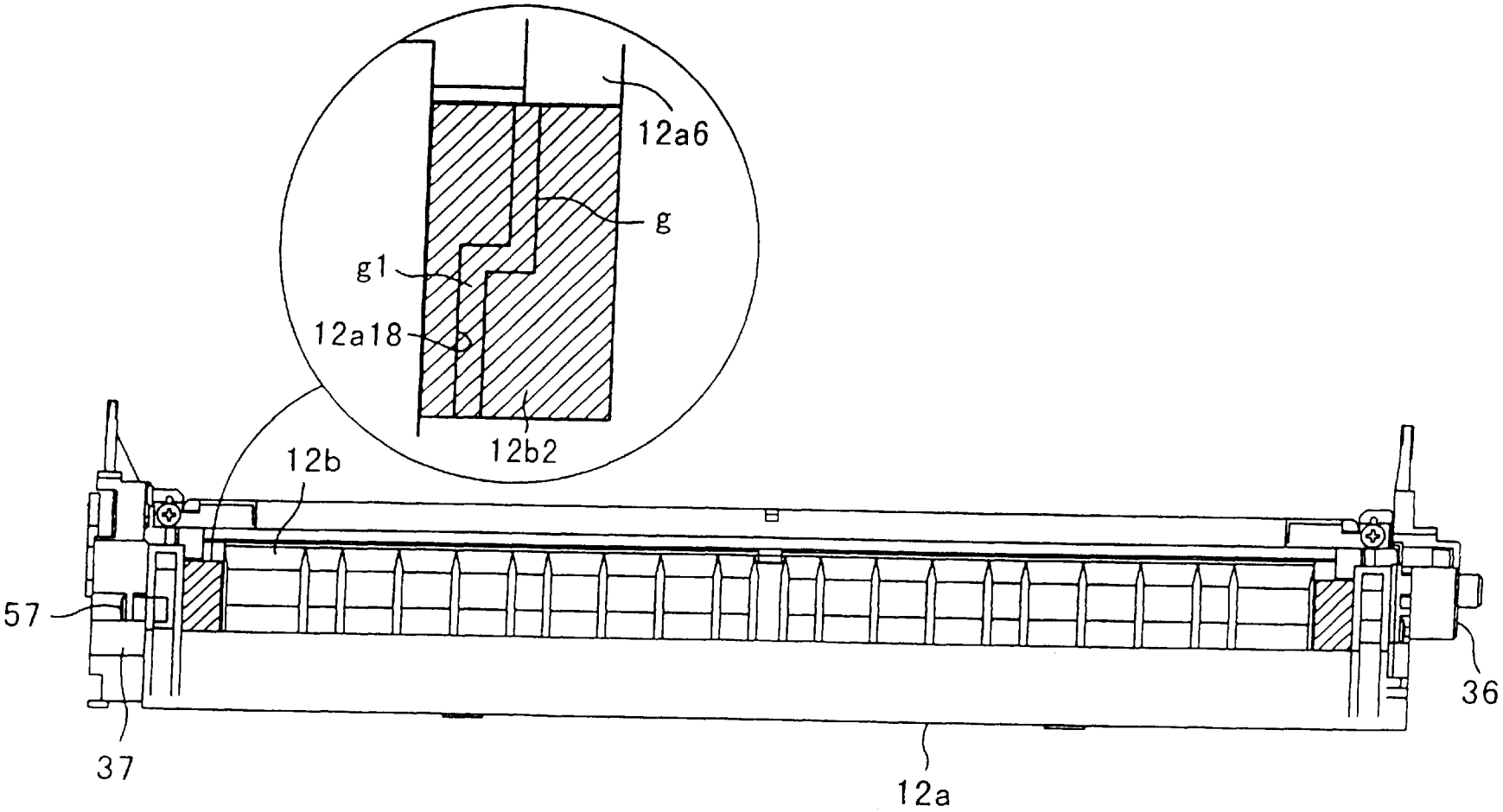
FIG. 20 is a front view of a toner developing container as seen in the direction opposite from the mounting direction of the process cartridge.

Each of the opposite ends of the lower developing frame 12*b* is provided with an outward projection 12*b*2 (FIG. 8). The developing device frame 12*a* is provided at each of the end portions with a recess 12*a*18 for engagement with a projection 12*b*2 when the dowels 12*b*3 are engaged with the holes 12*a*17 for the purpose of welding or bonding of the lower developing frame 12*b*. As shown in FIG. 20, a gap g1 is provided between the recess 12*a*18 and the projection 12*b*2. The gap is substantially equal to the gap g formed between the lower developing frame 12*b* and the arcuate portion 12*a*6.

As shown in FIG. 8, the arcuate portion 12*a*6 of the developing device frame 12*a* is provided with a sticking portion 12*a*20 to which the end seal 34 is stuck. The sticking portion 12*a*20 has an arcuate peripheral surface having a common axis with the arcuate portion 12*a*21 provided longitudinally outside of the arcuate portion 12*a*6. The axis is the rotational axis of the developing roller 10*d* in the toner developing container 12. The sticking portion 12*a*20 is provided with an arcuate surface having a radius which is smaller than that of the outer arcuate portion 12*a*21. An end of the sticking portion 12*a*20, as shown in FIG. 8, ends short of (inside) the circumference of the outer arcuate portion 12*a*21.

Figure 17:
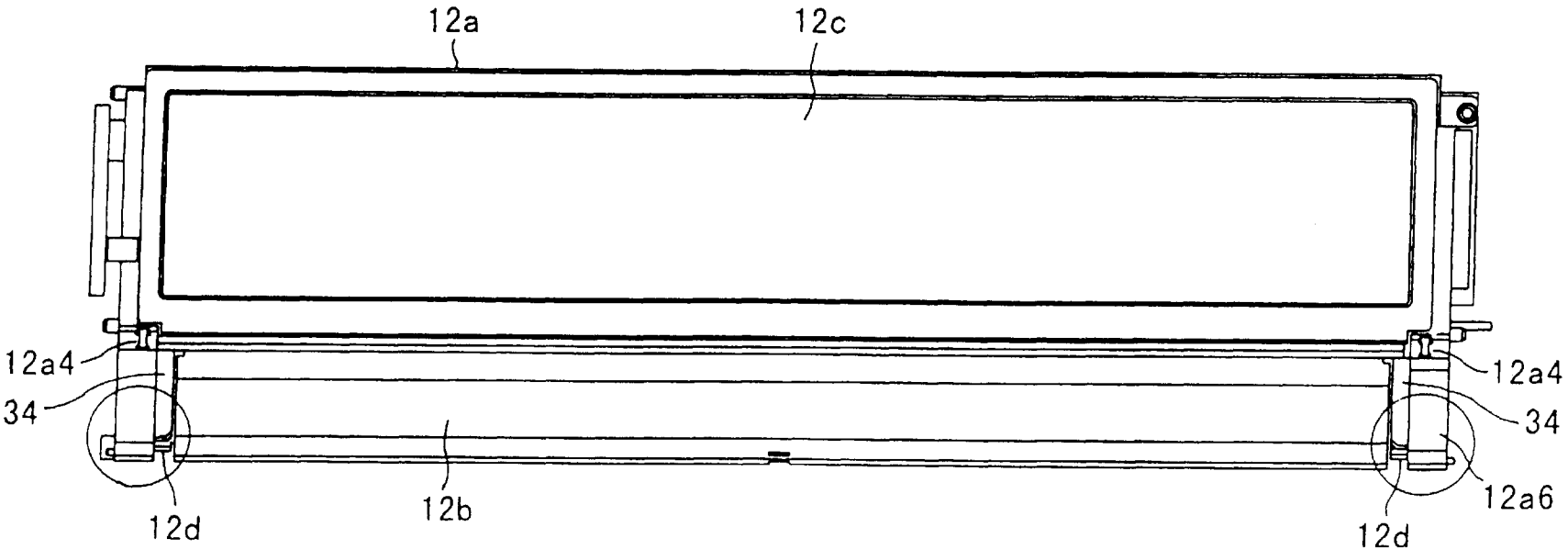
FIG. 17 is a top plan view of a toner developing container from which the developing roller and the developing blade have been removed.
Figure 18:
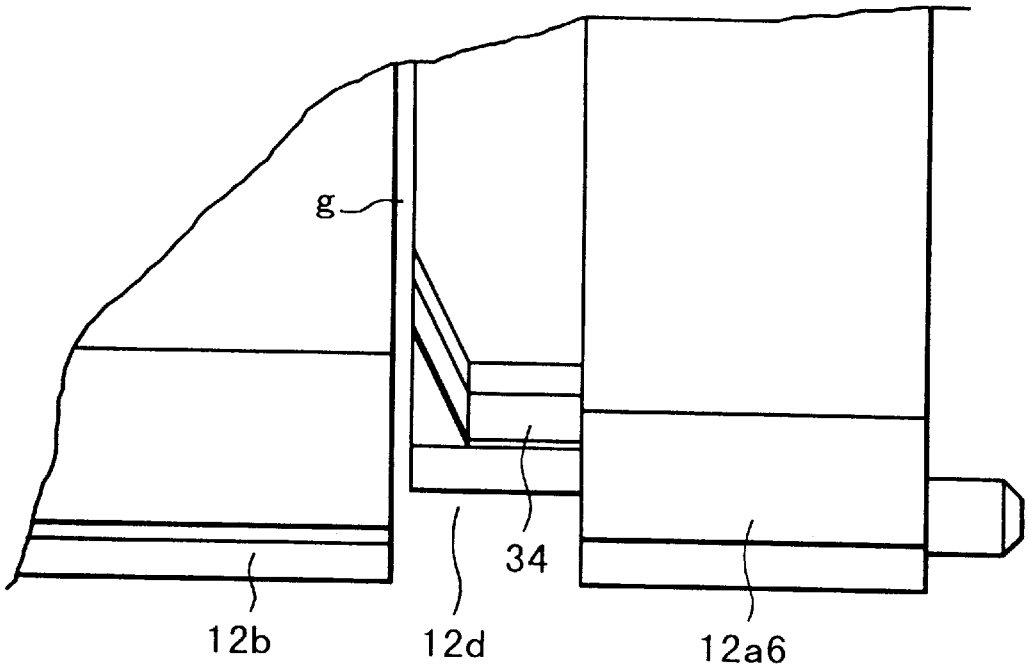
FIG. 18 is an enlarged view of the E part in FIG. 17.
Figure 19:
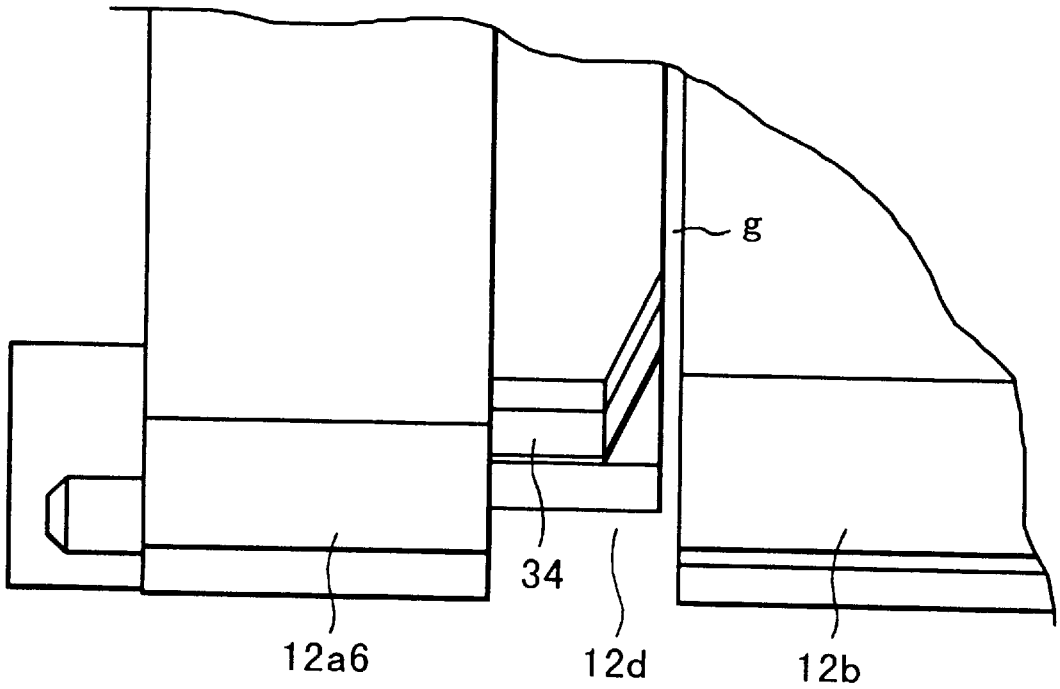
FIG. 19 is an enlarged view of the F part of FIG. 17.

As shown in FIGS. 17, 18, 19, when the lower developing frame is welded to or bonded to the developing device frame 12*a*, a slit 12*d* is provided between the arcuate portion 12*a*6 and the lower developing frame 12*b*.

Figure 21:
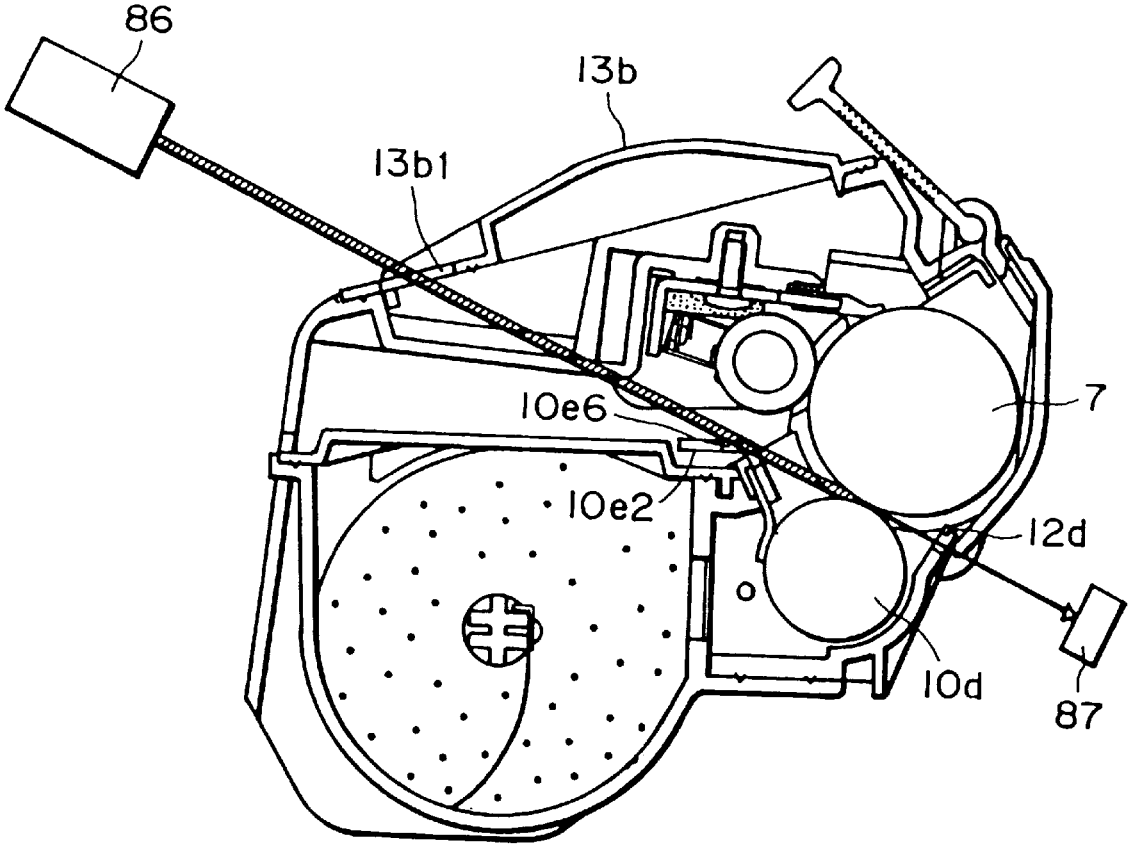
FIG. 21 is a longitudinal sectional view of a process cartridge.
Figure 22:
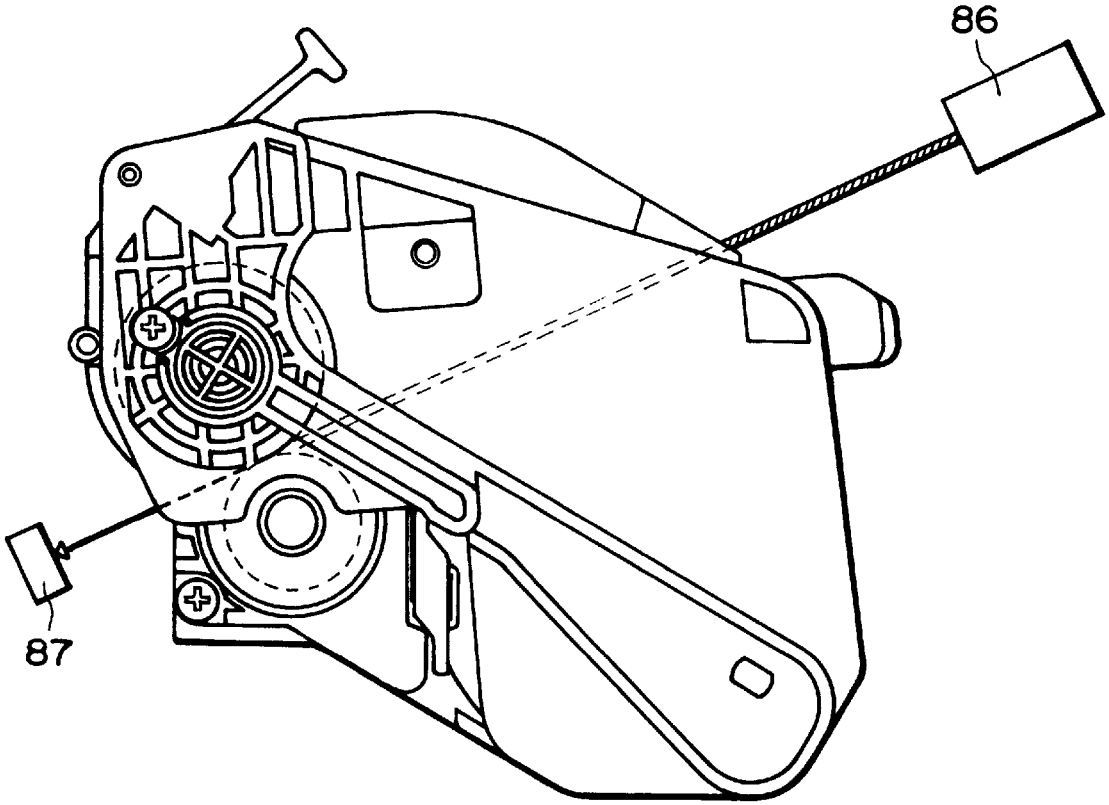
FIG. 22 is a side view of a process cartridge.
Figure 23:
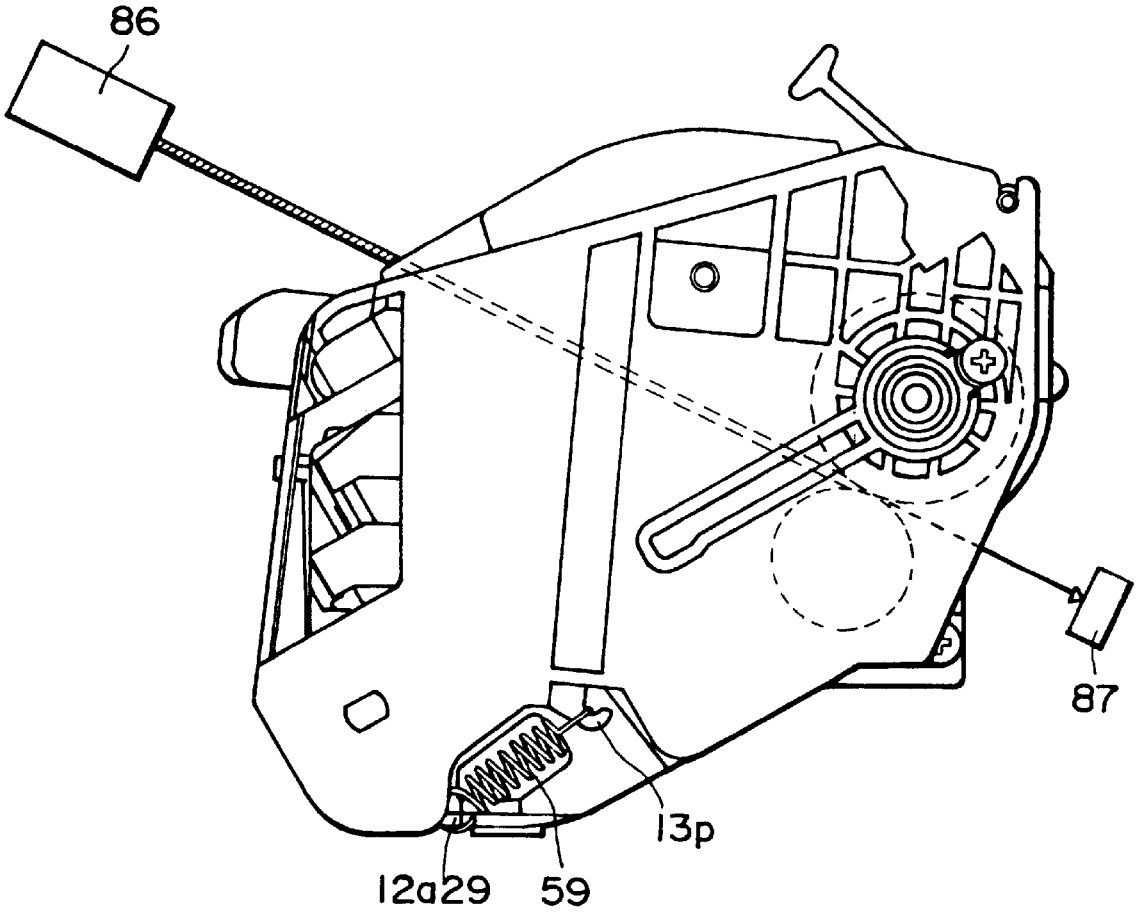
FIG. 23 is a side view of a process cartridge.

The slit 12*d*, as shown in FIGS. 21 to 23, is on an optical path of a laser beam passing through a gap (development gap) formed between the photosensitive drum 7 and the developing roller 10*d* provided by the spacer roller 10*d*1, which is disposed to each of the opposite end portions of the photosensitive drum 7 and the developing roller 10*d*. An optical path passes through the slit 12*d*, a slit 10*e*6 provided in the metal blade 10*e*2, and a hole 13*b*1 formed in the cap member 13*b*.

In FIG. 21, the laser beam emitted from the laser source 86 has a width that is larger than the gap ( approximately 300 μm) between the photosensitive drum 7 and the developing roller 10*d*. The laser beam emitted from the laser source 86 travels through the hole 13*b*1, the slit 10*e*6, the gap between the photosensitive drum 7 and the developing roller 10*d* and the slit 12*d*, and is then received by a photoreceptor 87. The width of the laser beam received by the photoreceptor 87 is measured in a direction parallel with the face of the sheet of the drawing of FIG. 21. Therefore, the development gap can be detected.

The measurement of the gap between the photosensitive drum 7 and the developing roller 10*d* using the laser beam, is effected at each of opposite longitudinal ends of the photosensitive drum 7 (two positions). Therefore, the hole 13*b*1, the slit and the slit 10*e*6, 12*d* are each provided at least two positions (adjacent opposite longitudinal ends).

After the lower developing frame 12*b* is welded to the developing device frame 12*a*, the end seal 34 and the seal 35 are mounted.

Figure 16:
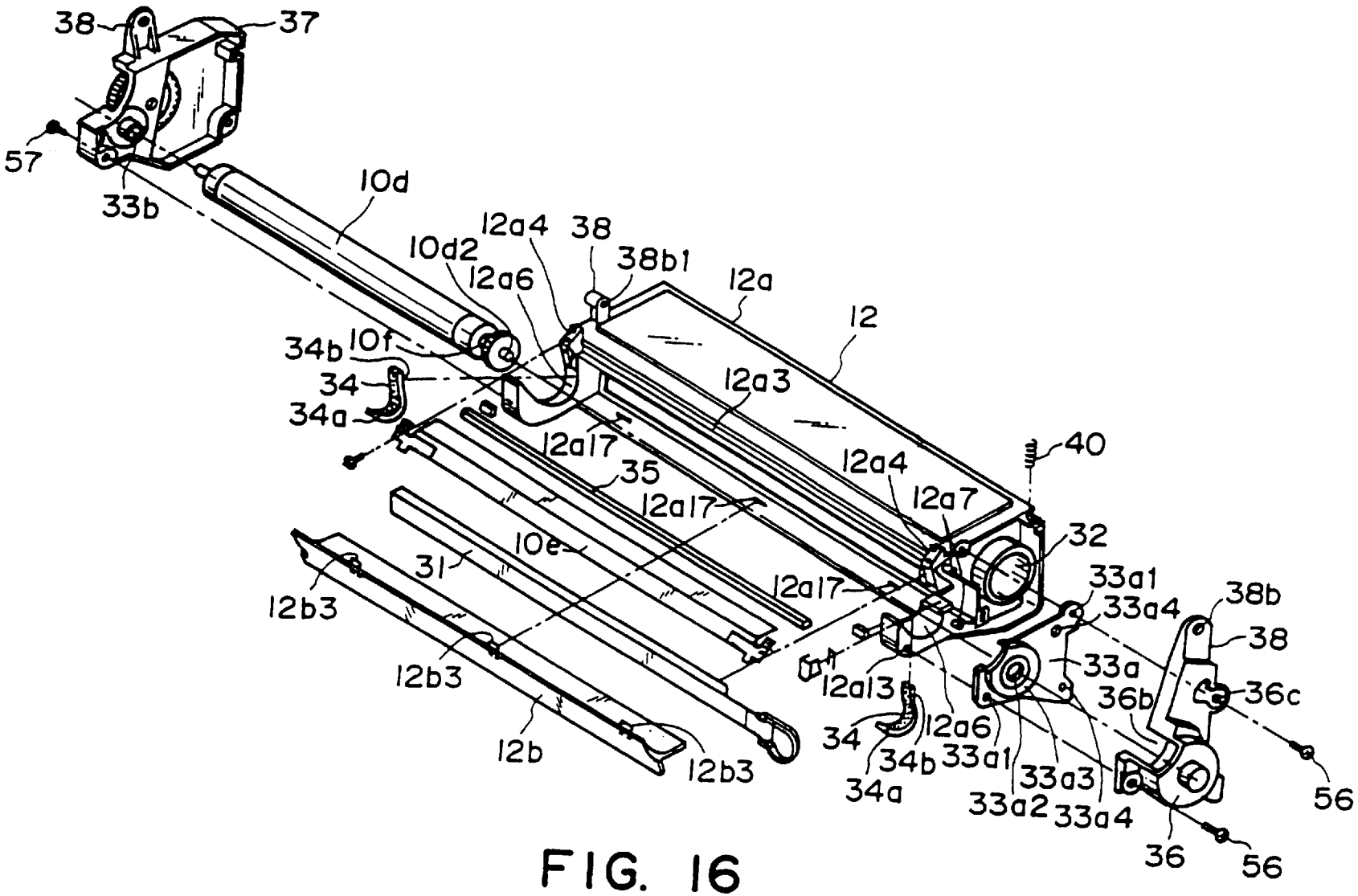
FIG. 16 is an exploded perspective view of a toner developing container.

As shown in FIG. 16, the end seal 34 functions to provide a seal between the developing device frame 12*a* and each of the end portions of the developing blade 10*e* and each of the end portions of the developing roller 10*d,* and it comprises an arcuate portion 34*a* contactable to the developing roller 10*d* along its circumferential surface and an integral linear portion 34*b* along a rear surface of each of the end portions of the metal blade 10*e*2. The outer circumference of the arcuate portion 34*a* is stuck to the sticking portion 12*a*20 of the developing device frame 12*a*.

As shown in FIG. 4, a seal 35 of urethane foam or the like is mounted and extended between blade mounting seat surfaces 12*a*4 formed above the toner discharging opening 12*a*1 of the toner discharging, and the developing blade 10*e* is screwed on the blade mounting seat surface 12*a*4 with the seal 35 therebetween. By doing so, the seal 35 is compressed between the metal blade 10*e*2 and a developing device frame 12*a* so that sealing is accomplished between the metal blade 10*e*2 and the developing device frame 12*a*.

Figure 24:
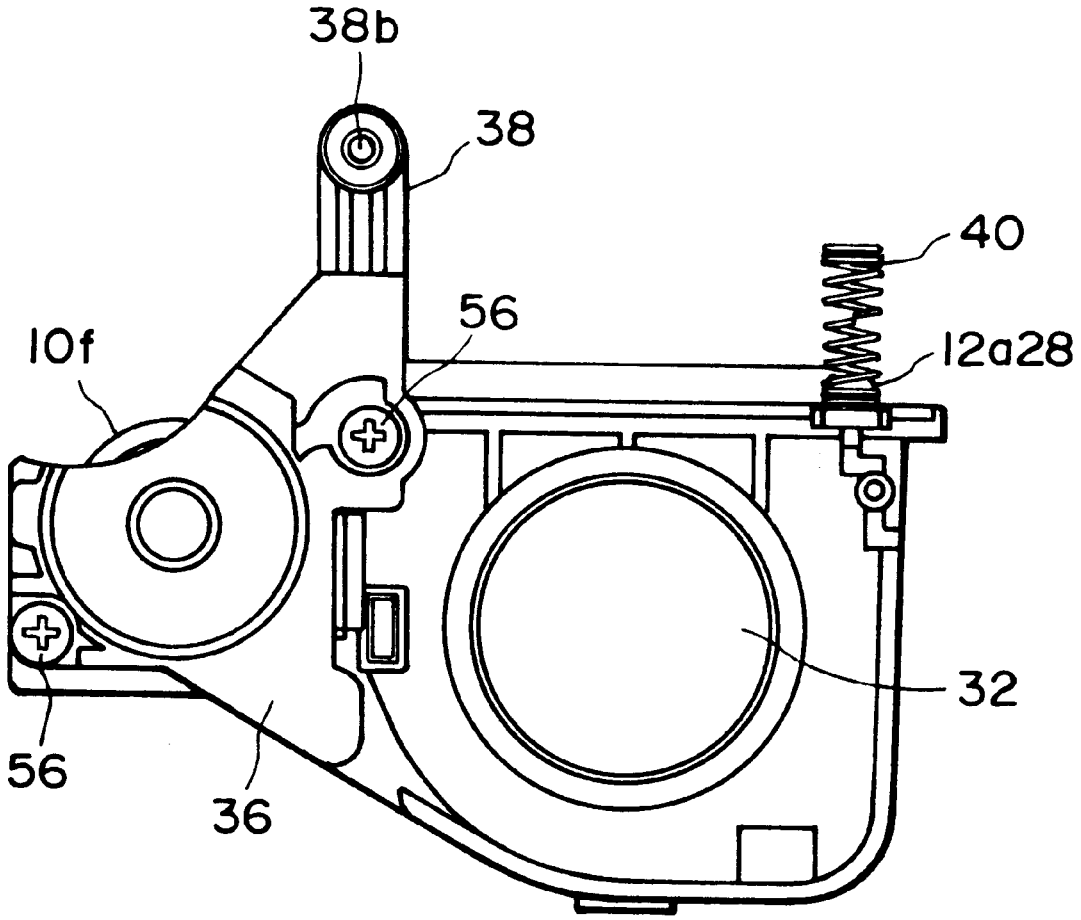
FIG. 24 is a side view of a toner developing container.
Figure 25:
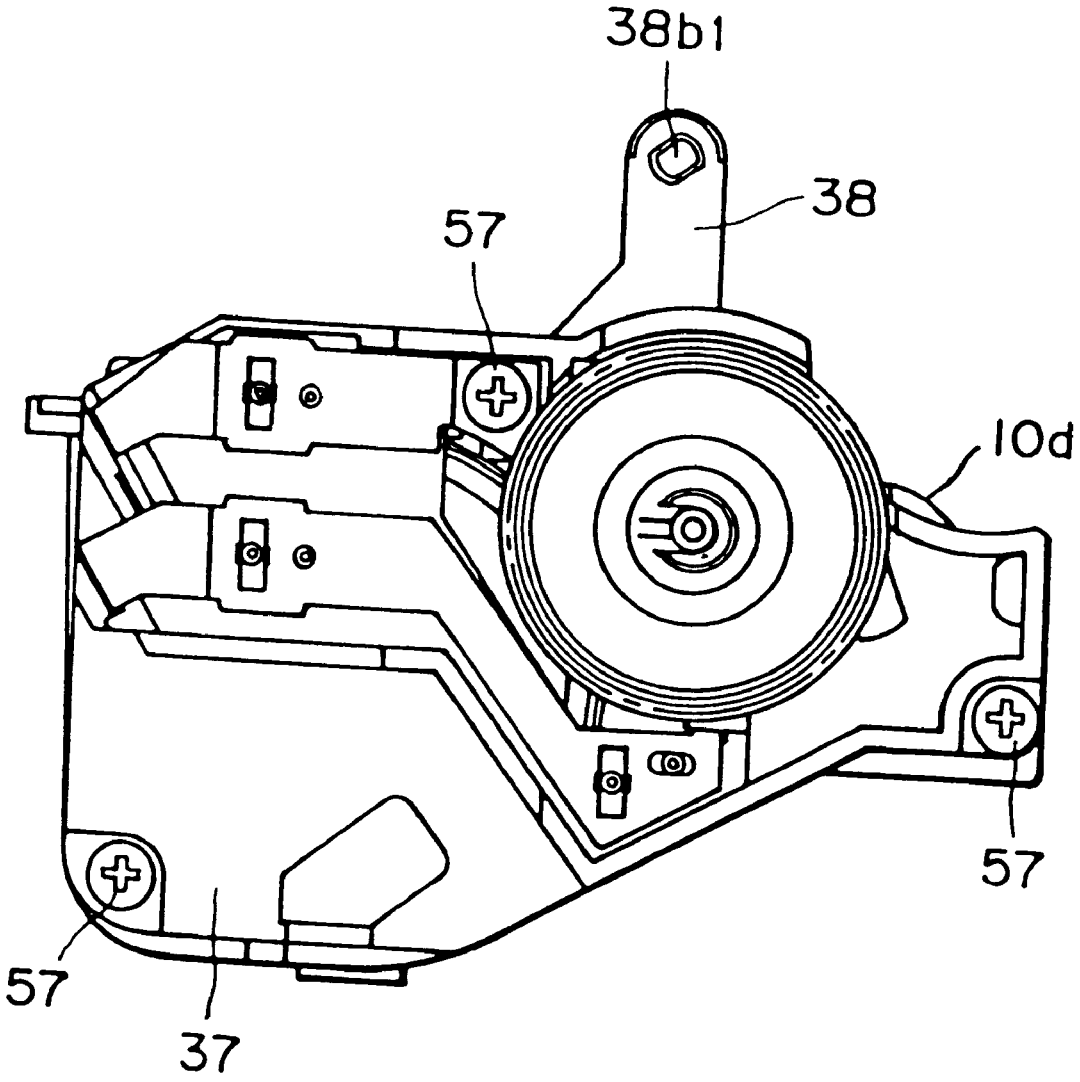
FIG. 25 is a side view of a toner developing container.

The development holder 36 shown in FIGS. 16, 24 is secured to one of the ends of the developing device frame 12*a,* and the development holder 37 shown in FIGS. 16, 25 is secured to the other end thereof. The development holders 36, 37 are fixed to the developing device frame 12*a* by small screws 56, 57.

The shaft 10*d*2 of the developing roller 10*d* at one end is engaged with a fixed bearing 33*b* which is in the form of a shaft integral with the development holder 37 shown in FIGS. 15, 16. The developing roller shaft 10*d*2 is received by a bearing hole 33*a*2 of the bearing 33*a* at the other end of the developing roller 10*d,* and as shown in FIG. 15, a hole 33*a*4 is engaged with a positioning dowel 12*a*7 provided on the developing device frame 12*a* at an outside of one of the longitudinal ends. Then, the developing roller gear 10*f* is engaged with the developing roller shaft 10*d*2. The engaging portion 33*a*3 of the bearing 33*a* is engaged with a part cylindrical engaging portion 36*a* of the development holder 36. At this time, the developing roller gear 10*f* is accommodated in the development holder 36. A small screw 56 is penetrated through a hole 36*c* of the development holder 36, and a hole 33*a*1 of the bearing 33*a* and is threaded into a female screw 12*a*13 of the developing device frame 12*a*. The gear accommodating portion 36*b* outside the development holder 36 is part-cylindrical, and when the toner developing container 12 and a cleaner container 13 are coupled, the developing roller gear 10*f* is brought into meshing engagement with the drum gear 51*a* through the open part of the gear accommodating portion 36*b*.

Each of the development holders 36, 37 is provided with an integral arm portion 38 functioning as a connecting portion for connecting the toner developing container 12 and the cleaner container 13.

The toner developing container 12 having the various members constituting the developing means and the cleaner container 13 having the various members constituting the photosensitive drum 7, the charging roller 8, and a cleaning means are coupled by the arm portions 38 to constitute the process cartridge B.

(Coupling Between Toner Developing Container and Cleaner Container)

Figure 7:
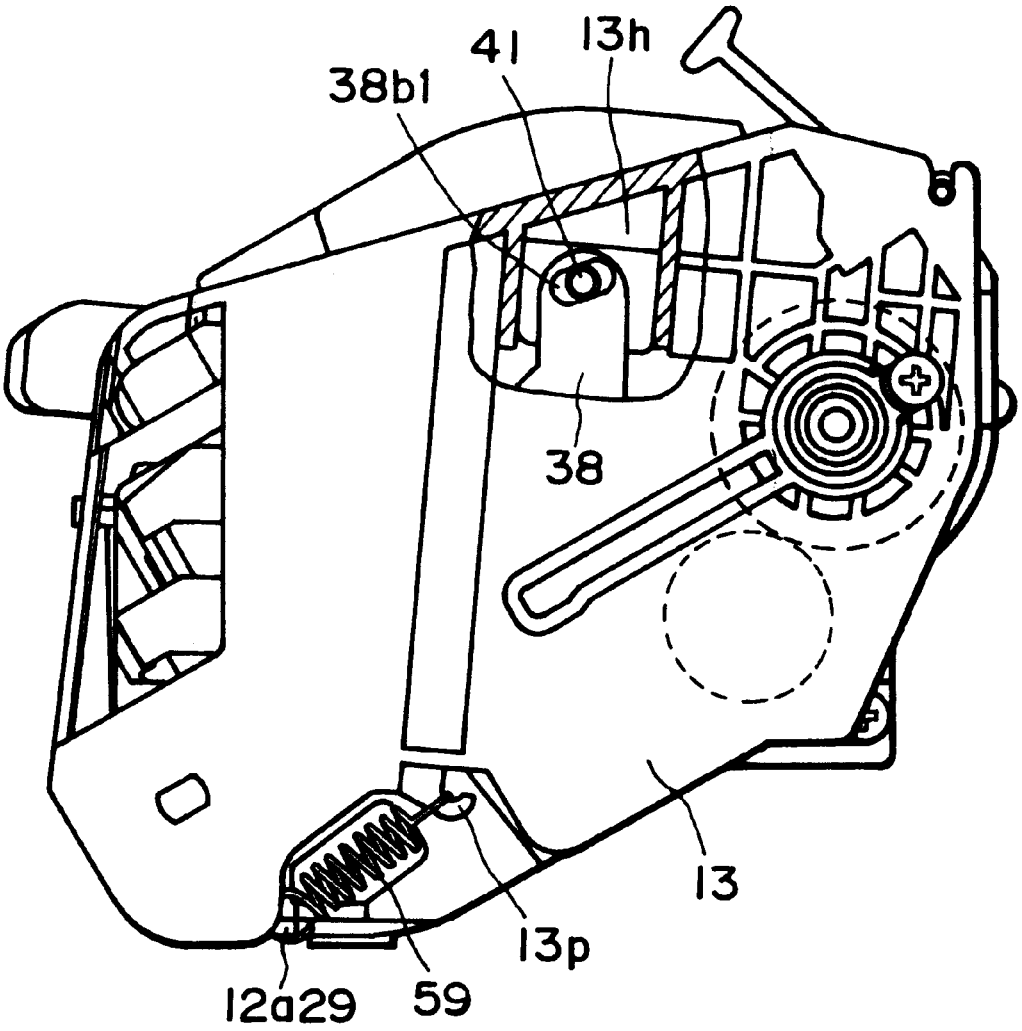
FIG. 7 is a partly broken side view of a process cartridge.
Figure 11:
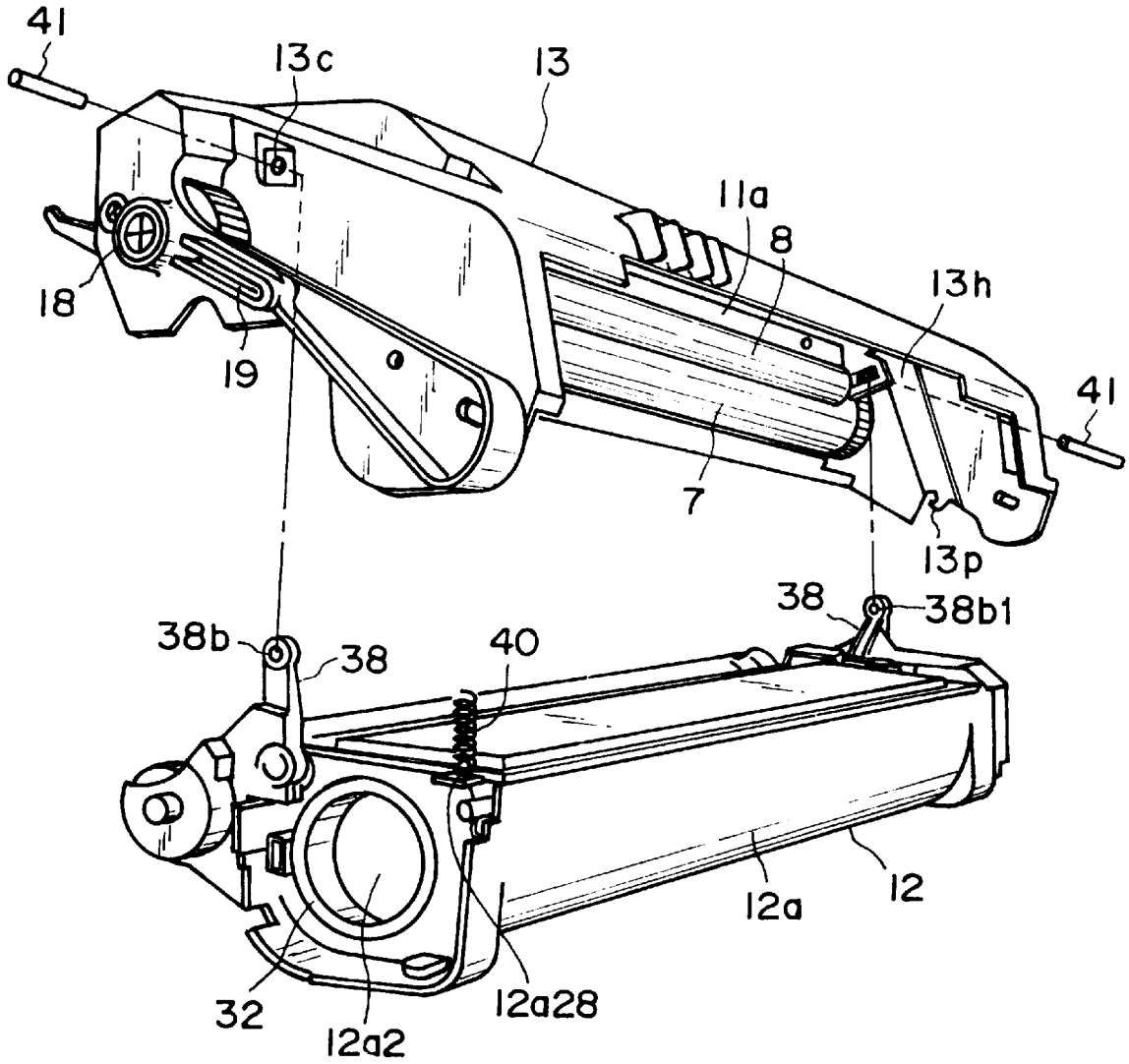
FIG. 11 is an exploded perspective view of a toner developing container and a cleaner container.
Figure 12:
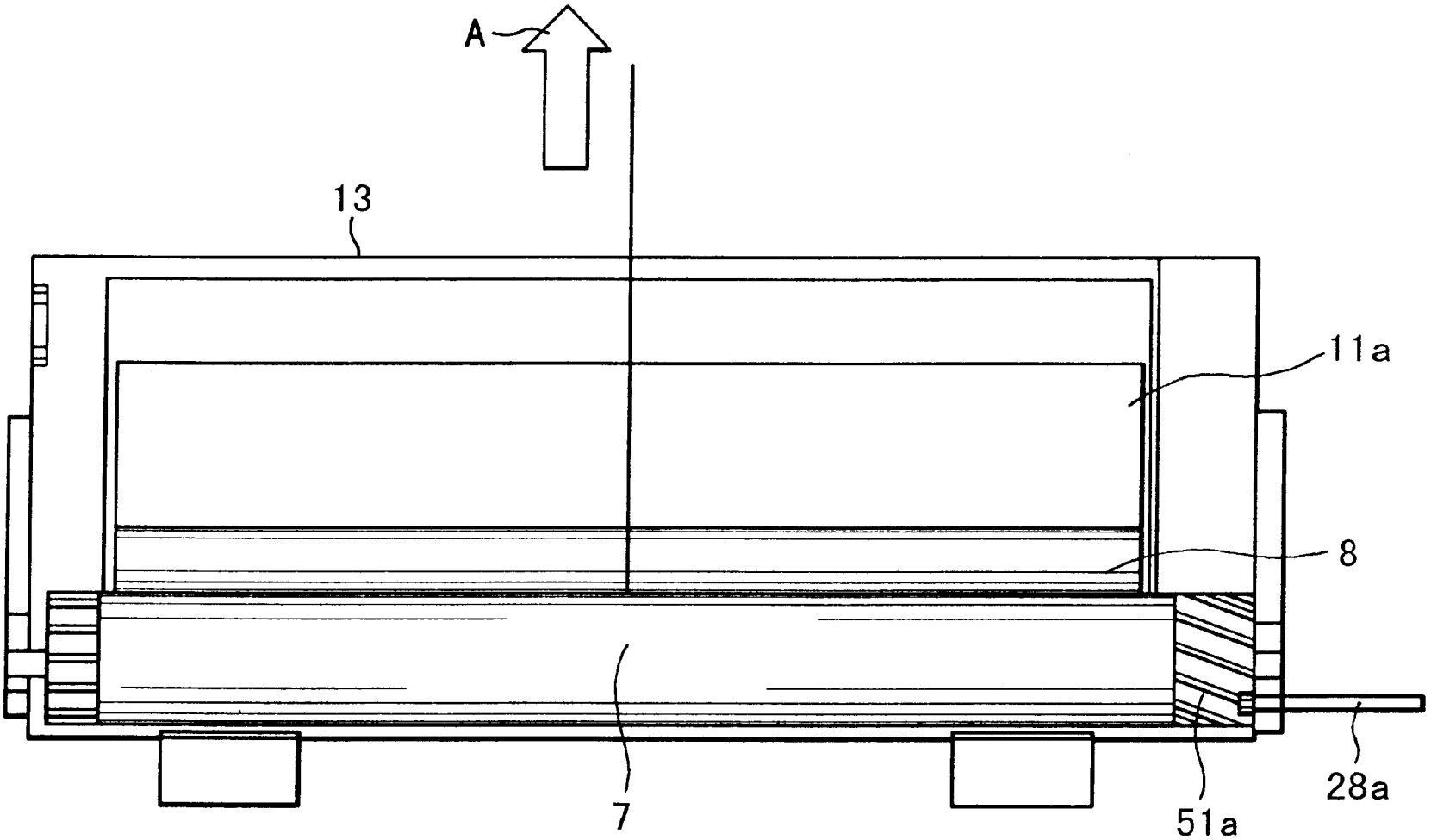
FIG. 12 is a developed schematic view of a cleaner container.
Figure 26:
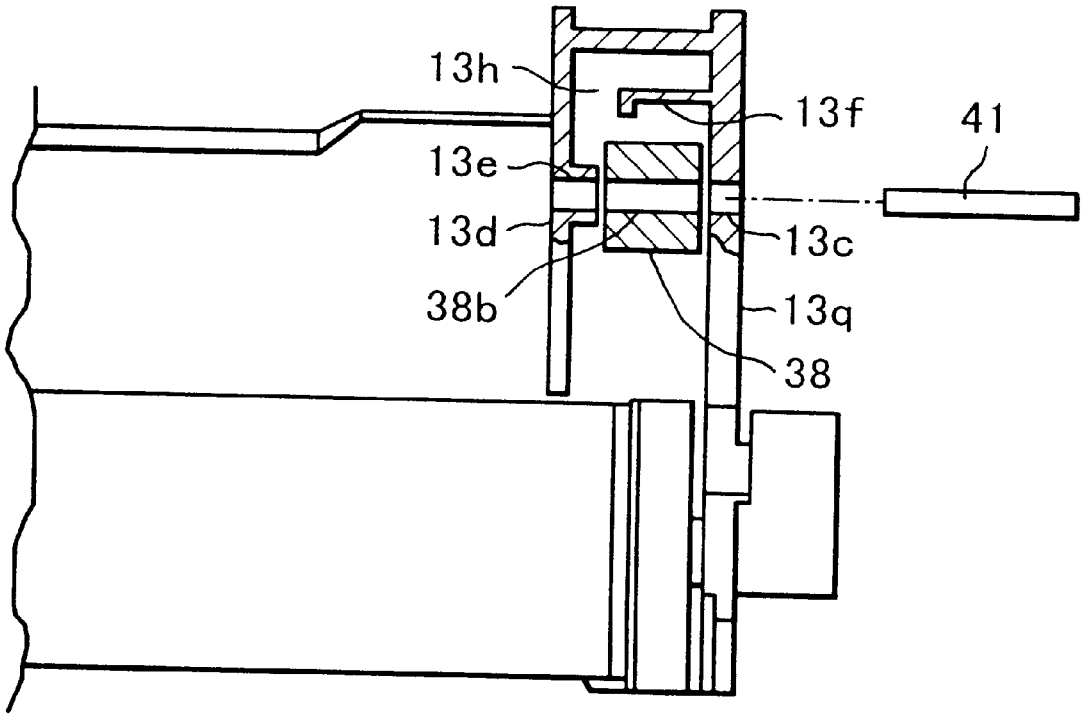
FIG. 26 is a longitudinal sectional view of a connecting portion between the toner developing container and the cleaner container.
Figure 27:
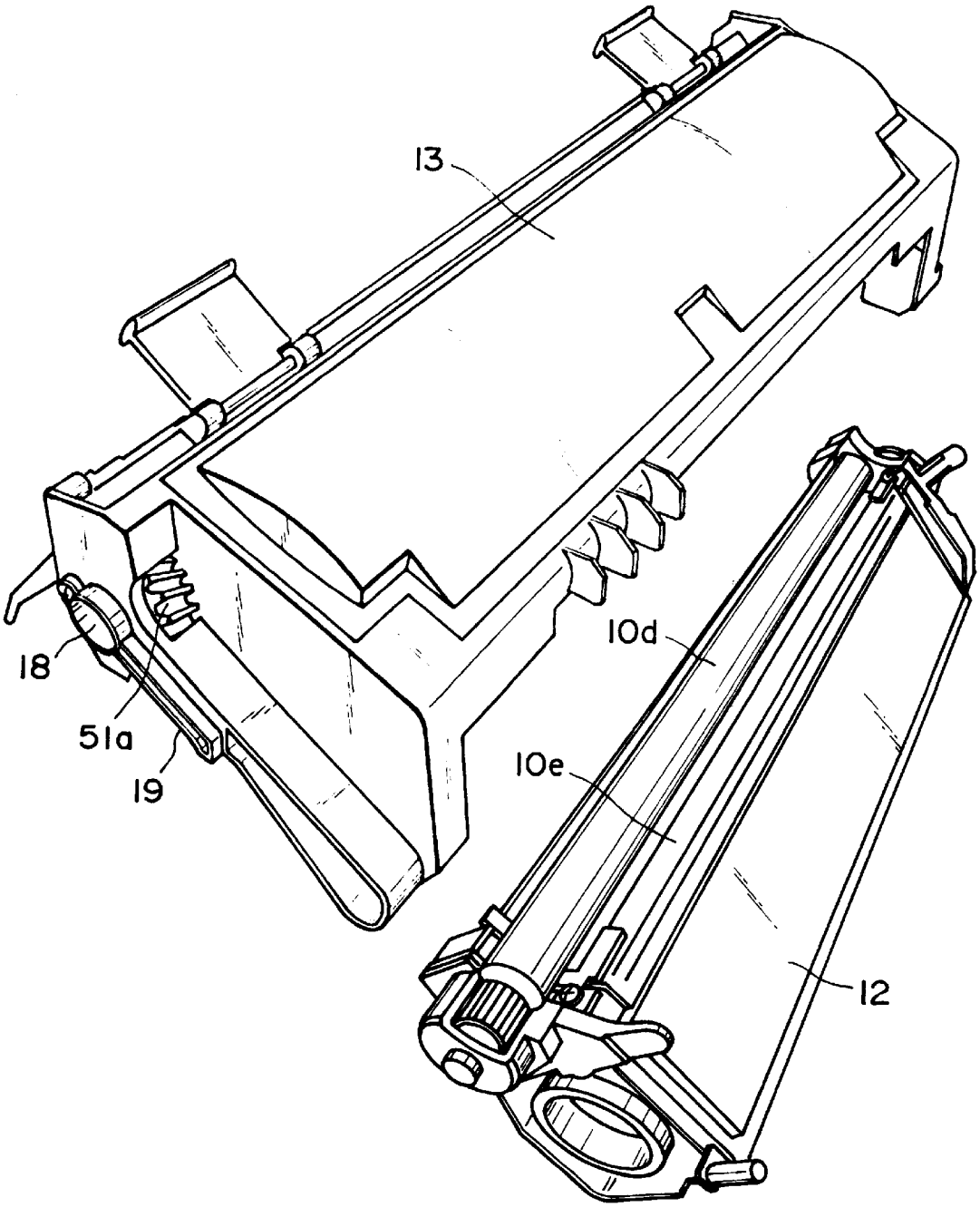
FIG. 27 is a perspective view of a toner developing container and a cleaner container.
Figure 28:
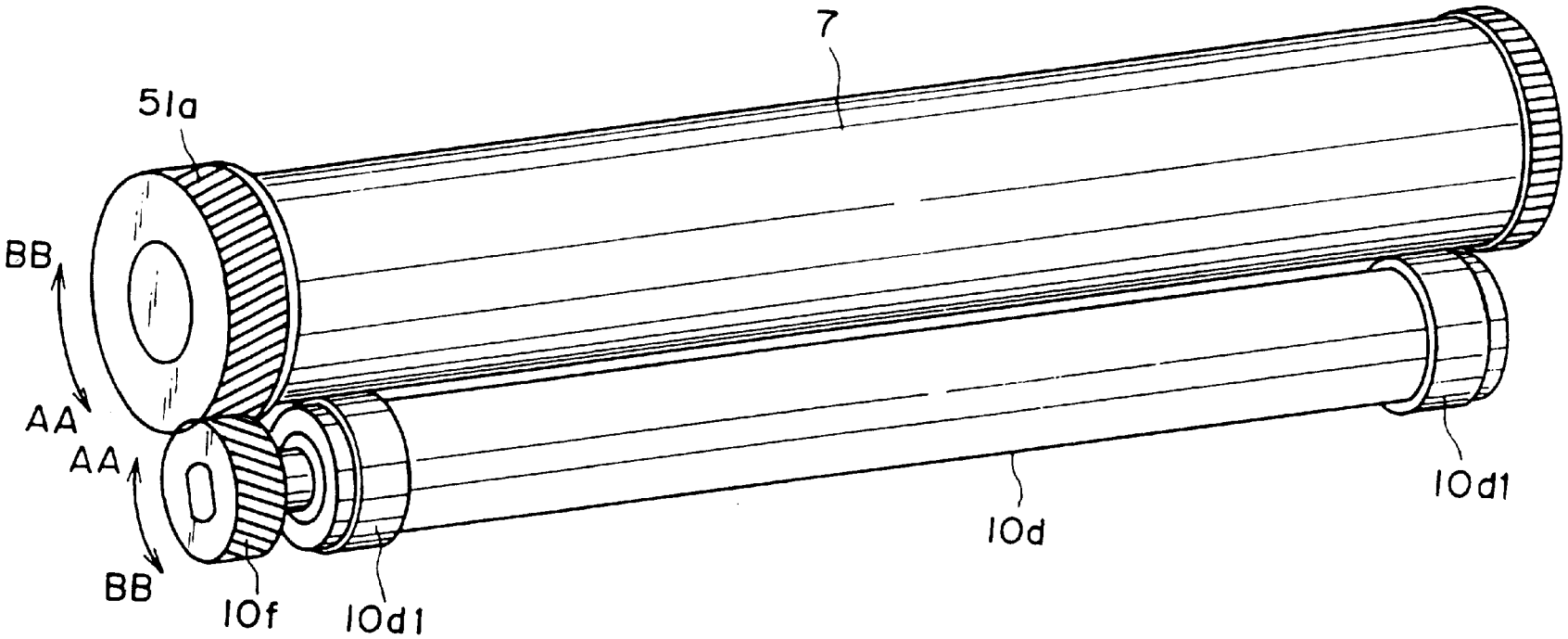
FIG. 28 is a perspective view of the photosensitive drum and the developing roller during an image forming operation.

Referring to FIGS. 7, 11, 24, 25, 26, a description will be provided as to the coupling between the toner developing container 12 and the cleaner container 13. FIGS. 7 and 11 are a side view and a perspective view illustrating the coupling between the containers 12, 13; FIG. 26 shows the inside of the coupling portion; and FIGS. 24, 25 are side views of the copper end portion of the toner developing container 12. The containers 12, 13 are rotatably coupled through the arms 38 at the opposite ends. Since the covering structures at the left and right ends are substantially the same, a description will be provided as to only one end. However, the portions with a difference between the left and right hands will be described for the respective ends.

As shown in FIGS. 11 and 24, the developing device frame 12*a* is provided with an integral spring mounting portion 12*a*28, on which a compression coil spring 40 is mounted. The position of the compression coil spring 40 is adjacent one of the longitudinal ends of the developing device frame 12*a,* and is away from the arm portion 38 in a direction perpendicular to the longitudinal direction. The compression coil spring 40 is extended out in parallel with the arm portion 38. At a longitudinal free end portion of the arm portion 38 where the compression coil spring 40 is provided, a through-hole 38*b* is provided for receiving a pin 41, which will be described hereinafter. As shown in FIG. 26, an outer wall 13*q* of the cleaner container 13 is provided with a hole 13*c* for receiving the pin 41, and an inner wall 13*d* thereof is provided with a hole 13*e* for being press fitted by the pin 41. The hole 13*c* and the hole 13*e* are aligned along a line parallel with the photosensitive drum 7. An elongated bore 38*b*1 is formed in the arm portion 38 and the other end of the cleaner container 13, and a line connecting the center of the elongated bore 38*b*1 and the hole 38*b* passes through the centers of the holes 13*c,* 13*e*. The elongated bore 38*b*1 is elongated in a direction parallel with a line connecting the center of the photosensitive drum 7 and the center of the developing roller 10*d,* and a width of the elongated bore 38*b*1 is equal to the diameter of the pin 41.

When the toner developing container 12 and the cleaner container 13 are coupled together with each other, as shown in FIGS. 7 and 11, the arm portion 38 of the toner developing container 12 is inserted into the recess 13*h* of the cleaner container 13, and the pin 41 is penetrated through the hole 13*c,* 13*c* of the cleaner container 13, the through hole 38*b,* of the arm portion 38, and the elongated bore 38*b*1 in the order named, and is press-fitted into the hole 13*e,* 13*e* of the inner wall 13*d*. By doing so, the toner developing container 12 and the cleaner container 13 are rotatably coupled for rotation about the pin 41. At this time, the compression coil spring 40 mounted to the developing device frame 12*a* is compressed by the abutment to the spring seat 13*f* (FIG. 26) of the cleaner container 13. The photosensitive drum 7 and the developing roller 10*d* are urged toward each other about the pin 41 so that spacer rollers 10*d*1 of the developing roller 10*d* are press-contacted to the photosensitive drum 7.

Because of the provision of the elongated bore 38*b*1, the photosensitive drum 7 and spacer rollers 10*d*1 of the developing roller 10*d* are contacted to each other at the generating lines thereof. The generating lines are parallel with the center lines of the photosensitive drum 7 and the developing roller 10*d*.

FIG. 7 shows an end surface portion that is opposite from the end where the compression coil spring 40 is provided. Opposite ends of a tension coil spring 59 are engaged with a spring hook 13*p* of the cleaner container 13 and a spring hook 12*a*29 of the developing device frame 12*a* of the toner developing container 12, respectively. The direction of the tension coil spring 59 is substantially parallel with a line connecting the centers of the photosensitive drum 7 and the developing roller 10*d*.

By the compression coil spring 40 and the tension coil spring 59, the developing roller 10*d* mounted in the toner developing container 12 is urged toward the photosensitive drum 7 mounted in the cleaner container 13, so that spacer rollers 10*d*1 at the opposite longitudinal ends of the developing roller 10*d* are contacted to the photosensitive drum 7, by which the developing roller 10*d* is correctly positioned relative to the photosensitive drum 7. The drum gear 51*a* fixed to the end of the photosensitive drum 7 is brought into meshing engagement with the developing roller gear 10*f* fixed to the end of the developing roller 10*d,* so that a driving force can be transmitted.

(Gap between Photosensitive Drum and Developing Roller)

When the photosensitive drum 7 and the developing roller 10*d* are contacted to each other, the drum gear 51*a* and the developing roller gear 10*f* are in meshing engagement with each other. When the process cartridge is transported with the drum gear 51*a* and the developing roller gear 10*f* are in meshing engagement with each other, the tooth surfaces of the gears are in contact, and therefore, they may be rotated by impact or vibration. If the direction of the rotation is as indicated by an arrow AA in FIG. 52 (the same direction as in the image forming operation), there is no problem. However, the direction of the rotation is not assured, since the vibration or the impact during the transportation occurs at random. If the photosensitive drum 7 rotates in the direction indicated by an arrow BB, that is, if the photosensitive drum 7 and the developing roller 10*d* are rotated in the direction opposite from the normal direction, the toner may be leaked out through between the jaw seal 42 (blow-out preventing sheet) and the developing roller 10*d,* and in the worst-case, the seal 42 may be wound around the developing roller since the preventing sheet is contacted to the developing roller counter directionally. In addition, the scraper 60, mounted to each of the opposite ends of the developing blade 10*e* and functioning to guide the toner inwardly at the opposite ends of the developing roller 10*d,* can operate correctly when the developing roller 10*d* rotates in the normal direction, and therefore, if it is rotated in the wrong direction, the toner may leak out at the opposite ends of the developing roller 10*d.*

In this embodiment, the back clearance of the meshing between the drum gear 51*a* and the developing roller gear 10*f* is made larger than that during the image formation operation to avoid abutment between the tooth surfaces during transportation. Another alternative is to disengage them for transportation.

Figure 29:
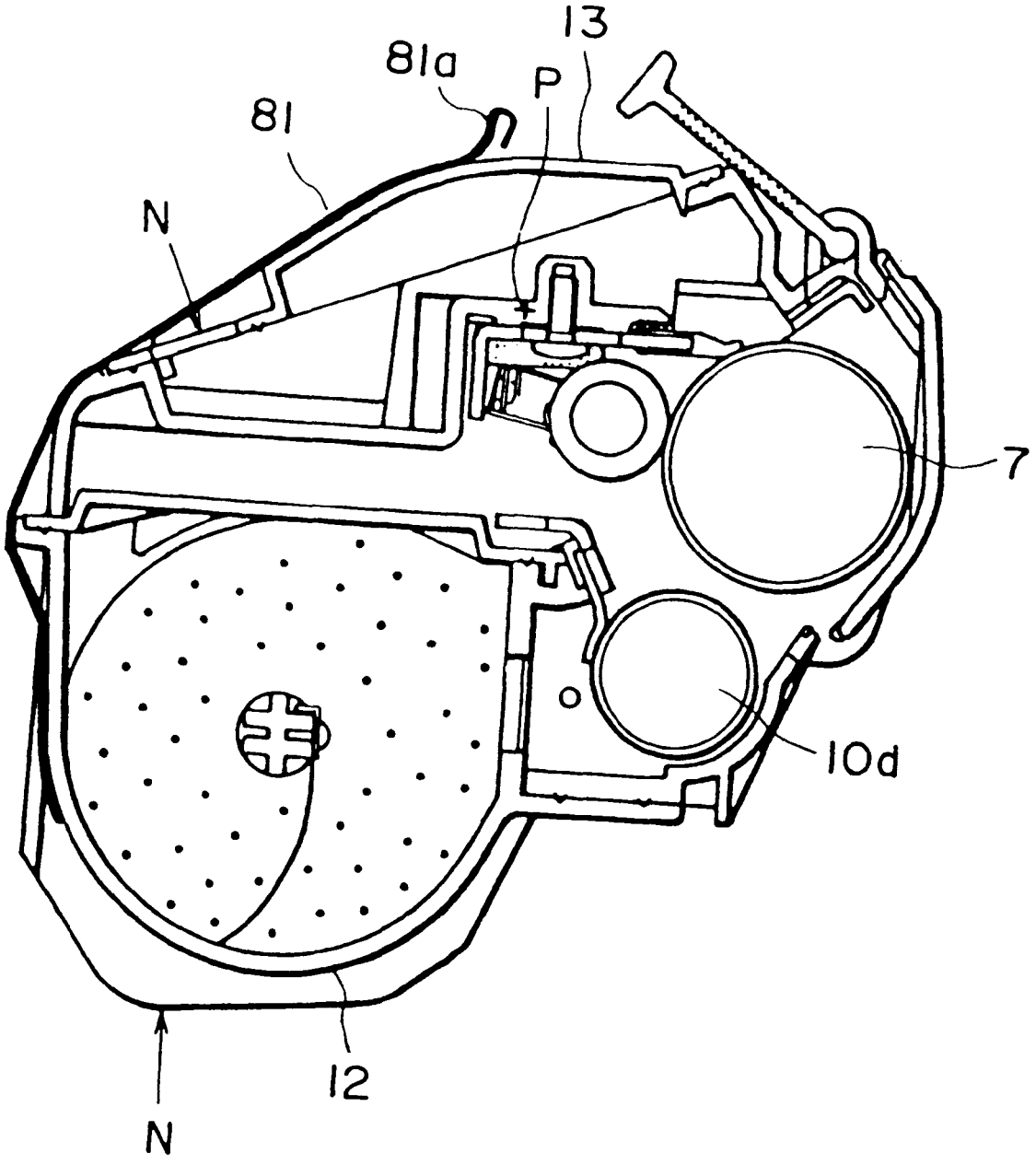
FIG. 29 is a longitudinal sectional view of the process cartridge during the transportation thereof.
Figure 30:
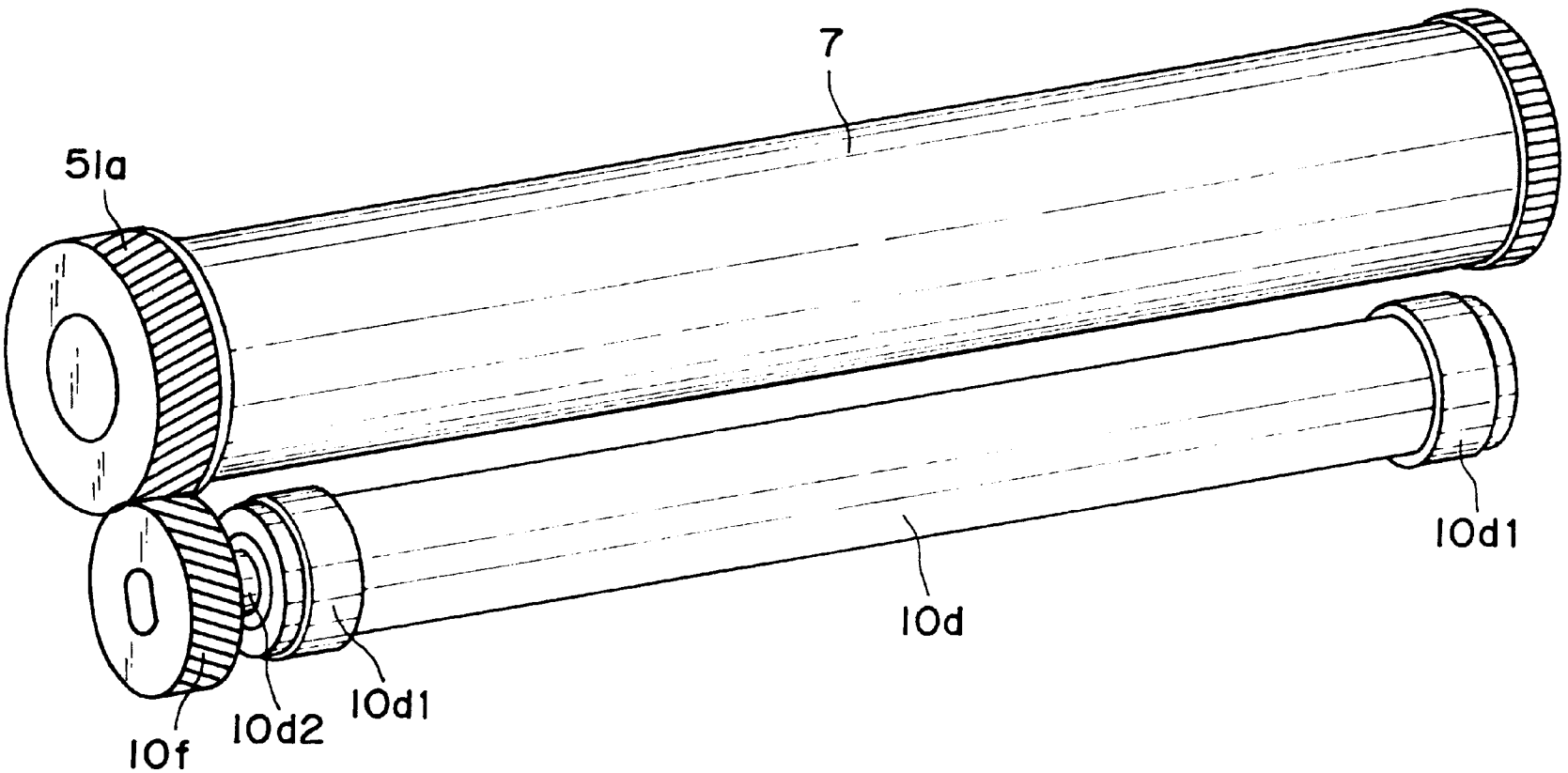
FIG. 30 is a perspective view illustrating a relationship between the photosensitive drum and the charging roller during transportation of the process cartridge.

Referring to FIG. 30, a description will be provided as to means for maintaining the disengaged state or large back clearance between the drum gear 51*a* and the developing roller gear 10*f.* In the case of FIG. 29, a tape is stuck over the toner developing container 12 and the cleaner container 13 with the drum gear 51*a* and the developing roller gear 10*f* disengaged from each other or with the large back clearance.

Figure 31:
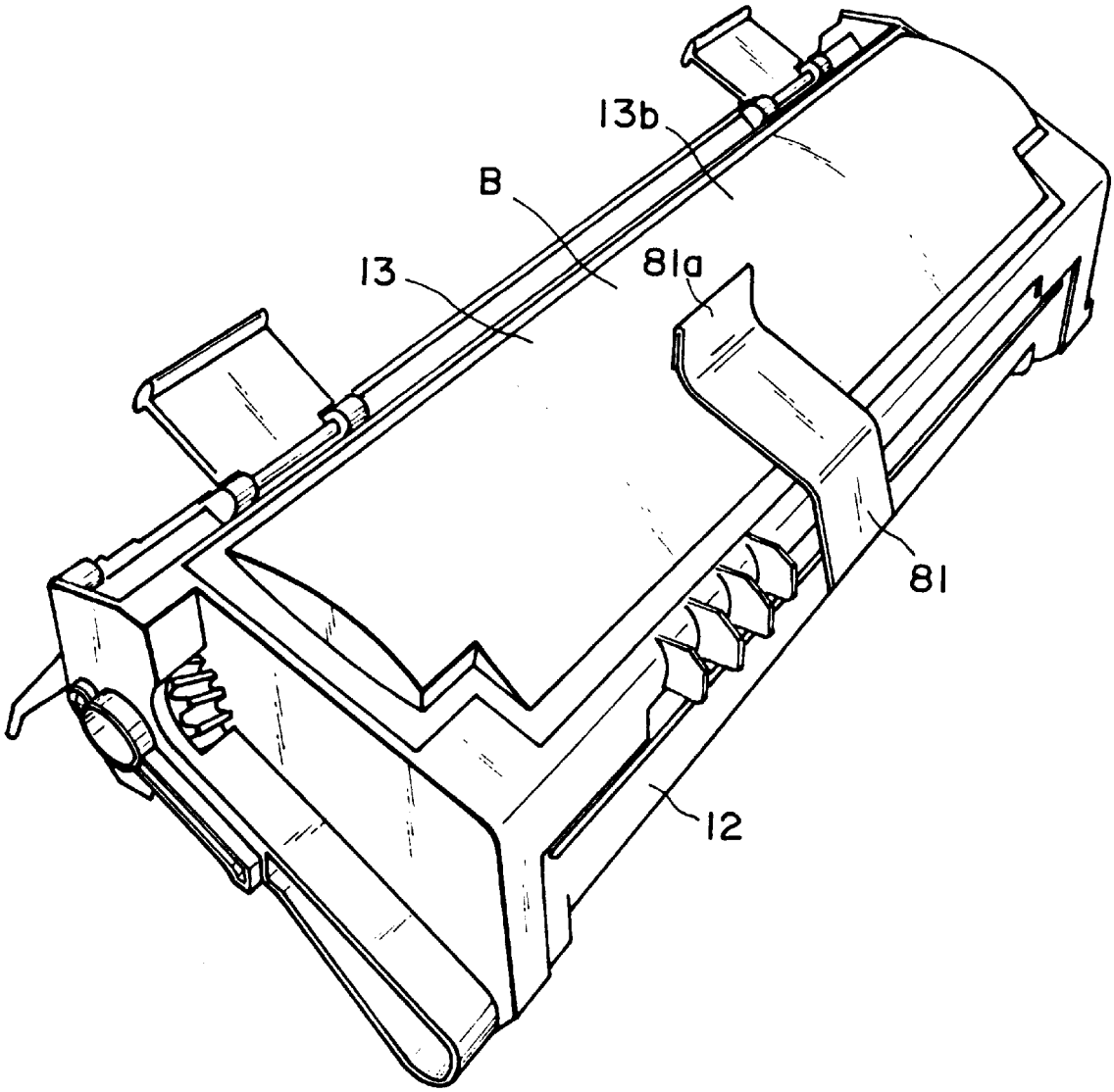
FIG. 31 is a perspective view of a process 10 cartridge during transportation thereof.

FIG. 31 is a perspective view with the tape stuck in this manner.

Figure 59:
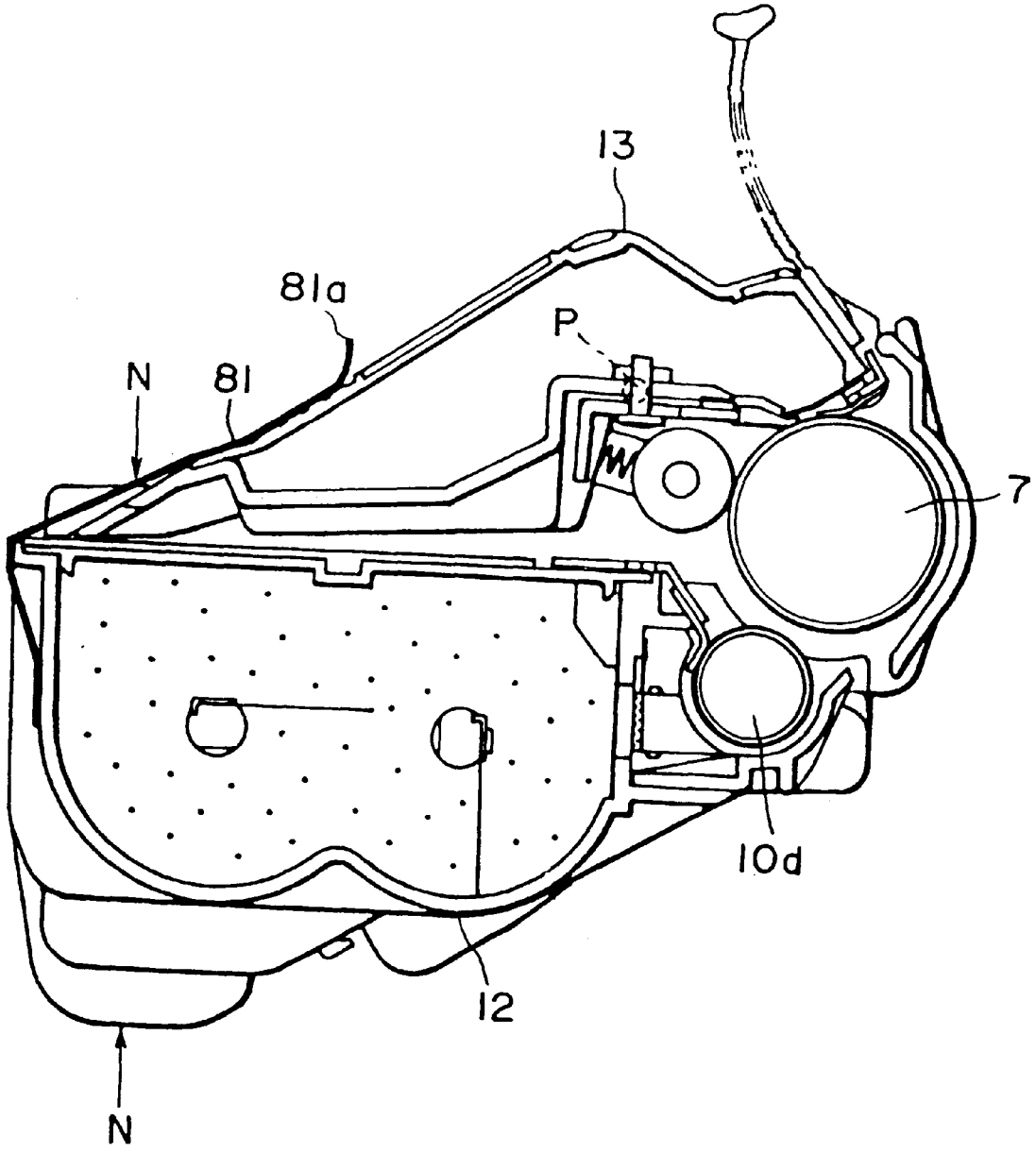
FIG. 59 is a longitudinal sectional view of a process cartridge during transportation.

More particularly, a force is applied to bias the toner developing container 12 and the cleaner container 13 toward each other and positions across a vertical surface passing through a point P which is a pivot between the toner developing container 12 and the cleaner container 13 from the portion where the photosensitive drum 7 and the developing roller 10*d* are provided, as indicated by an arrow N in FIGS. 29 and 59, by which the back clearance between the drum gear 51*a* and the developing roller gear 10*f* is increased, or they are disengaged from each other. The force is against the spring force provided by the tension coil spring 59 (FIG. 7) and the compression coil spring 40 (FIG. 11) for urging the photosensitive drum 7 and the developing roller 10*d* toward each other. Therefore, the tape 81 is stretched by the springs 40, 59. Therefore, the tape 81 has sufficient width and thickness such that stress during the transportation is within a tolerable range, and in addition, the adhesive material or the adhesive material for the tape has also sufficient bonding strength against the toner developing device frame 12*a* and the cleaner container 13.

When the photosensitive drum 7 and the developing roller 10*d* are moved away from each other, the back clearance between the drum gear 51*a* and the developing roller gear 10*f* increases, and the gear teeth are separated from each other.

The tape 81 may be an adhesive tape which is easy to handle.

The tape 81 is a single tape, and is disposed in the longitudinally central portion of the process cartridge B. By doing so, the containers 12, 13 are not deformed irregularly despite the regular force imparted to the toner developing container 12 and/or the cleaner container 13.

An end of the tape 81 is folded back to provide a tag 81*a*. The tape 81 can be peeled off using the tag 81*a*.

After the manufacturing of the process cartridge B, it is shipped out with the back clearance between the developing roller gear 10*f* and the drum gear 51*a* increased by the tape 81 or with the gears disengaged from each other. Before a user mounts the process cartridge B into the main assembly 14 of the image forming apparatus, the tape 81 is peeled off using the tag 81*a*. Or, the tape 81 is cut by scissors at a portion between the toner developing container 12 and the cleaner container 13 where the tape 81 is not stuck. Then, the toner developing container 12 and the cleaner container 13 are rotated to each other about the pin 41 by the spring forces provided by the springs 40, 59, so that developing roller gear 10*f* and the drum gear 51*a* are brought into meshing engagement with each other. Simultaneously, the spacer roller 10*d*1 and the photosensitive drum 7 are press-contacted to each other.

When the developing roller gear 10*f* and the drum gear 51*a* are disengaged from each other, the exposure opening 9 for transmitting the image light onto the photosensitive drum 7 is closed. Therefore, the photosensitive drum 7 is substantially completely closed with the aid of the drum shutter member 28.

When the process cartridge is transported with the developing roller gear 10*f* and the drum gear 51*a* disengaged from each other, the image region of the photosensitive drum 7 is protected from contacting the developing roller 10*d* due to such a large force imparted to the process cartridge B that the gap ( approximately 300 $\mu$m) between the developing roller 10*d* and the photosensitive drum 7 otherwise disappears.

(Embodiment 2)

A description will be provided as to Embodiment 2 in conjunction with the accompanying drawings.

A description will be provided as to general arrangements of the image forming apparatus and a process cartridge according to an embodiment of the present invention, and then as to an assembling method of the process cartridge. The process steps of disassembling and reassembling the process cartridge and the reassembled process cartridge will be described finally.

Referring to FIGS. 32 to 36, the process cartridge and the image forming apparatus to which the process cartridge is detachably mountable, will be described.

(General Arrangement)

Figure 32:
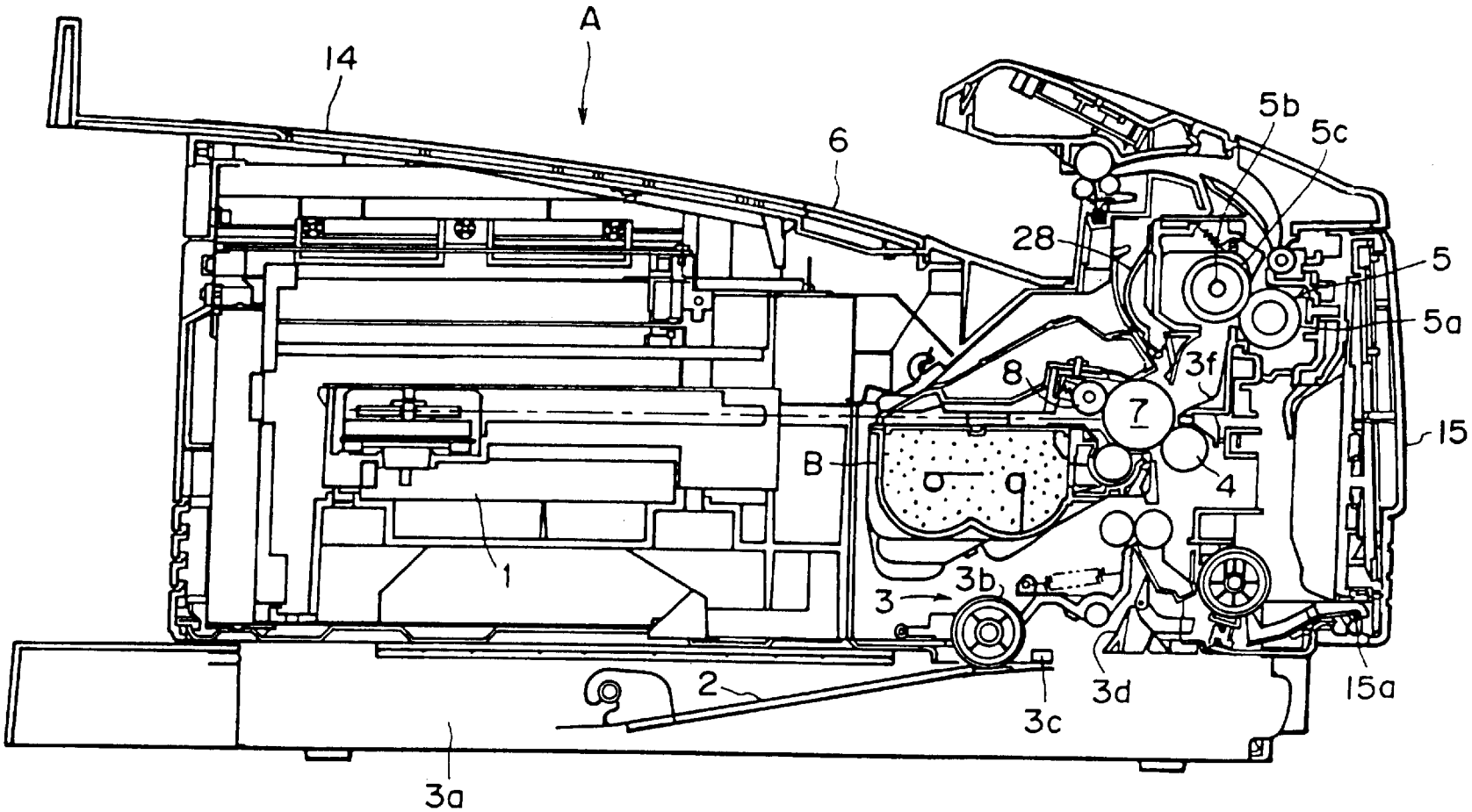
FIG. 32 is a longitudinal sectional view of a toner filling according to a further embodiment of the present invention.

The image forming apparatus in this embodiment is an electrophotographic image forming apparatus (laser beam printer) A, as shown in FIG. 32, wherein an electrophotographic photosensitive member in the form of a drum is exposed to information light modulated in accordance with image information from an optical system 1, so that a latent image is formed on the photosensitive member, and the latent image is developed into a toner image. In synchronism with the formation of the toner image, the recording material 2 is fed out one by one from a sheet feeding cassette 3*a* using a pick-up roller 3*b* and separation claws 3*c* press-contacted at the corners of the top surface of the recording material 2, and the sheet is fed by feeding means 3 including a feeding path 3*d* and a pair of registration rollers. The toner image formed on the electrophotographic photosensitive member in the process cartridge B is transferred onto the recording material 2 by applying a voltage to transfer means in the form of a transfer roller 4, and then the recording material 2 is fed to fixing means 5 on a feeding path 3*f*. The fixing means 5 comprises a driving roller 5*a* and a fixing roller 5*c* containing a heater 5*b* therein, and pressure and heat are imparted to the recording material 2 which is passing therethrough, by which the transferred toner image is fixed on the recording material. The recording material 2 is further fed by discharging rollers, and is discharged to a discharging portion 6 through a reverse feeding path.

Figure 35:
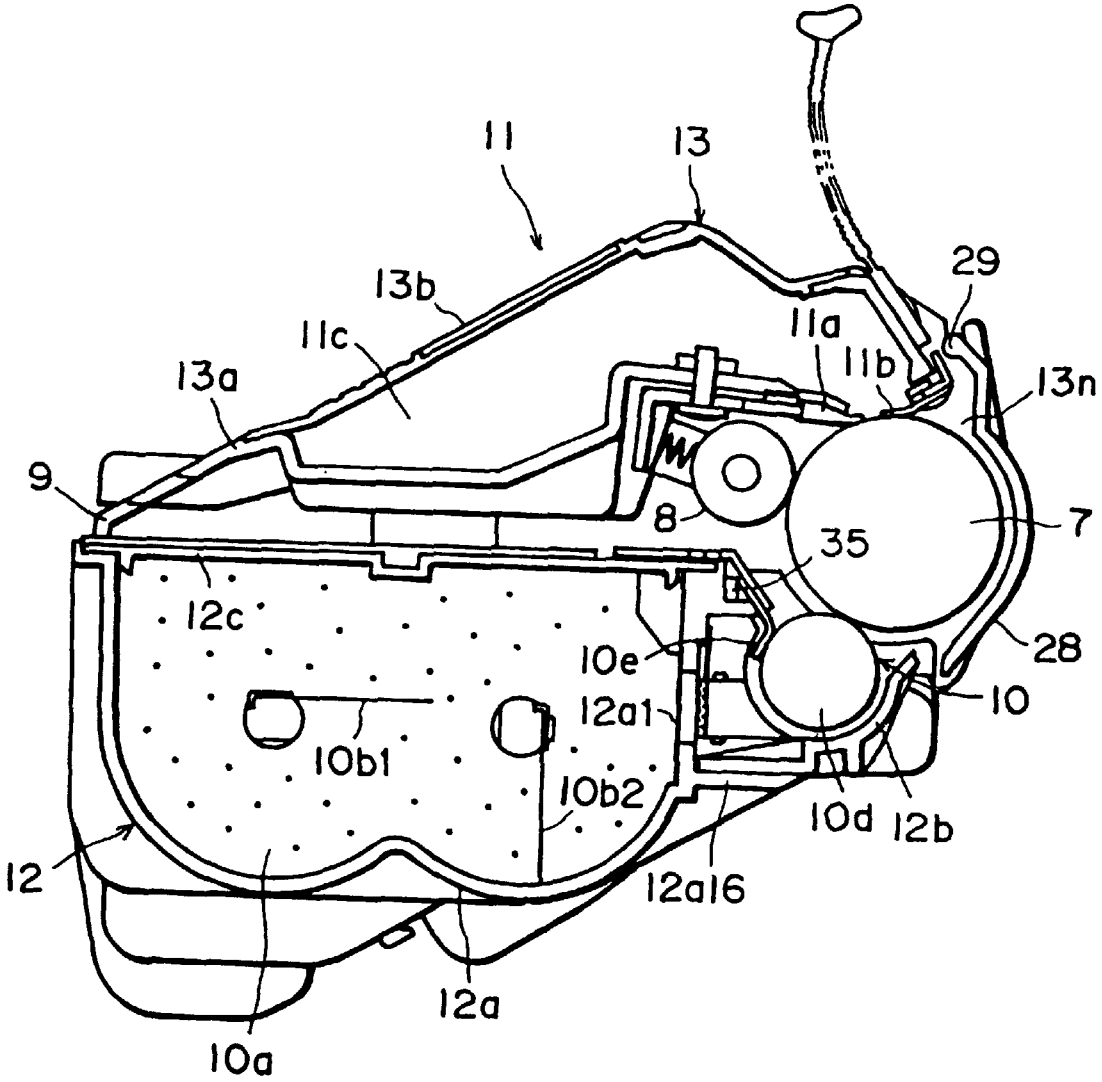
FIG. 35 is a longitudinal sectional view of a process cartridge.

On the other hand, the process cartridge B contains the electrophotographic photosensitive member and at least one of process means. Here, the process means includes charging means for electrically charging the electrophotographic photosensitive member, the developing means for developing a latent image formed on the electrophotographic photosensitive member, and cleaning means for cleaning the surface of the electrophotographic photosensitive member to remove residual toner. As shown in FIG. 35, in the process cartridge B of this embodiment, the electrophotographic photosensitive member in the form of an electrophotographic photosensitive drum 7 having a photosensitive layer is rotated, and a voltage is applied on the charging roller 8 which is the charging means, so that the surface of the photosensitive drum 7 is uniformly charged, and the photosensitive drum 7 is exposed to image light from the optical system 1 through an opening 9, by which an electrostatic latent image is formed, and the image is developed by developing means 10.

In the developing means 10, the toner in a toner accommodating portion 10*a* is fed out by feeding means in the form of a rotatable toner feeding member 10*b*, and a developing roller 10*d* containing therein a stationary magnet is rotated, by which a layer of toner particles triboelectrically charged by the developing blade 10*e* is formed on the surface of the developing roller 10*d*. The toner is selectively transferred onto the photosensitive drum 7 so that a toner image is formed. The developing roller 10*d* functions to supply the toner to the photosensitive drum 7. The developing blade 10*e* functions to regulate a thickness of the toner layer on the surface of the developing roller 10*d*.

The transfer roller 4 is supplied with a voltage having a polarity opposite from the polarity of the toner image, by which the toner image is transferred onto the recording material 2. Thereafter, the residual toner remaining on the photosensitive drum 7 is scraped off by the cleaning blade 11*a*, and the removed toner is received by a receptor sheet 11*b*, and the received toner is collected into a removed toner accommodating portion 11*c*.

(Cartridge Mounting Means)

Various parts such as the photosensitive drum 7 are supported and accommodated in a cartridge frame that is provided by coupling the toner developing container 12 and the cleaner container 13. The cartridge is mounted to the main assembly 14 of the apparatus.

Figure 33:
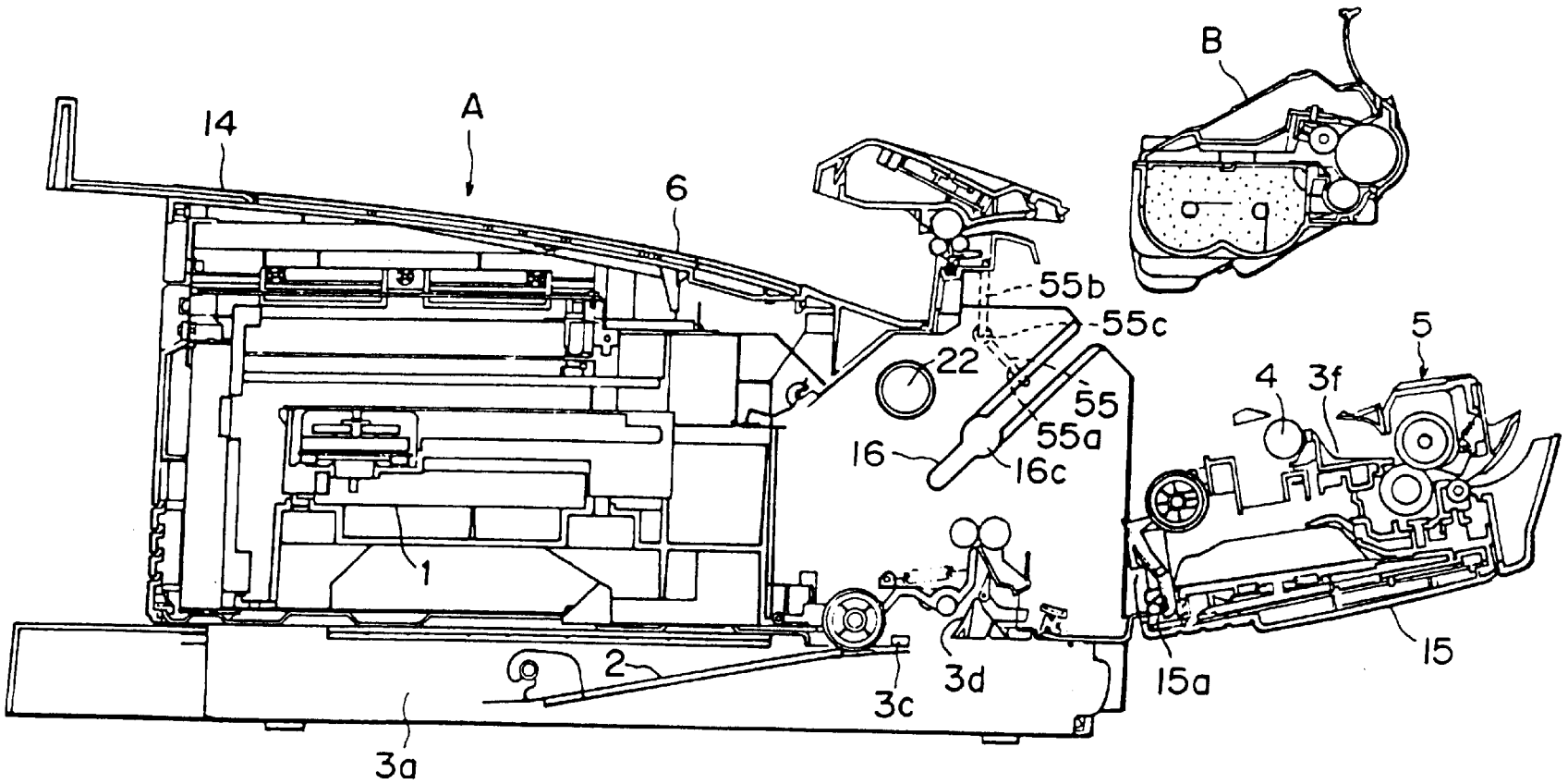
FIG. 33 is a longitudinal sectional view of an electrophotographic image forming apparatus.
Figure 34:
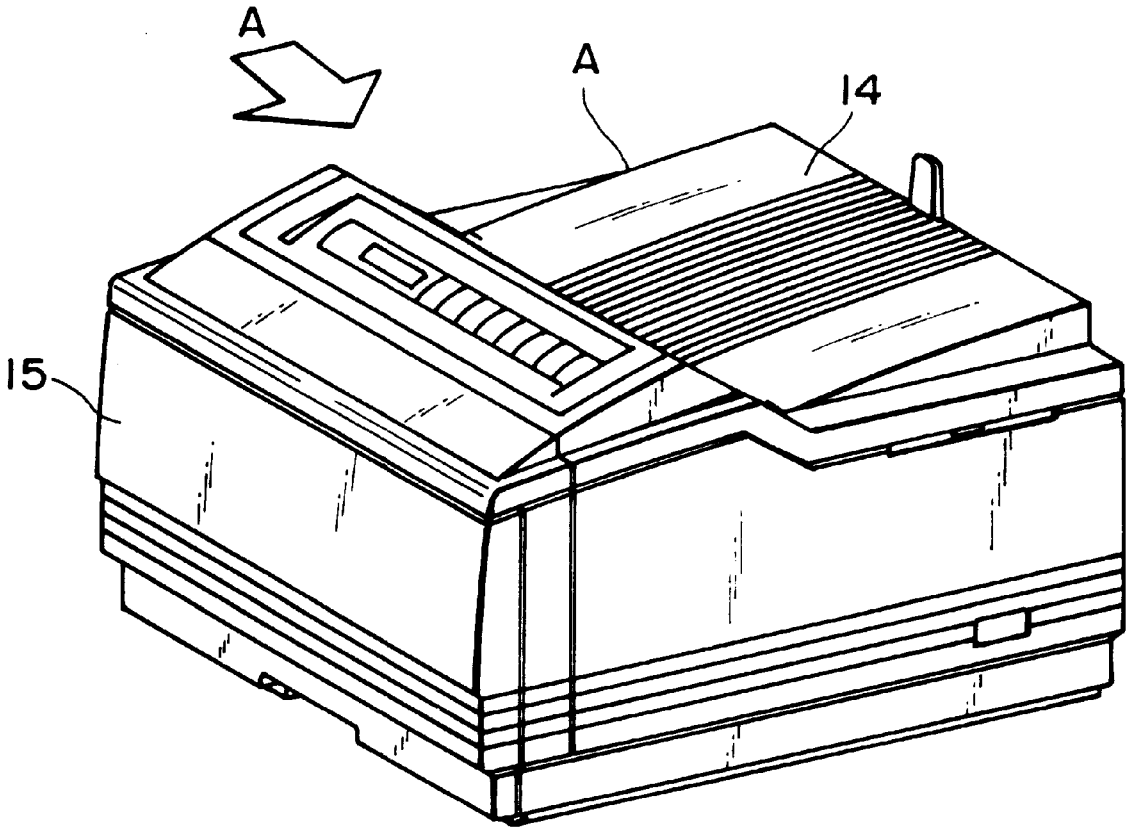
FIG. 34 is a perspective view of an electrophotographic image forming apparatus.

In the cartridge mounting means, when the cover member 15 is opened by rotating it about the shaft 15*a* (FIGS. 32, 33), there are guide grooves 16 which are inclined toward the rear side at each of the left and right sides of the cartridge mounting space as shown in FIG. 33. The guide grooves 16 are disposed substantially symmetrically. The guide grooves 16 are substantially linear. At the inlet side of the guide grooves 16 there is provided a positioning portion 16*c* (main assembly side positioning portion 16*c*).

Figure 36:
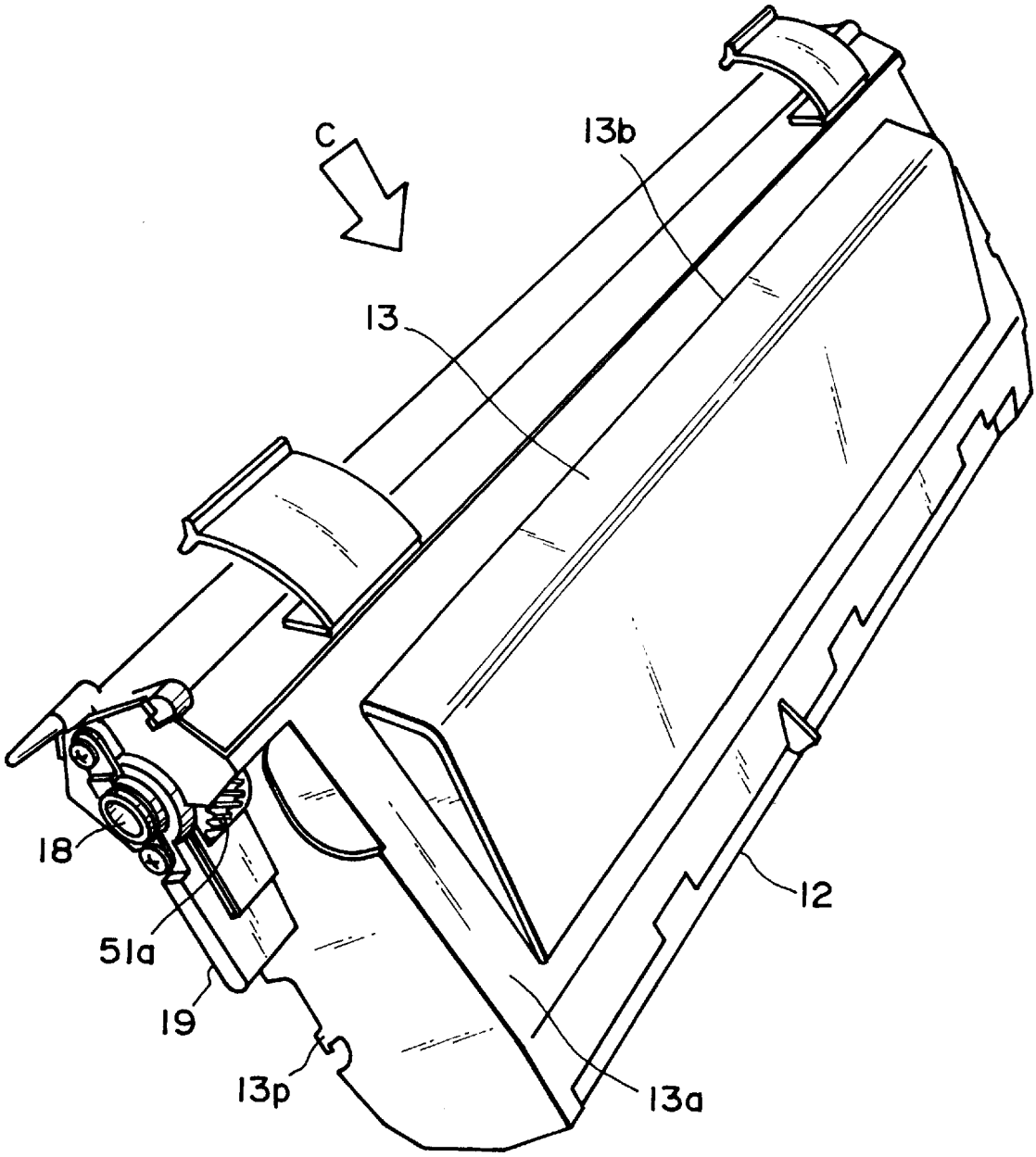
FIG. 36 is a perspective view of a process cartridge.

On the other hand, at the opposite outer ends of the process cartridge, there are provided guide portions correspondingly to the guide grooves 16 to be guided by the guide grooves 16. The guide portions are projected substantially symmetrically at the opposite longitudinal ends, respectively. As shown in FIG. 36, it comprises a boss 18 and a rib 19 that are integral. The boss 18 and the rib 19 are integrally formed with the cleaner container 13 to which the photosensitive drum 7 is mounted, and the boss 18 is disposed on an extension of a rotational axis of the photosensitive drum 7, and the rib 19 is extended from the boss 18 in an inserting direction of the process cartridge B as indicated by an arrow C in FIG. 36. The rib 19 extends inclined downwardly in conformity with the guide grooves 16.

With this structure, when the process cartridge is to be mounted to the main assembly, as shown in FIG. 33, the cover member 15 is open, and the ribs 19 are engaged into the guide grooves 16, and then, the process cartridge B is inserted into the main assembly 14 of the apparatus. When the process cartridge B is further inserted, the boss 18 of the process cartridge B is seated on the main assembly side positioning portion 16*c* in the inlet of the guide groove 16. Simultaneously, the free end 19*a* of the rib 19 is abutted to a stopper surface 16*a* of the guide groove 16 by a moment about the boss 18 produced by the weight of the process cartridge B. Thus, the drum gear 51*a* (FIG. 36) fixed to an end of the photosensitive drum 7 is brought into meshing engagement with a driving gear 22 (FIG. 33) provided in the main assembly 14, so that a driving force can be transmitted to the process cartridge B.

Then, the cover member 15 is closed, by which the shutter opening lever 55, which is interrelated with the cover member, is rotated in the clockwise direction about the shaft 55*c* from a position 55*a* to a position 55*b*, so that it is engaged with a pin 28*a* provided on the drum shutter member 28 as shown in FIG. 10, and the drum shutter member 28 is opened about a pin 29 mounted to the cleaner container 13 against a spring force of a spring 27, thus opening a transfer opening 13*n*. The coil spring 27 is fitted around the pin 29, and one end thereof is engaged to the cleaner container 13, and the other end is engaged to the drum shutter member 28, and therefore, when the cover member 15 is open or when the process cartridge B is outside the main assembly 14, the drum shutter member 28 closes the transfer opening 13*n* by the spring force.

When the process cartridge B is to be taken out, the cover member 15 is opened, and the shutter opening lever 55 is rotated about the shaft 55*c* to return from the position 55*b* to the position 55*a*. Then, drum shutter member 28 rotates about the pin 29 by the spring force of the coil spring 27, thus closing the transfer opening 13*n*. The process cartridge B is pulled up such that in the boss 18 is away from the positioning portion 16*c*, and thereafter, the process cartridge B is further pulled up such that ribs 19 are guided by the guide grooves 16.

(Structure of Cartridge Frame)

A description will be provided as to the structure of the cartridge frame. The cartridge frame is made of polystyrol resin material by injection molding, and as shown in FIG. 35, a lower developing frame 12*b* is welded to a side of the developing device frame 12*a*, and a cap member 12*c* is welded to the upper portion, thus constituting a toner developing container 12. A cap member 13*b* is welded to a top of a cleaning frame 13*a* to constitute an integral cleaner container 13. Then, the cleaner container 13 is coupled with the toner developing container 12 to constitute a cartridge frame.

Figure 44:
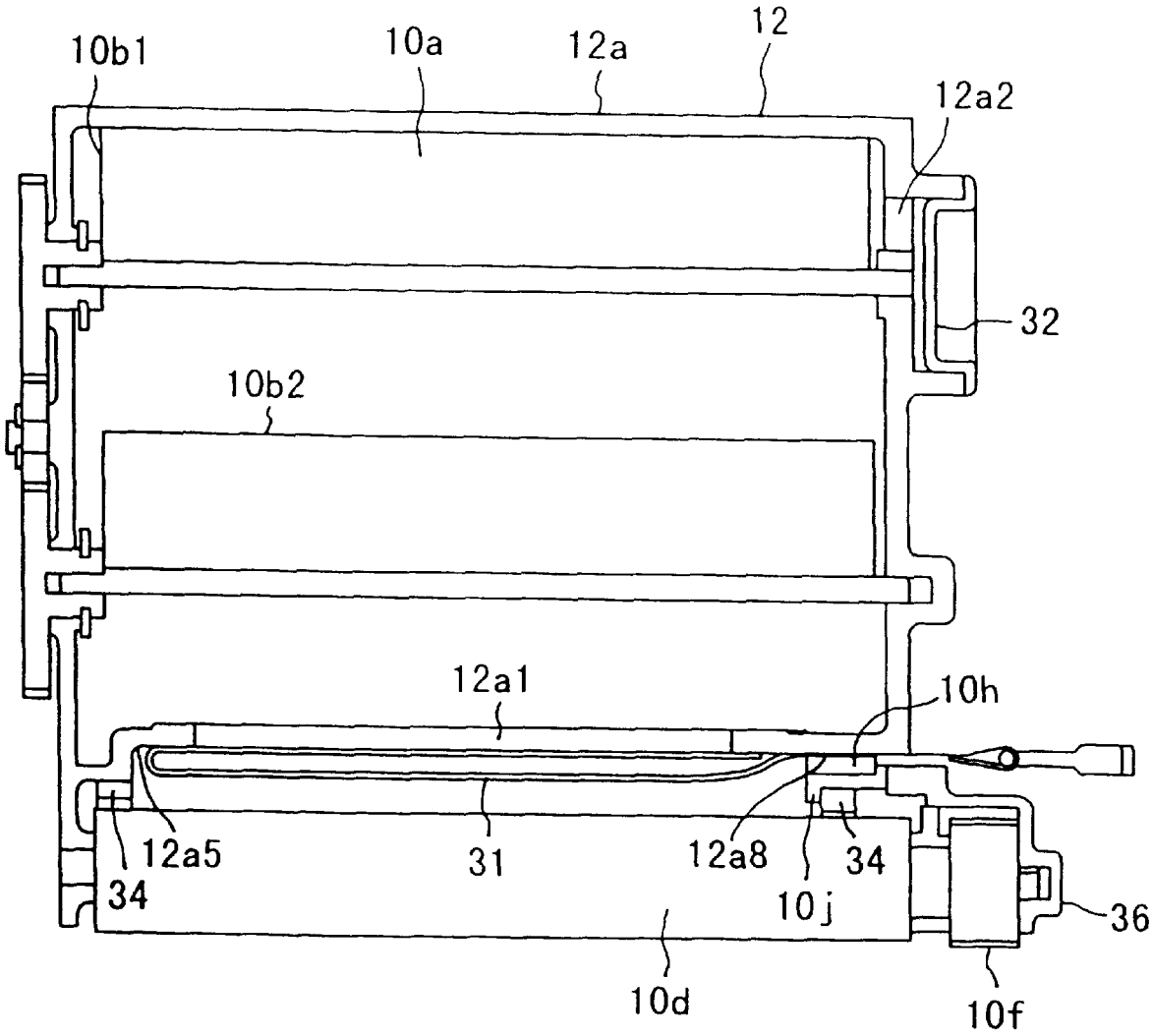
FIG. 44 is a horizontal sectional view of a toner developing container.
Figure 45:
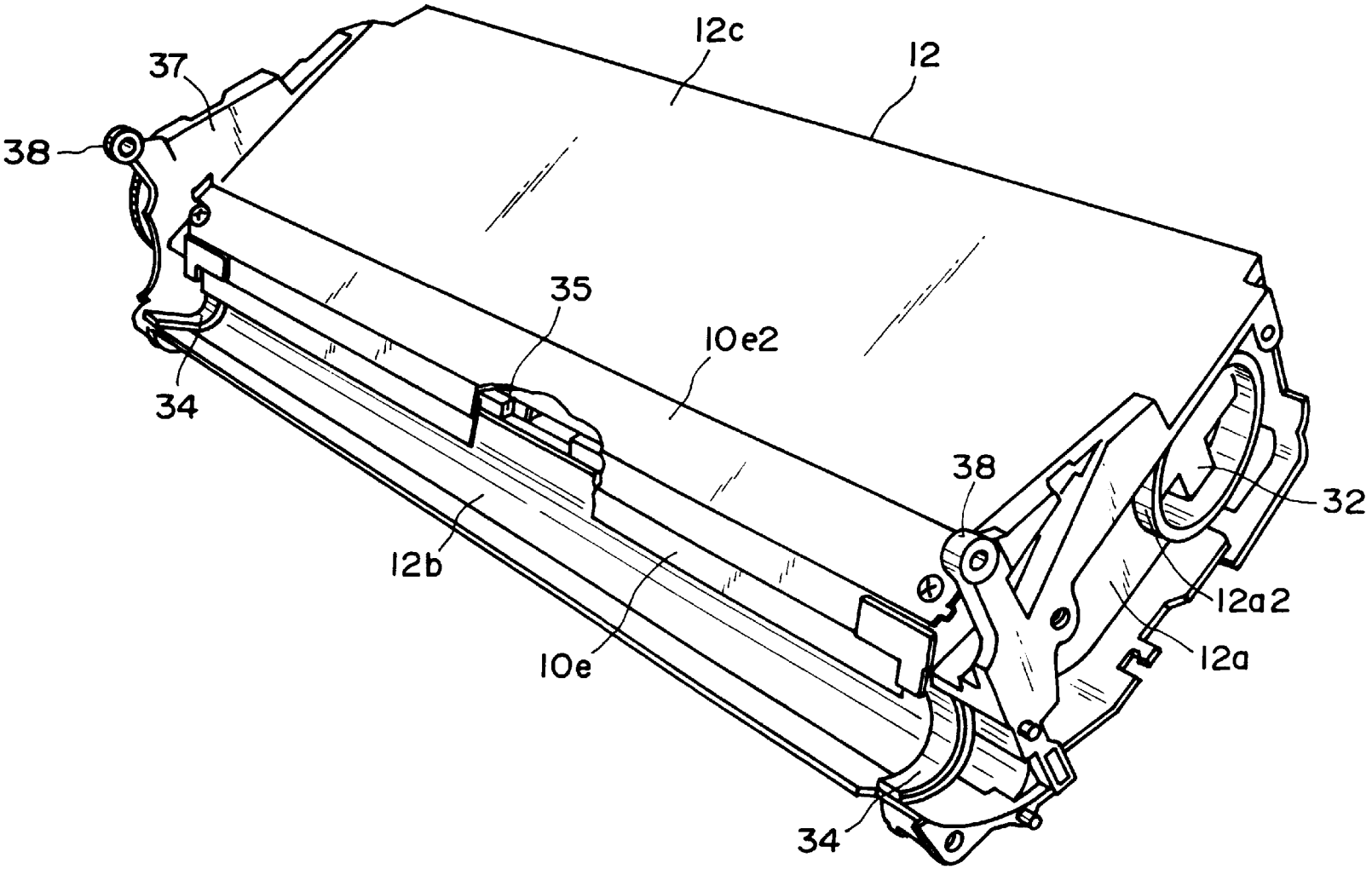
FIG. 45 is a perspective view of a toner developing container without a developing roller.

The developing device frame 12*a* is provided at an end thereof with a toner supply opening 12*a*1, as shown in FIGS. 44, 45, and is also provided at one longitudinal end with a toner filling opening 12*a*2. The developing device frame 12*a* is provided therein with a plurality of erected supporting members (not shown) in the longitudinal direction. The toner supply opening 12*a*1 permits supply of the toner from the toner accommodating portion 10*a* to the developing roller 10*d*. The toner in the toner accommodating portion 10*d* is supplied to the developing roller 10*d* through the toner supply opening 12*a*1.

When the developing means is mounted in place, as shown in FIGS. 35, 44, a toner feeding member 10*b* is mounted in the developing device frame 12*a*, and thereafter, the cap member 12*c* is welded to the developing device frame 12*a*. Subsequently, a toner seal 31 in the form of a film is welded on a surface 12*a*5 of the seat formed around the circumference of the toner supply opening 12*a*1 of the toner developing container 12 to seal the opening 12*a*1. Then, the toner is filled through the toner filling opening 12*a*2, and thereafter, the filling opening 12*a*2 is plugged by a cap 32 to seal the toner accommodating portion 10*a*. The toner seal 31 sealing the toner supply opening 12*a*1, as shown in FIG. 44, is folded back at one longitudinal end of the opening 12*a*1, and the free end thereof is extended out through a slit 12*a*8 of the developing device frame 12*a*. The free end of the toner seal 31 is nipped by fingers of the user and is pulled out when the user starts to use the process cartridge B.

When it is pulled out, the seal is not complete at the portion where the toner seal 31 extends through the toner developing container 12.

Therefore, as shown in FIG. 13, an elastic sealing member 10*h* such a felt is provided in the slit 12*a*8 at an end, closer to the fee end, of the toner seal 31.

As shown in FIG. 44, the elastic sealing material 10*h* is overlaid on the toner seal 31 and urges the toner seal 31. Therefore, when the toner seal 31 is pulled out, the elastic sealing material 10*h* occupies the slit 12*a*8 which has been occupied by the toner seal 31 to be press-contacted to a wall of the developing device frame 12*a*, thus preventing leakage of the toner to the outside.

Figure 46:
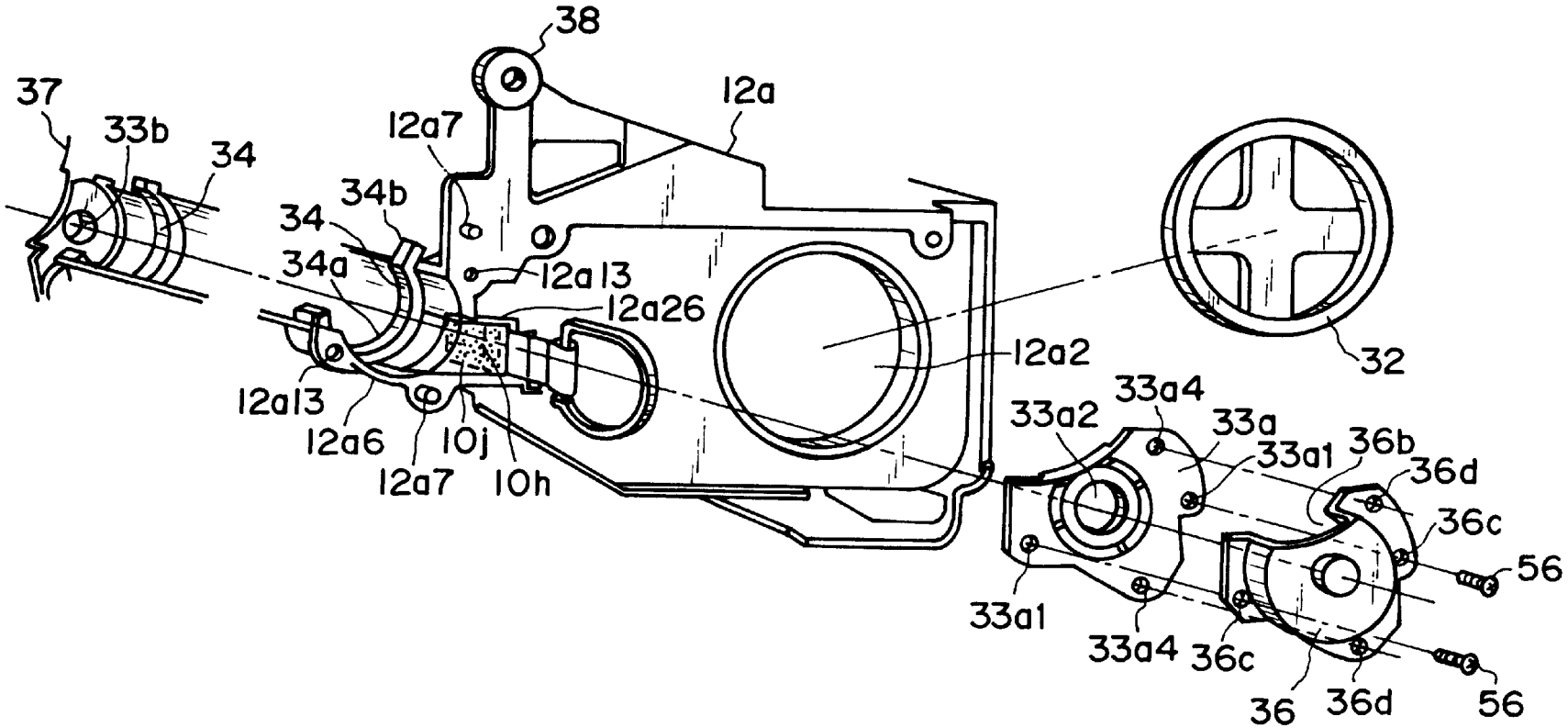
FIG. 46 is an exploded perspective view of a supporting means for supporting a developing roller.

A description will be provided as to the mounting of the elastic sealing material 10*h*. As shown in FIG. 46, apart of the arcuate portion 12*a*6 of the developing device frame 12*a* is provided with an angle groove 12*a*26 extending in the longitudinal direction. The bottom of the angle groove 12*a*26 is flush with the toner seal sticking seat surface 12*a*5. An elastic sealing material 10*h* such as a felt or the like is stuck on a piece 10*j* engaged in the angle groove 12*a*26.

With this structure, even when the toner seal 31 is pulled out, the toner is prevented from leaking to the outside of the toner developing container 12 through the slit 12*a*8.

Figure 39:
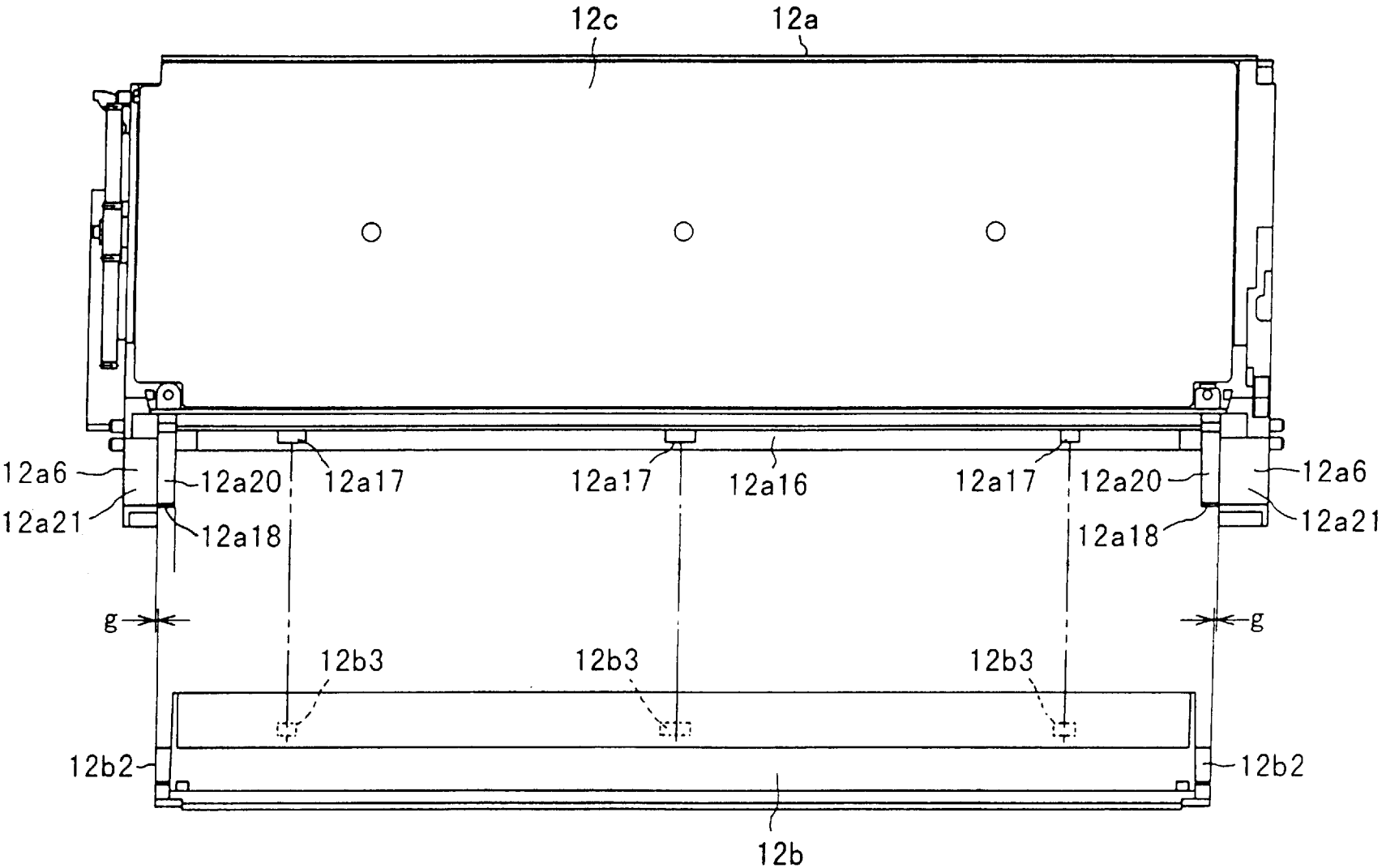
FIG. 39 is a plan view of a frame constituting a toner developing container.
Figure 40:
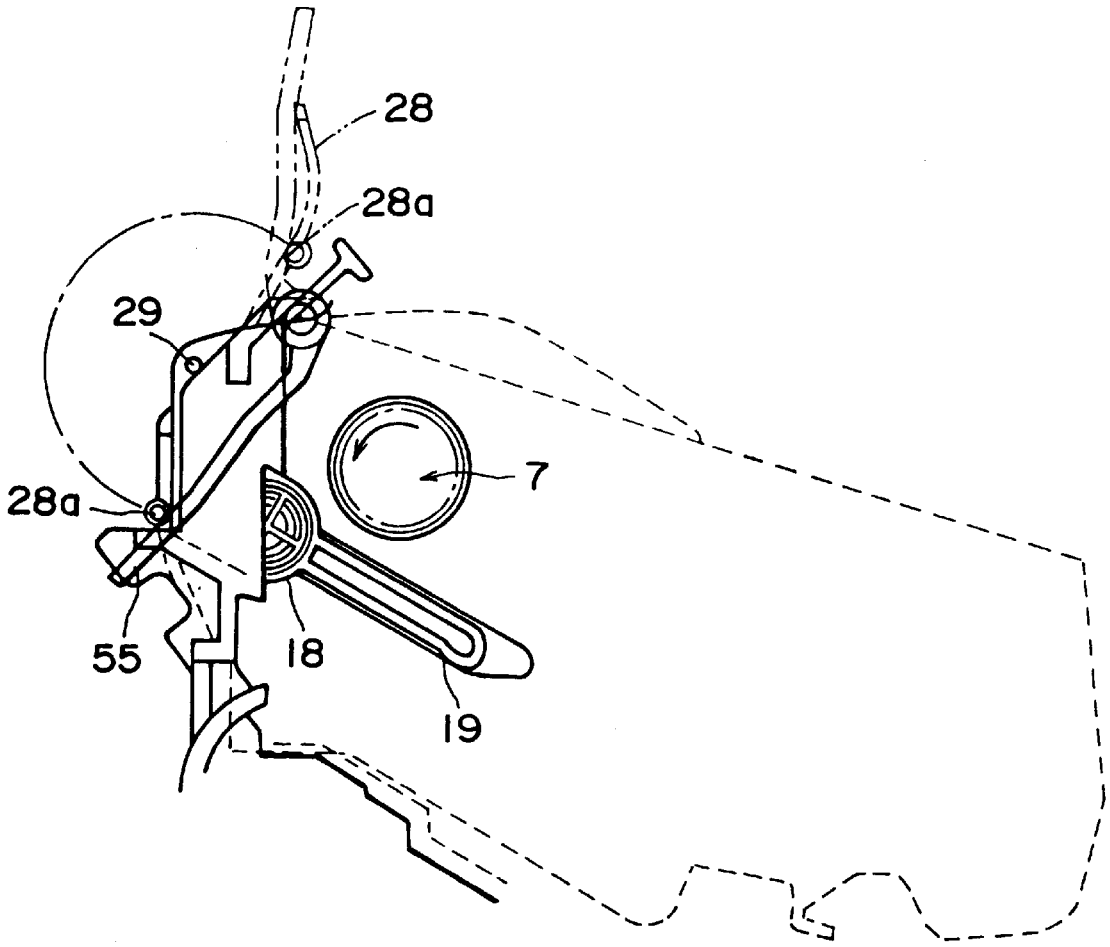
FIG. 40 is a side view of a drum shutter.
Figure 41:
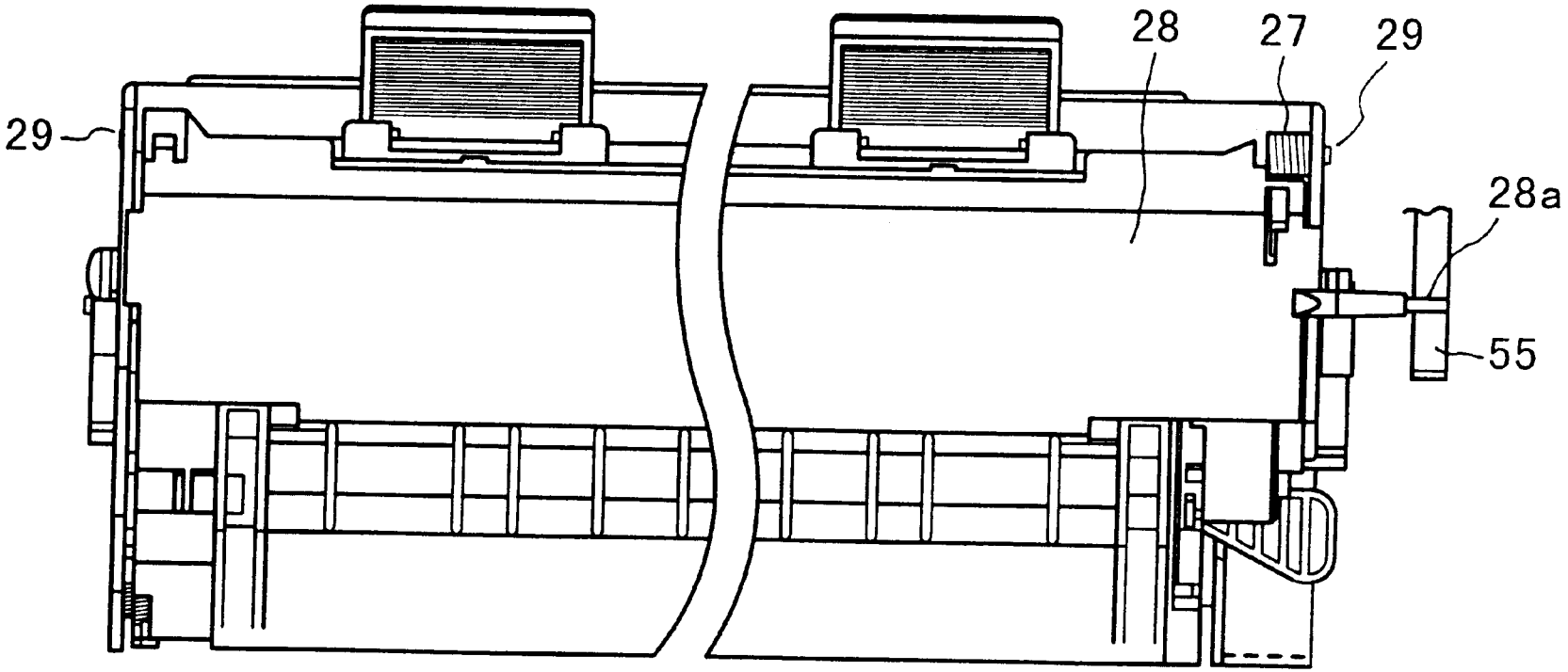
FIG. 41 is a plumb view of a process cartridge.

Then, the lower developing frame 12*b* is welded to the developing device frame 12*a*. As shown in FIG. 39, the developing device frame 12*a* is provided at the opposite longitudinal ends of the toner supply opening 12*a*1 with arcuate portions 12*a*6 at which the end seals 34 are to be mounted. A flat flange 12*a*16 is extended between the arcuate portions 12*a*6 below the seal sticking seat surface 12*a*5, and the flange 12*a*16 is substantially perpendicular to the seal sticking seat surface 12*a*5. On the other hand, lower developing frame 12*b* is engaged with the longitudinally opposing surfaces of the arcuate portions 12*a*6. Therefore, in consideration of manufacturing errors, the lower developing frame 12*b* has a length which is smaller than the distance between the opposing surfaces of the arcuate portion 12*a*6 by 2×g where g is a gap at each ends. The flange 12*a*16 is provided with holes 12*a*17, and the lower developing frame 12*b* is provided with dowels 12*b*3 for engagement with the holes 12*a*17, respectively. With the dowels 12*b*3 being in engagement with the respective hole 12*a*17, the bottom surface of the lower developing frame 12*b* and the top surface of the flange 12*a*16 of the developing device frame 12*a* are welded to each other. By doing so, a gap g is formed between the arcuate portion 12*a*6 and the lower developing frame 12*b* at each end. The dimension of the gap g is not constant when the lower developing frame 12*b* is fixed to the developing device frame 12*a*.

Figure 49:
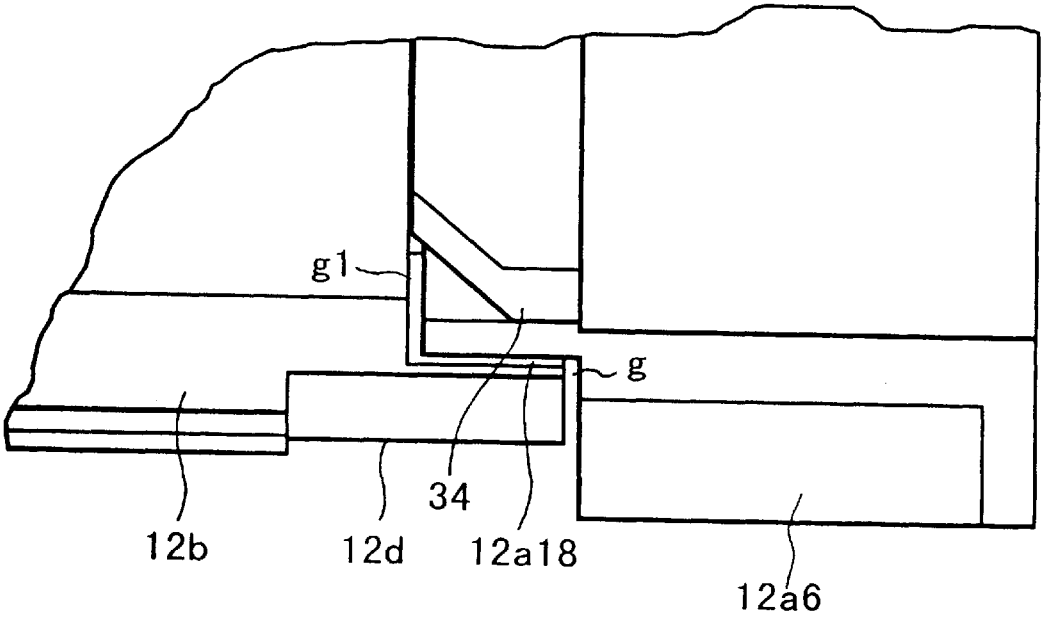
FIG. 49 is an enlarged view of the E part shown in FIG. 48.
Figure 50:
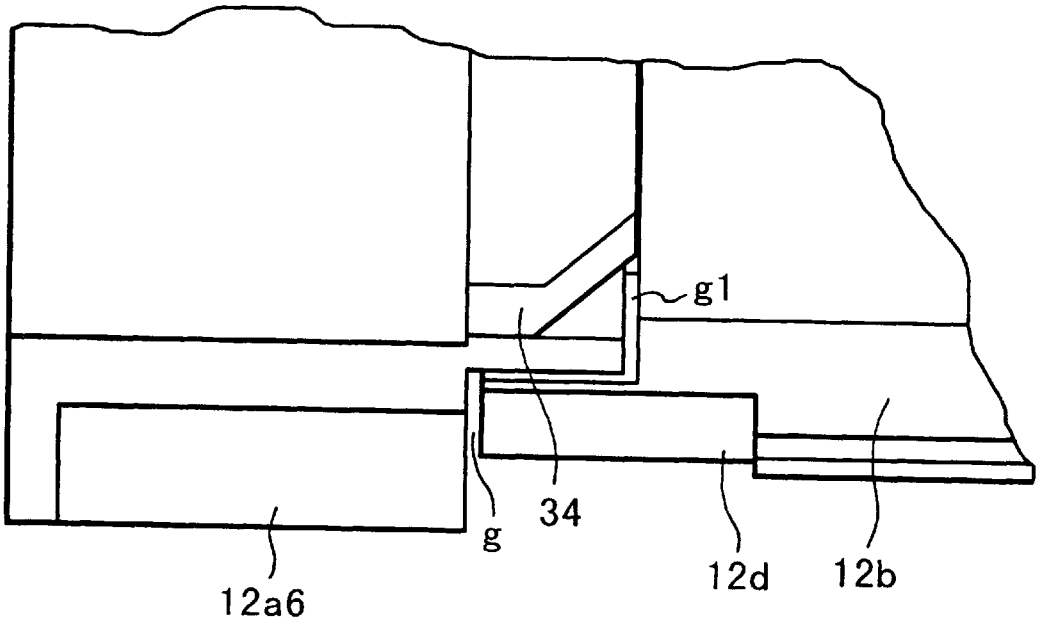
FIG. 50 is an enlarged view of the F part shown in FIG. 48.
Figure 51:
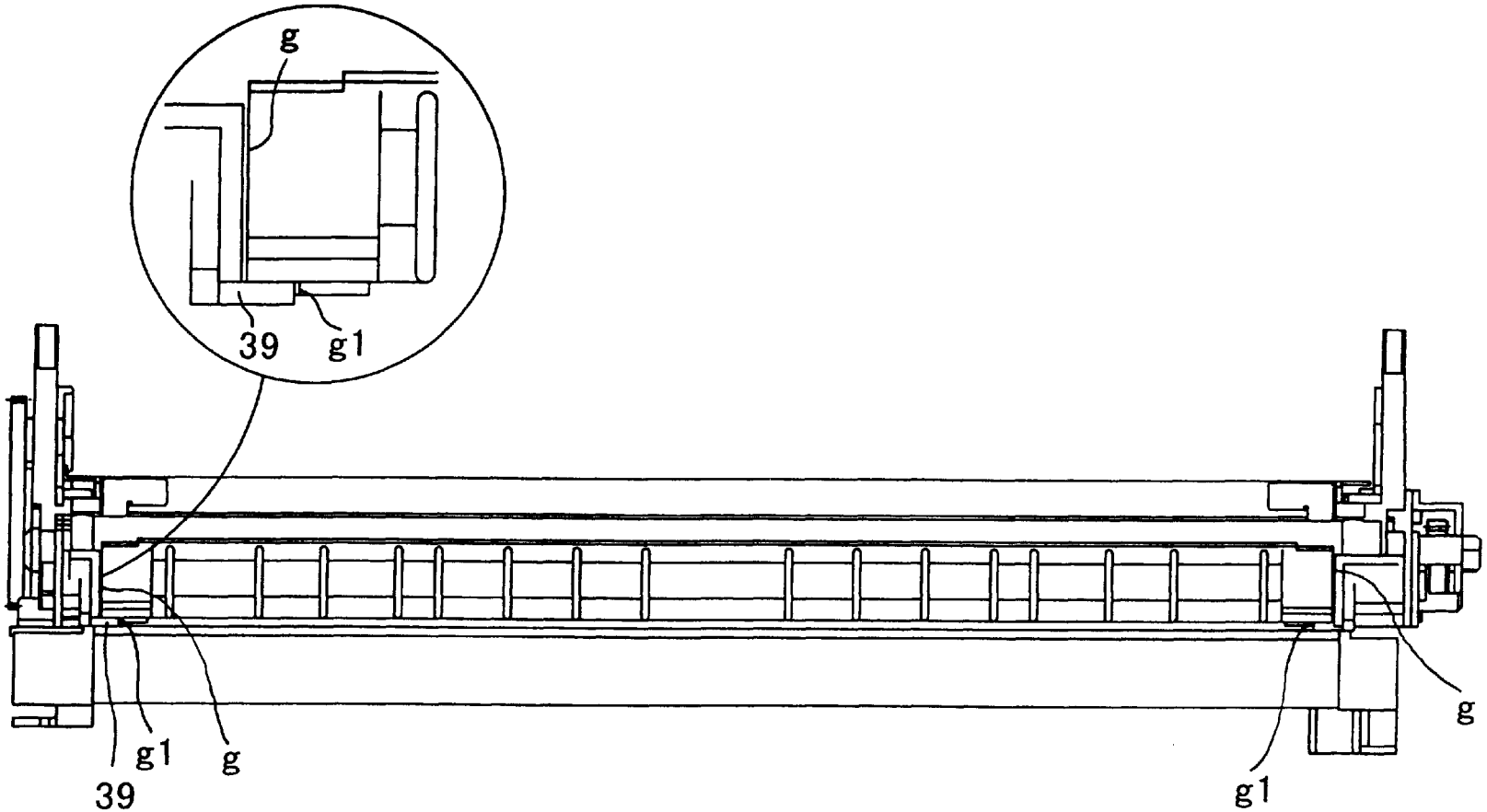
FIG. 51 is a front view of a toner developing container as seen in the direction opposite from the process cartridge mounting direction.

Each of the opposite ends of the lower developing frame 12*b* is provided with an outward projection 12*b*2 (FIGS. 35 and 39). The developing device frame 12*a* is provided at each of the end portions with a recess 12*a*18 for engagement with a projection 12*b*2 when the dowels 12*b*3 are engaged with the holes 12*a*17 for the purpose of welding or bonding of the lower developing frame 12*b*. As shown in FIGS. 49, 50, and 51, a gap g1 is provided between the recess 12*a*18 and the projection 12*b*2. The gap is substantially equal to the gap g formed between the lower developing frame 12*b* and the arcuate portion 12*a*6.

The gap between the projection 12*b*2 and the recess 12*a*18 is sealed by sealing material 39.

As shown in FIG. 39, the arcuate portion 12*a*6 of the developing device frame 12*a* is provided with a sticking portion 12*a*20 to which the end seal 34 is stuck. The sticking portion 12*a*20 has an arcuate peripheral surface having a common axis with the arcuate portion 12*a*21 provided longitudinally outside of the arcuate portion 12*a*6. The axis is the rotational axis of the developing roller 10*d* in the toner developing container 12. The sticking portion 12*a*20 is provided with an arcuate surface having a radius which is smaller than that of the outer arcuate portion 12*a*21. An end of the sticking portion 12*a*20, as shown in FIG. 8, ends short of (inside) the circumference of the outer arcuate portion 12*a*21.

Figure 48:
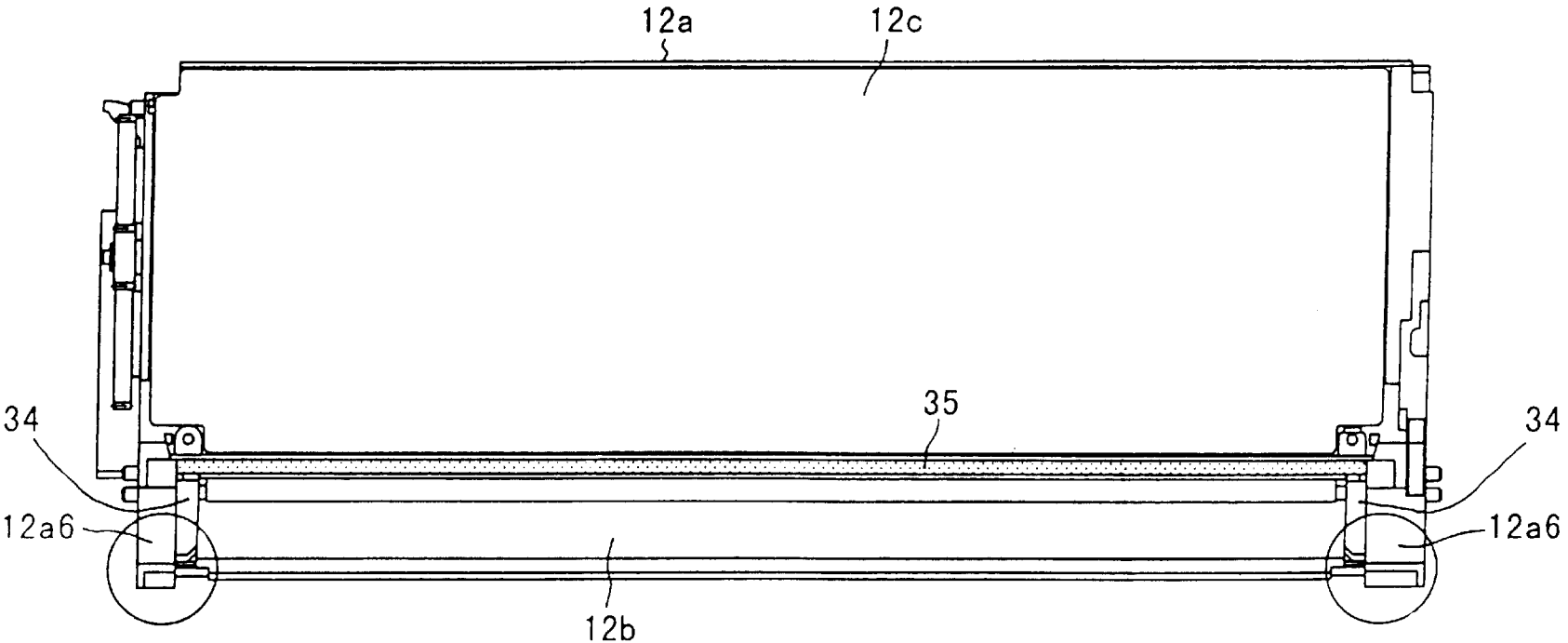
FIG. 48 is a top plan view of a toner developing container without the developing roller and the developing blade.

As shown in FIGS. 48, 49, 50, when the lower developing frame is welded to or bonded to the developing device frame 12*a*, a slit 12*d* is provided between the arcuate portion 12*a*6 and the lower developing frame 12*b*.

Figure 52:
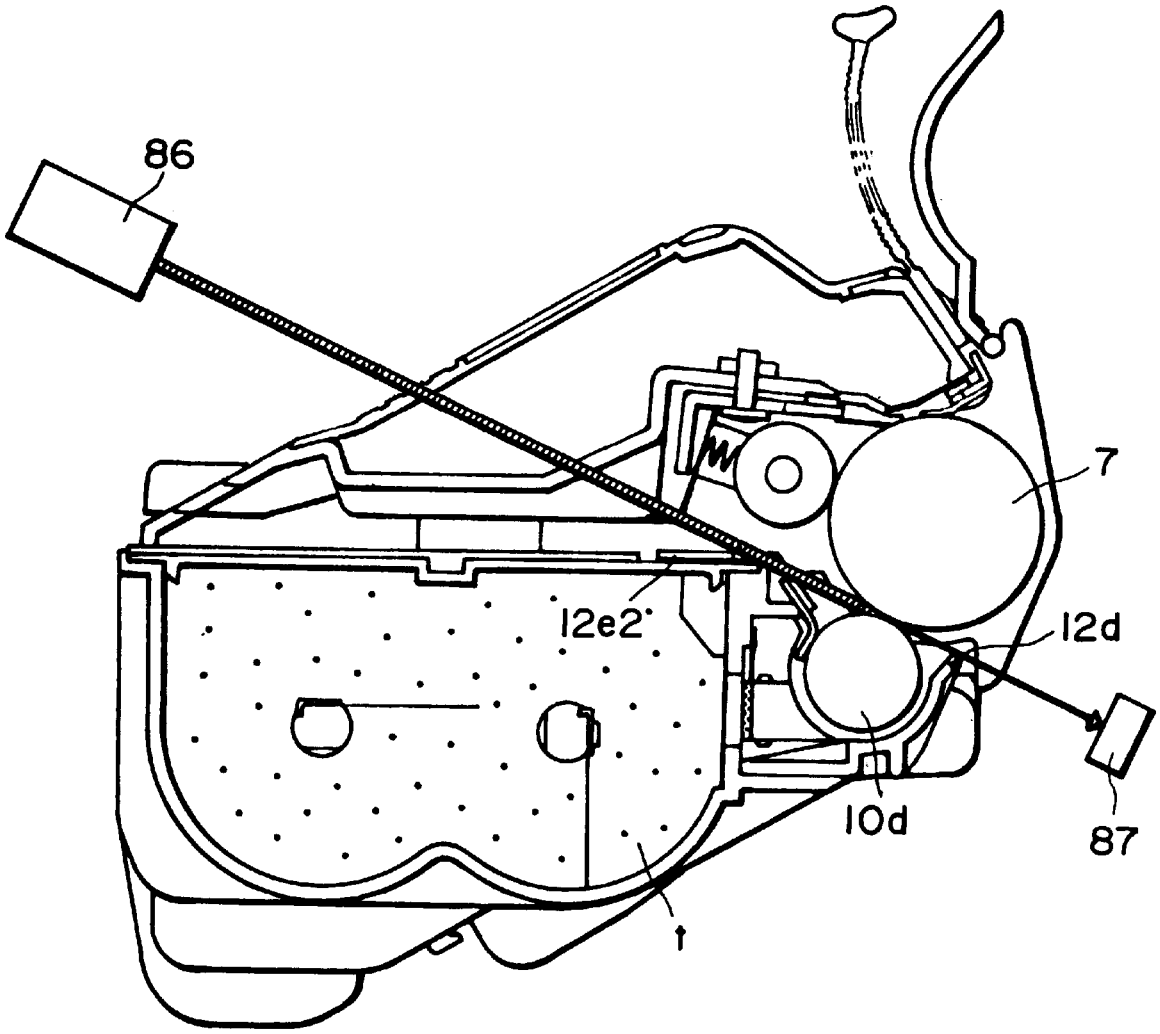
FIG. 52 is a longitudinal sectional view of a process cartridge.
Figure 53:
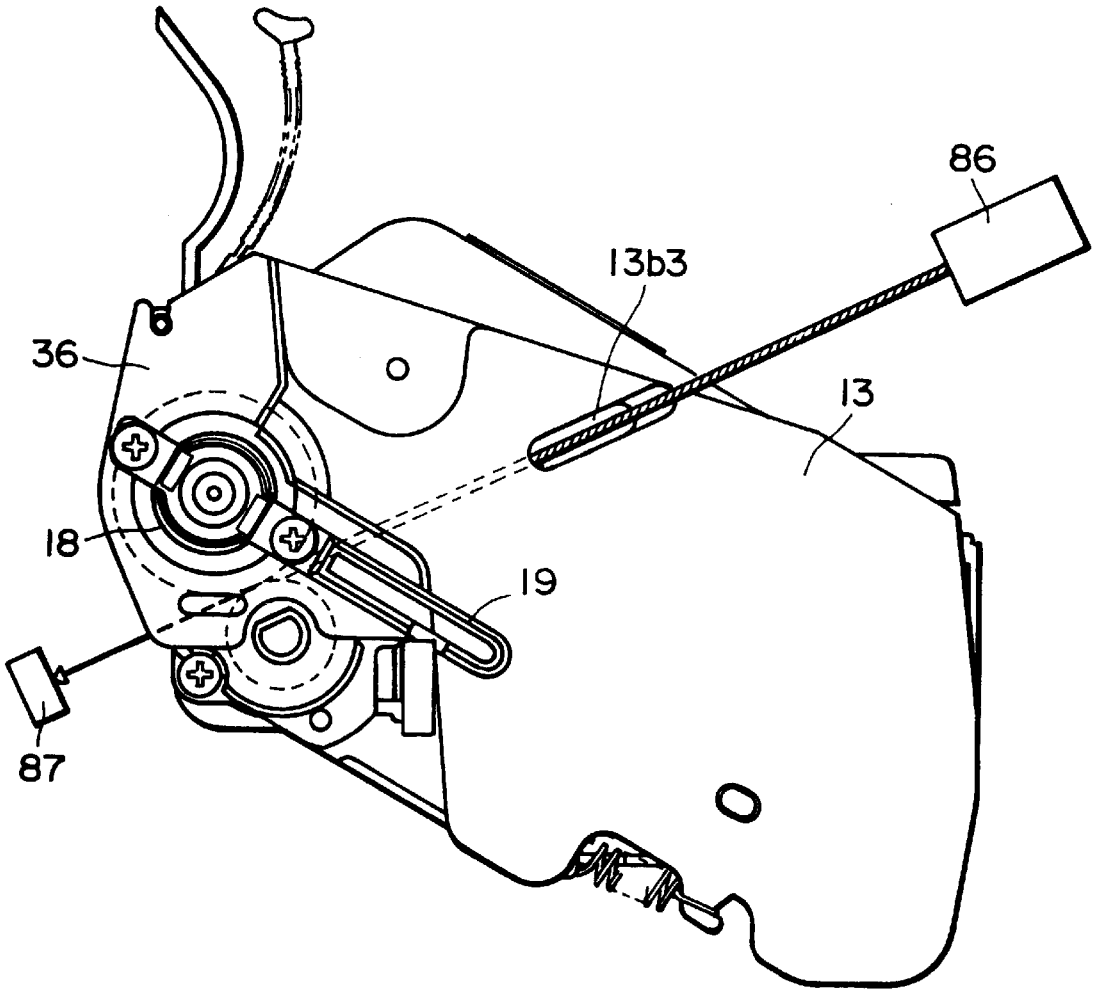
FIG. 53 is a side view of a process cartridge.
Figure 54:
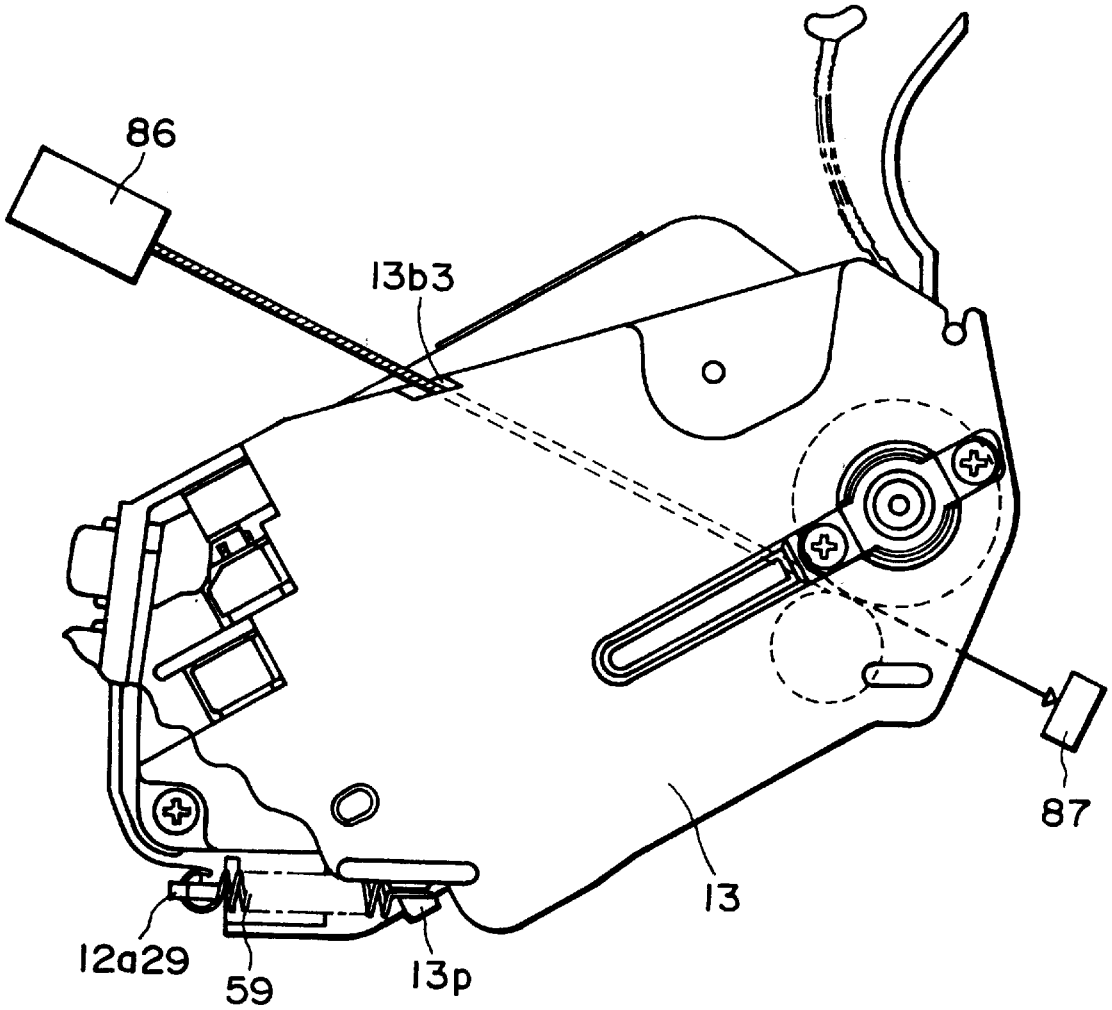
FIG. 54 is a side view of a process cartridge.

The slit 12*d*, as shown in FIGS. 52 to 54, is on an optical path of a laser beam passing through a gap (development gap) formed between the photosensitive drum 7 and the developing roller 10*d* provided by the spacer roller 10*d*1, which is disposed to each of the opposite end portions of the photosensitive drum 7 and the developing roller 10*d*. An optical path passes through the slit 12*d*, a slit 10*e*6 provided in the metal blade 10*e*2 and a hole 13*b*1 formed in the cap member 13*b*.

In FIGS. 52–54, the laser beam emitted from the laser source 86 has a width which is larger than the gap ( approximately 300 $\mu$m) between the photosensitive drum 7 and the developing roller 10*d*. The laser beam emitted from the laser source 86 travels through the hole 13*b*1, the slit 10*e*6, the gap between the photosensitive drum 7 and the developing roller 10*d* and the slit 12*d*, and is then received by a photoreceptor 87. The width of the laser beam received by the photoreceptor 87 is measured in a direction parallel with the face of the sheet of the drawing of FIG. 52. Therefore, the development gap can be detected.

The measurement of the gap between the photosensitive drum 7 and the developing roller 10*d* using the laser beam, is effected at each of opposite longitudinal ends of the photosensitive drum 7 (two positions). Therefore, the hole 13*b*1, the slit and the slit 10*e*6, 12*d* are each provided at at least two positions (adjacent opposite longitudinal ends).

After the lower developing frame 12*b* is welded to the developing device frame 12*a,* the end seal 34 and the seal 35 are mounted.

Figure 47:
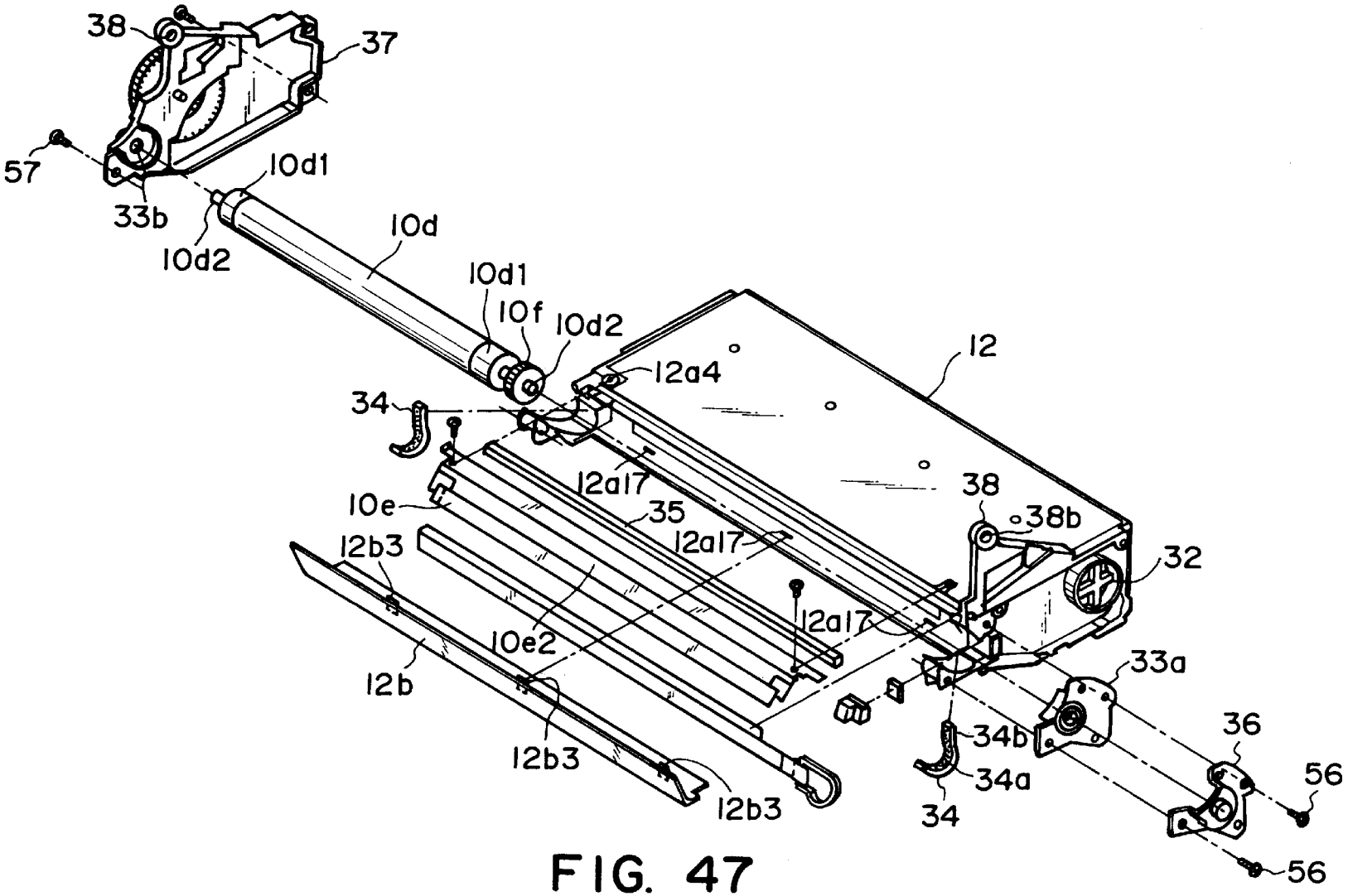
FIG. 47 is an exploded perspective view of a toner developing container.

As shown in FIGS. 46 and 47, the end seal 34 functions to provide a seal between the developing device frame 12*a* and each of the end portions of the developing blade 10*e* and each of the end portions of the developing roller 10*d,* and it comprises an arcuate portion 34*a* contactable to the developing roller 10*d* along its circumferential surface and an integral linear portion 34*b* along a rear surface of each of the end portions of the metal blade 10*e*2. The outer circumference of the arcuate portion 34*a* is stuck to the sticking portion 12*a*20 of the developing device frame 12*a*.

As shown in FIG. 35, a seal 35 of urethane foam or the like is mounted and extended between blade mounting seat surfaces 12*a*4 formed above the toner discharging opening 12*a*1 of the toner discharging, and the developing blade 10*e* is screwed on the blade mounting seat surface 12*a*4 with the seal 35 therebetween. By doing so, the seal 35 is compressed between the metal blade 10*e*2 and a developing device frame 12*a* so that sealing is accomplished between the metal blade 10*e*2 and the developing device frame 12*a*.

Figure 55:
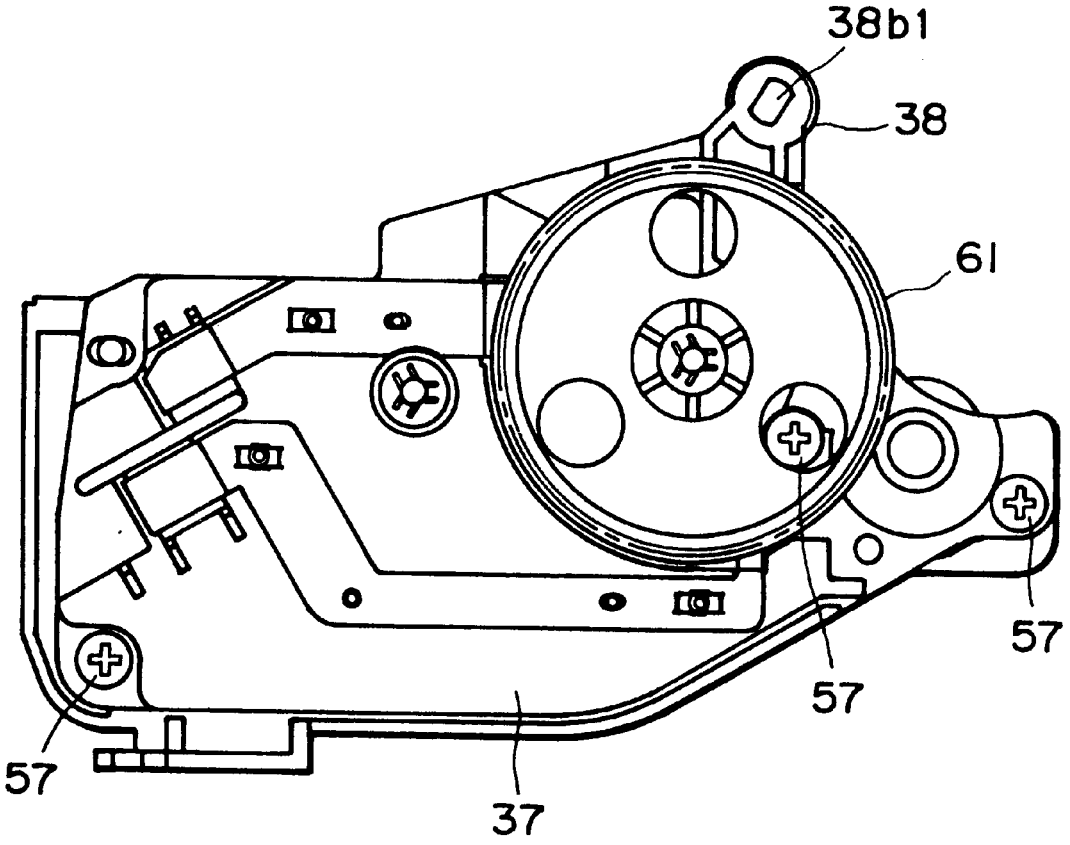
FIG. 55 is a side view of a toner developing container.
Figure 56:
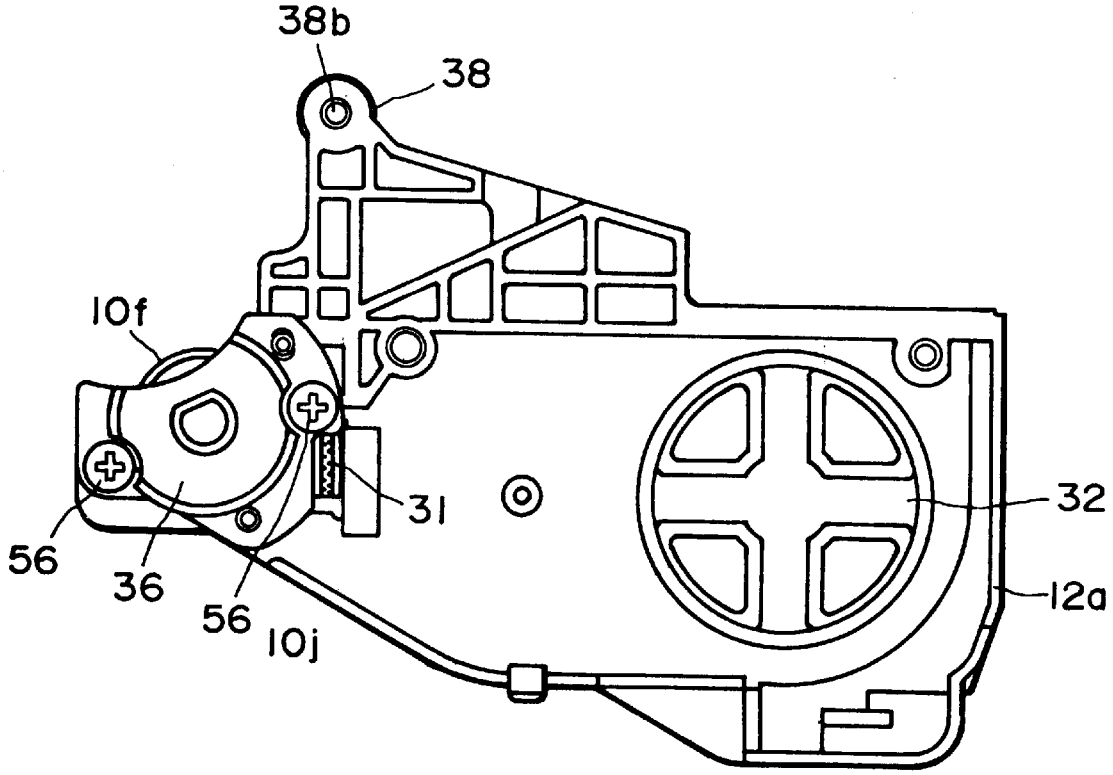
FIG. 56 is a side view of a toner developing container.

The development holder 36 shown in FIG. 56 is secured to one of the ends of the developing device frame 12*a,* and the development holder 37 shown in FIG. 55 is secured to the other end thereof. The development holders 36, 37 are fixed to the developing device frame 12*a* by small screws 56, 57.

The shaft 10*d*2 of the developing roller 10*d* at one end is engaged with a fixed bearing 33*b* which is in the form of a shaft integral with the development holder 37 shown in FIG. 46. The developing roller shaft 10*d*2 is received by a bearing hole 33*a*2 of the bearing 33*a* at the other end of the developing roller 10*d,* and as shown in FIG. 46, a hole 33*a*4 is engaged with a positioning dowel 12*a*7 provided on the developing device frame 12*a* at an outside of one of the longitudinal ends. Then, the developing roller gear 10*f* is engaged with the developing roller shaft 10*d*2. The engaging portion 33*a*3 of the bearing 33*a* is engaged with a part-cylindrical engaging portion 36*a* of the development holder 36. At this time, the developing roller gear 10*f* is accommodated in the development holder 36. A small screw 56 is penetrated through a hole 36*c* of the development holder 36, a hole 33*a*1 of the bearing 33*a* and is threaded into a female screw 12*a*13 of the developing device frame 12*a*. The gear accommodating portion 36*b* outside the development holder 36 is part cylindrical, and when the toner developing container 12 and a cleaner container 13 are coupled, the developing roller gear 10*f* is brought into meshing engagement with the drum gear 51*a* through the open part of the gear accommodating portion 36*b*.

Each of the development holders 36, 37 is provided with an integral arm portion 38 functioning as a connecting portion for connecting the toner developing container 12 and the cleaner container 13.

The toner developing container 12 having the various members constituting the developing means and the cleaner container 13 having the various members constituting the photosensitive drum 7, the charging roller 8 and a cleaning means are coupled by the arm portions 38 to constitute the process cartridge B.

(Coupling Between Toner Developing Container and Cleaner Container)

Figure 57:
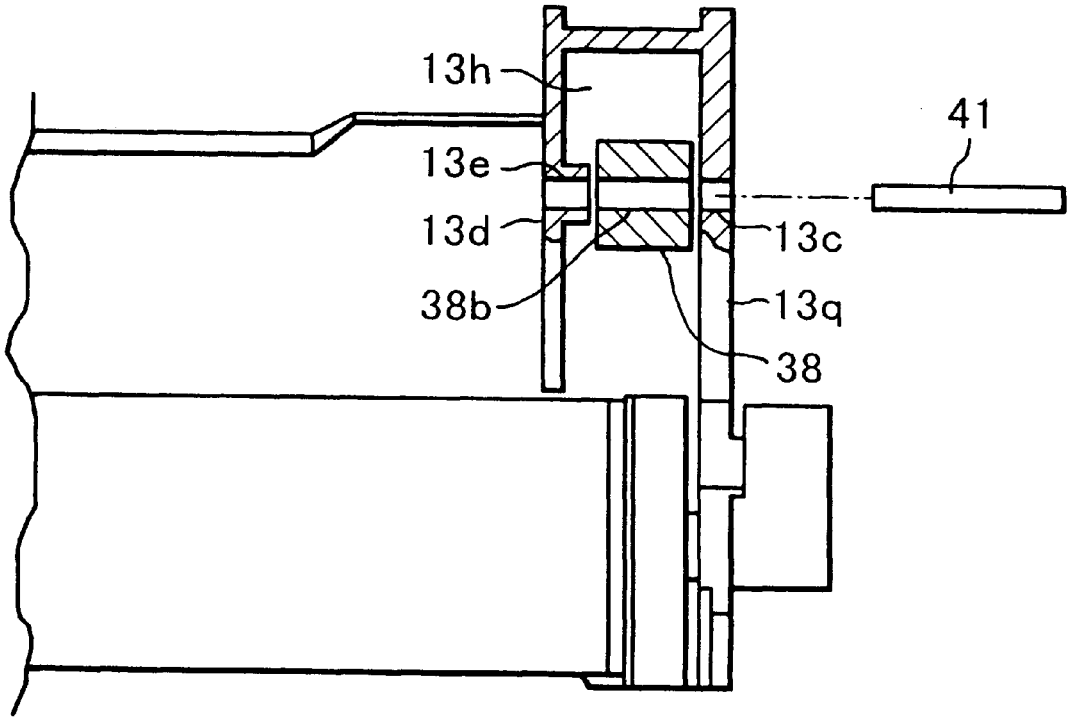
FIG. 57 is a longitudinal sectional view illustrating a connecting portion between the toner developing container and the cleaner container.
Figure 58:
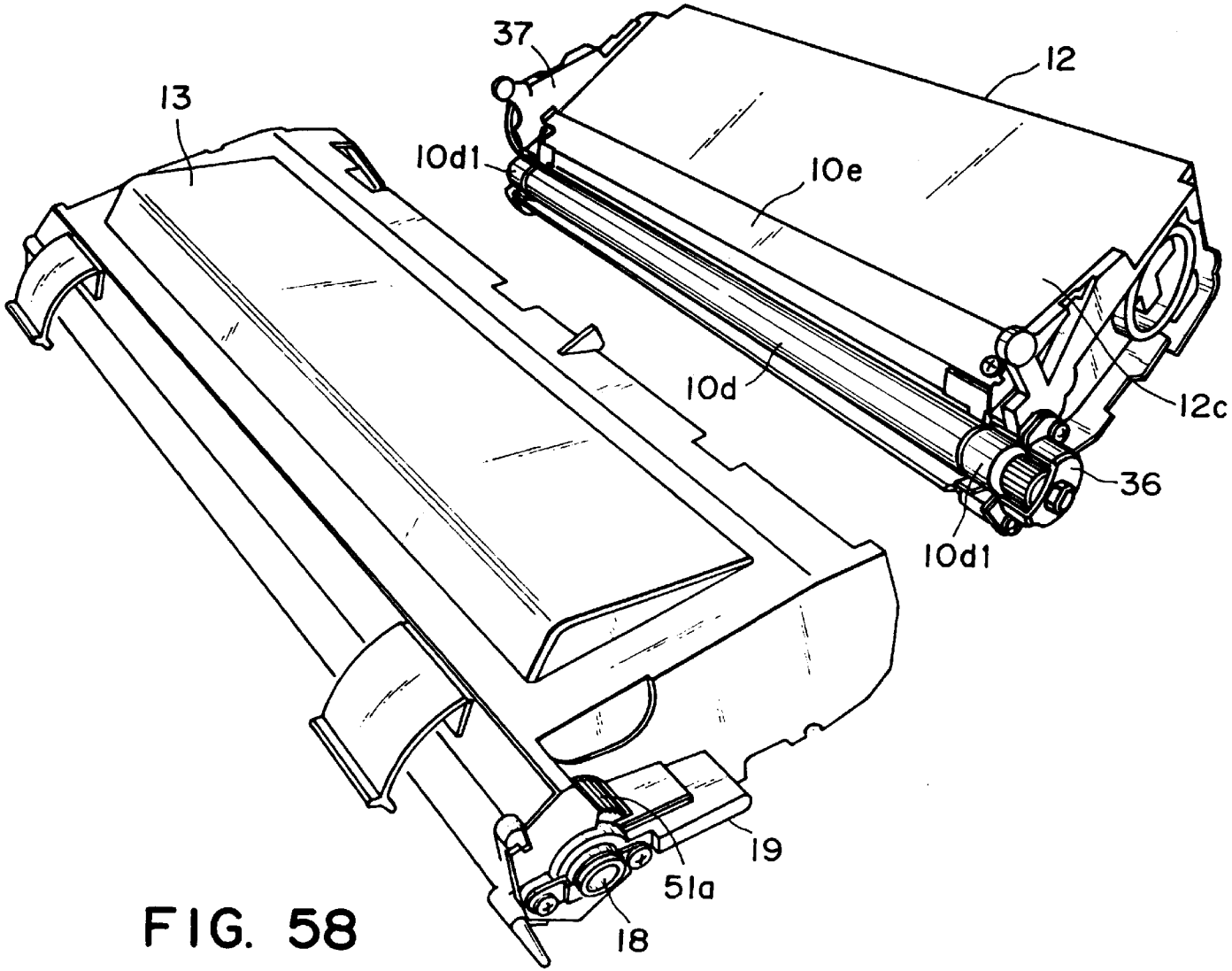
FIG. 58 is a perspective view of a cleaner container and a toner developing container.

Referring to FIGS. 38, 42, 55, 56, 57, a description will be provided as to the coupling between the toner developing container 12 and the cleaner container 13. FIGS. 7 and 11 are a side view and a perspective view illustrating the coupling between the containers 12, 13; FIG. 57 shows inside of the coupling portion; and FIGS. 55, 56 are side views of the copper end portion of the toner developing container 12. The containers 12, 13 are rotatably coupled through the arms 38 at the opposite ends. Since the covering structures at the left and right ends are substantially the same, a description will be provided as to only one end. However, the portions of the arm 38 which are different between the left and right hands will be described for the respective ends.

At a free end portion of the arm portion 38, a through-hole 38*b* is provided for receiving a pin 41 which will be described hereinafter. As shown in FIG. 57, an outer wall 13*q* of the cleaner container 13 is provided with a hole 13*c* for receiving the pin 41, and an inner wall 13*d* thereof is provided with a hole 13*e* for being press-fitted by the pin 41. The hole 13*c* and the hole 13*e* are aligned along a line parallel with the photosensitive drum 7. An elongated bore 38*b*1 is formed in the arm portion 38 and the other end of the cleaner container 13, and a line connecting the center of the elongated bore 38*b*1 and the hole 38*b* passes through the centers of the holes 13*c,* 13*e*. The elongated bore 38*b*1 is elongated in a direction parallel with a line connecting the center of the photosensitive drum 7 and the center of the developing roller 10*d,* and a width of the elongated bore 38*b*1 is equal to the diameter of the pin 41.

Figure 42:
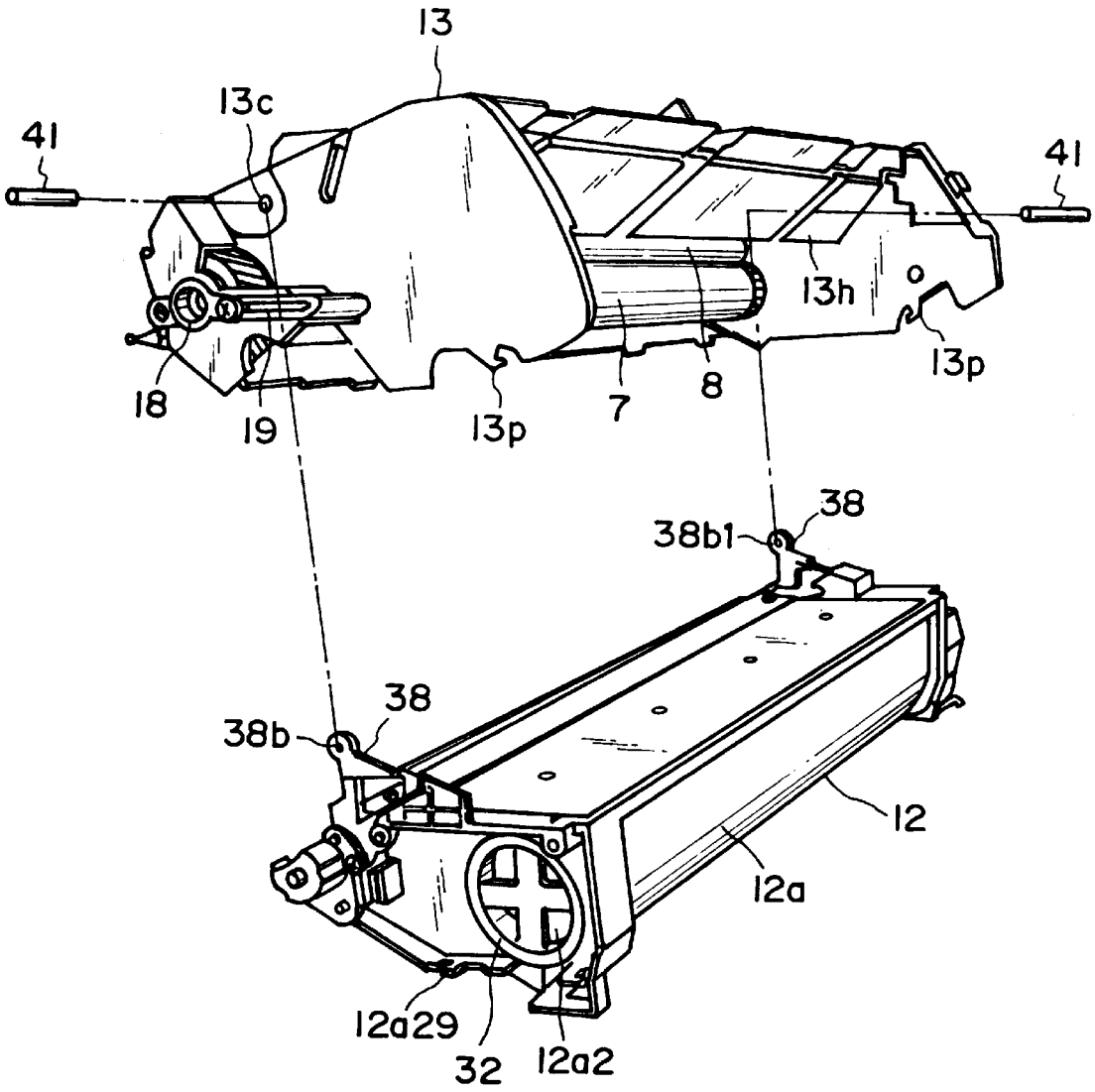
FIG. 42 is an exploded perspective view of a toner developing container and a cleaner container.
Figure 43:
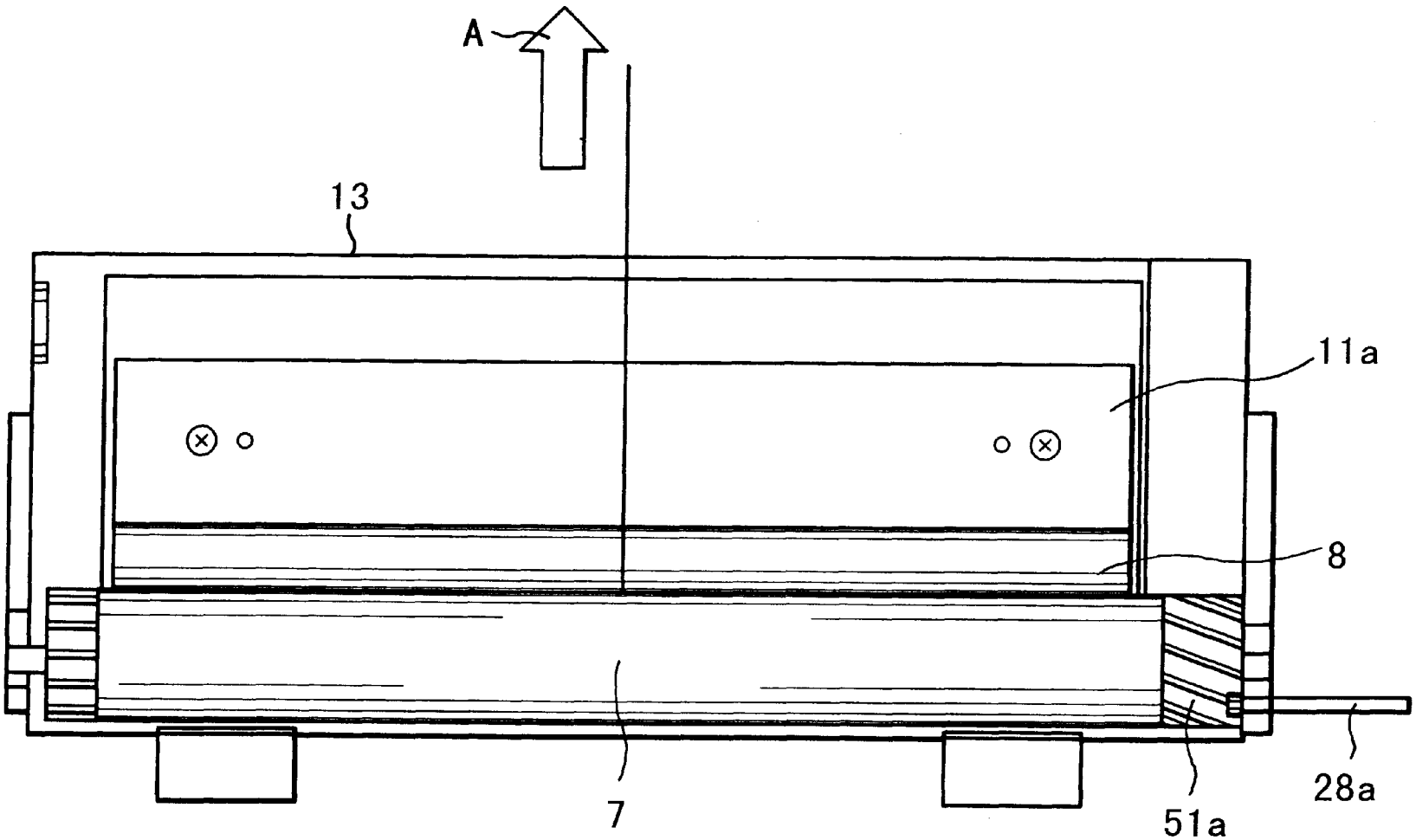
FIG. 43 is a schematic developed view of a cleaner container.

When the toner developing container 12 and the cleaner container 13 are coupled together with each other, as shown in FIGS. 42 and 57, the arm portion 38 of the toner developing container 12 is inserted into the recess 13*h* of the cleaner container 13, and the pin 41 is penetrated through the hole 13*c,* 13*c* of the cleaner container 13, the through hole 38*b,* of the arm portion 38, and the elongated bore 38*b*1 in the order named, and is press-fitted into the hole 13*e,* 13*e* of the inner wall 13*d*. By doing so, the toner developing container 12 and the cleaner container 13 are rotatably coupled for rotation about the pin 41.

Because of the provision of the elongated bore 38*b*1, the photosensitive drum 7 and spacer rollers 10*d*1 of the developing roller 10*d* contact each other at the generating lines thereof.

Opposite ends of a tension coil spring 59 are engaged with a spring hook 13*p* of the cleaner container 13 and a spring hook 12*a*29 of the developing device frame 12*a* of the toner developing container 12, respectively. The direction of the tension coil spring 59 is substantially parallel with a line connecting the centers of the photosensitive drum 7 and the developing roller 10*d*.

By doing so, by the tension coil spring 59, the developing roller 10*d* mounted in the toner developing container 12 is urged toward the photosensitive drum 7 mounted in the cleaner container 13, so that spacer rollers 10*d*1 at the opposite longitudinal ends of the developing roller 10*d* contact the photosensitive drum 7 by which the developing roller 10*d* is correctly positioned relative to the photosensitive drum 7. The drum gear 51*a* fixed to the end of the photosensitive drum 7 is brought into meshing engagement with the developing roller gear 10*f* fixed to the end of the developing roller 10*d,* so that driving force can be transmitted.

(Gap between Photosensitive Drum and Developing Roller)

When the photosensitive drum 7 and the developing roller 10*d* contact each other, the drum gear 51*a* and the developing roller gear 10*f* are in meshing engagement with each other. When the process cartridge is transported, with the drum gear 51*a* and the developing roller gear 10*f* are in meshing engagement with each other, the tooth surfaces of the gears are in contact, and therefore, they may be rotated by impact or vibration. If the direction of the rotation is the same direction as in the image forming operation, there is no problem. However, the direction of the rotation is not assured, since the vibration or the impact during the transportation occurs at random. If the photosensitive drum 7 rotates in the direction indicated by an arrow B, that is, if the photosensitive drum 7 and the developing roller 10*d* are rotated in the direction opposite from the normal direction, the toner may be leaked out through between the jaw seal 42 (blow-out preventing sheet) and the developing roller 10*d*, and in the worst-case, the seal 42 may be wound around the developing roller since the preventing sheet contacts the developing roller counter-directionally.

In this embodiment, the back clearance of the meshing between the drum gear 51*a* and the developing roller gear 10*f* is made larger than that during the image formation to avoid abutment between the tooth surfaces during the transportation. Another alternative is to disengage them for the transportation.

Figure 60:
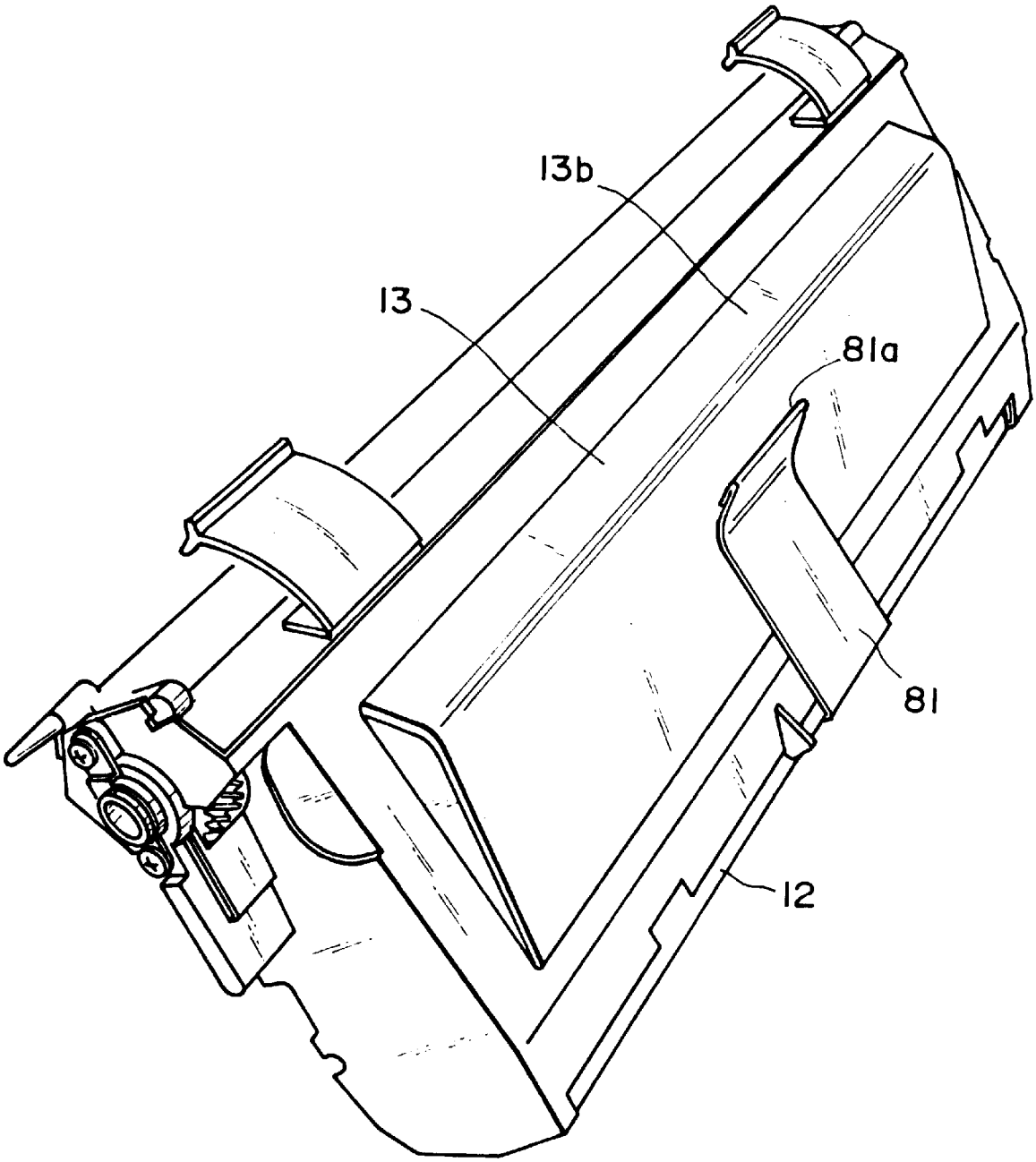
FIG. 60 is a perspective view of a process cartridge during transportation.

Referring to FIG. 30, a description will be provided as to means for maintaining the disengaged state or large back clearance between the drum gear 51*a* and the developing roller gear 10*f*. In the case of FIGS. 59 and 60, a tape 81 is stuck over the toner developing container 12 and the cleaner container 13 with the drum gear 51*a* and the developing roller gear 10*f* disengaged from each other or with the large back clearance.

Figure 37:
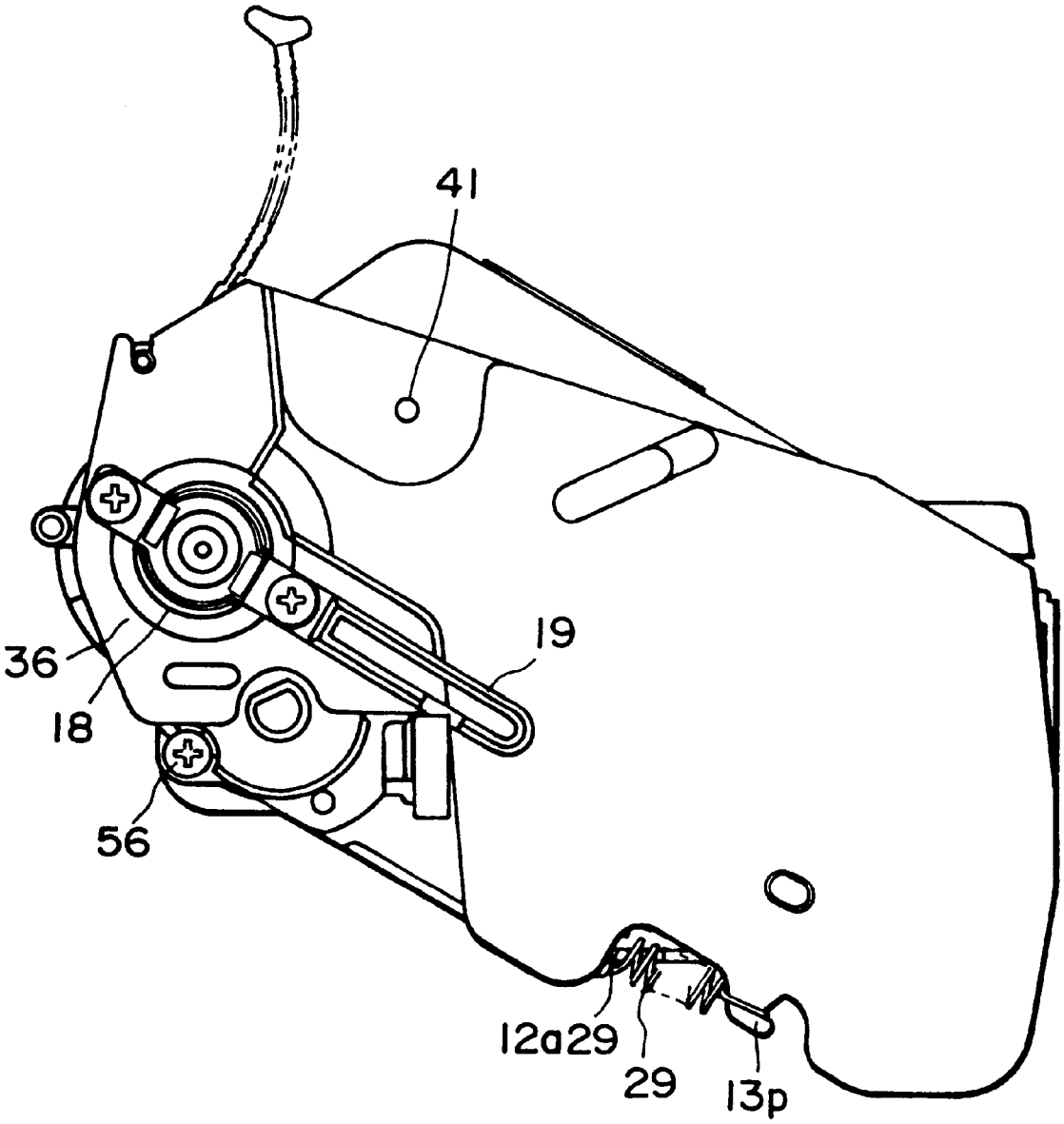
FIG. 37 is a side view of a process cartridge.
Figure 38:
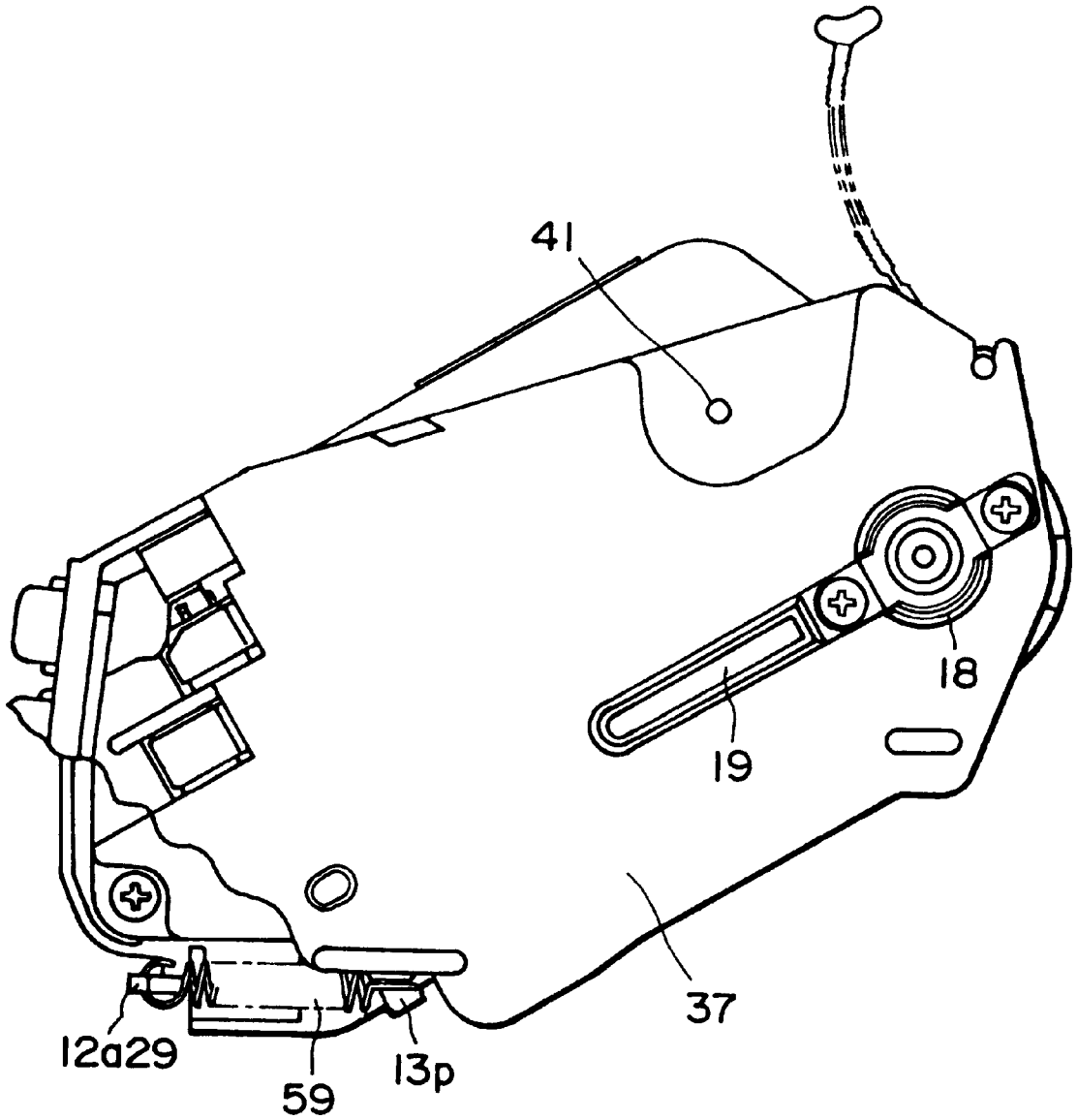
FIG. 38 is a partly broken side view of a process cartridge.

More particularly, a force is applied to the toner developing container 12 and the cleaner container 13 toward each other and positions across a vertical surface passing through a point P which is a pivot between the toner developing container 12 and the cleaner container 13 from the portion where the photosensitive drum 7 and the developing roller 10*d* are provided, as indicated by an arrow N in FIG. 59, by which the drum gear 51*a* and the developing roller gear 10*f* are disengaged from each other. The force is against the spring force provided by the tension coil spring 59 (FIGS. 37 and 38) for urging the photosensitive drum 7 and the developing roller 10*d* toward each other. Therefore, the tape 81 is stretched by the springs 40, 59. Therefore, the tape 81 has sufficient width and thickness such that stress during the transportation is within a tolerable range, and in addition, the adhesive material or the adhesive material for the tape has also sufficient bonding strength against the toner developing device frame 12*a* and the cleaner container 13.

As regards the elements and functions which are not described are the same as with Embodiment 1.

The above-described embodiment of the present invention are summarized as follows.

1. A process cartridge B detachably mountable to a main assembly 14 of an electrophotographic image forming apparatus, comprises:

an electrophotographic photosensitive drum 7;

a drum gear 51*a* provided at one longitudinal end of the photosensitive drum 7;

a developing roller 10*d* for developing with toner an electrostatic latent image formed on the photosensitive drum 7;

a developing roller gear 10*f*, provided at one longitudinal end of the developing roller, for meshing engagement with the drum gear 51*a* to transmit a driving force for rotating the developing roller from the drum gear 51*a*;

a cleaner container 13 supporting the photosensitive drum 7;

a toner developing container 12 supporting the developing roller;

a coupling member 41 for rotatably connecting the cleaner container 13 and the toner developing container 12 with each other;

an urging member 40, 59 for urging the cleaner container 13 and the toner developing container 12 coupled by the coupling member 41 in the direction of engagement of the drum gear 51*a* and the developing roller gear 10*f* with each other;

a tape 81 stuck continuously on the cleaner container 13 and the toner developing container 12 to maintain, against an urging force provided by the urging member 40, 59, a state in which the drum gear 51*a* and the developing roller gear 10*f* are disengaged from each other or in which a back clearance between the drum gear 51*a* and the developing roller gear 10*f* is larger than that during image forming operation.

2. An apparatus according to Paragraph 1, wherein the coupling member 41 is a pin 41 for rotatably coupling the cleaner container 13 and the toner developing container 12.

3. A process cartridge B according to Paragraph 2, wherein the gears of the developing roller and the electrophotographic photosensitive drum 7 are disengaged from each other by urging the toner developing container 12 and the cleaner container 13 toward each other at a position across the pin 41 from the developing roller.

4. A process cartridge B according to Paragraph 3, wherein the gears of the developing roller and the electrophotographic photosensitive drum 7 are disengaged from each other by adhering the tape 81 at a position across the pin 41 from the developing roller.

5. A process cartridge B according to Paragraph 4, wherein the tape 81 is peelable or cuttable.

6. A process cartridge B according to Paragraph 5, wherein the tape 81 is an adhesive tape 81.

7. A process cartridge B according to any one of Paragraphs 4 to 6, wherein the tape 81 is a single tape 81 disposed substantially at a central portion of the process cartridge B with respect to a longitudinal direction of the developing roller.

8. A process cartridge B according to any one of Paragraphs 4 to 7, wherein the tape 81 is provided with a tag 81 at its end.

9. A process cartridge B according to any one of Paragraphs 4 to 8, wherein a notification that tape 81 is to be removed or cut is on a side of the tape 81 which is visible by a user.

10. A process cartridge B according to any one of Paragraphs 1 to 9, wherein the state is maintained after the process cartridge B is manufactured and before the process cartridge B is mounted to the main assembly 14 of the apparatus.

11. A process cartridge B according to Paragraph 1, further comprising an opening, at a position across the coupling member 41 from the electrophotographic photosensitive drum 7 between the cleaner container 13 and the toner developing container 12, for passing image light for exposing the electrophotographic photosensitive drum 7, wherein when the gears of the electrophotographic photosensitive drum 7 and the developing roller are disengaged, the opening is closed.

As described in the foregoing according to the present invention, the roller is effectively prevented from rotating in the direction opposite from the regular direction which is the direction during the image forming operation.

While the invention has been described with reference to the structures disclosed herein, it is not confined to the details set forth and this application is intended to cover such modifications or changes as may come within the purpose of the improvements or the scope of the following claims.

What is claimed is:

1. A process cartridge detachably mountable to a main assembly of an electrophotographic image forming apparatus, comprising:

an electrophotographic photosensitive drum;

a drum gear provided at one longitudinal end of said photosensitive drum;

a developing roller for developing with toner an electrostatic latent image formed on said photosensitive drum;

a developing roller gear, provided at one longitudinal end of said developing roller, for meshing engagement with the drum gear to transmit a driving force for rotating said developing roller from said drum gear;

a cleaner container supporting said photosensitive drum;

a toner developing container supporting said developing roller;

a coupling member for rotatably connecting said cleaner container and said toner developing container with each other;

an urging member for urging said cleaner container and said toner developing container coupled by said coupling member in the direction of engagement of said drum gear and said developing roller gear with each other; and a tape stuck continuously on a surface of said cleaner container and a surface of said toner developing container to maintain, against an urging force provided by said urging member, a state in which said drum gear and said developing roller gear are disengaged from each other or in which a back clearance between said drum gear and said developing roller gear is larger than that during an image forming operation.

2. A process cartridge according to claim 1, wherein said coupling member is a pin for rotatably coupling said cleaner container and said toner developing container.

3. A process cartridge according to claim 2, wherein said gears of said developing roller and said electrophotographic photosensitive drum are disengaged from each other by urging said toner developing container and said cleaner container toward each other at a position across said pin from said developing roller.

4. A process cartridge according to claim 3, wherein said gears of said developing roller and said electrophotographic photosensitive drum are disengaged from each other by adhering said tape at a position across said pin from said developing roller continuously on said toner developing container and said cleaner container.

5. A process cartridge according to claim 4, wherein said tape is peelable or cuttable.

6. A process cartridge according to claim 5, wherein said tape is an adhesive tape.

7. A process cartridge according to any one of claims 4 to 6, wherein said tape is a single tape disposed substantially at a central portion of said process cartridge with respect to a longitudinal direction of said developing roller.

8. A process cartridge according to any one of claims 4 to 6, wherein said tape is provided with a tag at its end.

9. A process cartridge according to any one of claims 4 to 6, wherein a notification that tape is to be removed or cut is on a side of said tape which is visible by a user.

10. A process cartridge according to claim 1, wherein said state is maintained after said process cartridge is manufactured and before said process cartridge is mounted to the main assembly of said apparatus.

11. A process cartridge according to claim 1, further comprising an opening, at a position across said coupling member from said electrophotographic photosensitive drum between said cleaner container and said toner developing container, for passing image light for exposing said electrophotographic photosensitive drum, wherein when said gears of said electrophotographic photosensitive drum and said developing roller are disengaged, said opening is closed.

12. A process cartridge according to any one of claims 1 to 6 and 11, wherein said process cartridge further contains at least one of a charging roller for charging said photosensitive drum and a cleaning blade for removing the toner remaining on said photosensitive drum as a unit and is detachably mountable as said unit to the main assembly of the image forming apparatus.

13. A process cartridge detachably mountable to a main assembly of an electrophotographic image forming apparatus, comprising:

an electrophotographic photosensitive drum;

a drum gear provided at one longitudinal end of said photosensitive drum;

a developing roller for developing with toner an electrostatic latent image formed on said photosensitive drum;

a developing roller gear, provided at one longitudinal end of said developing roller, for meshing engagement with the drum gear to transmit a driving force for rotating said developing roller from said drum gear;

a cleaner container supporting said photosensitive drum;

a toner developing container supporting said developing roller;

a pin for rotatably connecting said cleaner container and said toner developing container with each other;

an urging member for urging said cleaner container and said toner developing container coupled by said pin in the direction of engagement of said drum gear and said developing roller gear with each other; and a tape stuck continuously on said cleaner container and said toner developing container to maintain, against an urging force provided by said urging member, a state in which said drum gear and said developing roller gear are disengaged from each other or in which a back clearance between said drum gear and said developing roller gear is larger than that during an image forming operation, wherein said gears of said developing roller and said electrophotographic photosensitive drum are disengaged from each other by urging said toner developing container and said cleaner container toward each other at a position across said coupling member from said developing roller, wherein said gears of said developing roller and said electrophotographic photosensitive drum are disengaged from each other by adhering said tape at a position across said coupling member from said developing roller, continuously on said toner developing container and said cleaner container, wherein said tape is peelable or cuttable, wherein said tape is an adhesive tape.

14. A process cartridge according to claim 13, wherein said tape is a single tape disposed substantially at a central portion of said process cartridge with respect to a longitudinal direction of said developing roller.

15. A process cartridge according to claim 14, wherein said tape is provided with a tag at its end.

16. A process cartridge according to claim 15, wherein a notification that tape is to be removed or cut is on a side of said tape which is visible by a user.

17. A process cartridge according to claim 16, wherein said state is maintained after said process cartridge is manufactured and before said process cartridge is mounted to the main assembly of said apparatus.

18. A process cartridge according to claims 13, 14, 15, 16, or 17, further comprising an opening, at a position across said pin from said electrophotographic photosensitive drum between said cleaner container and said toner developing container, for passing image light for exposing said electrophotographic photosensitive drum, wherein when said gears of said electrophotographic photosensitive drum and said developing roller are disengaged, said opening is closed.

19. A process cartridge detachably mountable to a main assembly of an electrophotographic image forming apparatus, said process cartridge comprising:

an electrophotographic photosensitive drum;

a drum gear provided at one longitudinal end of said electrophotographic photosensitive drum;

a developing roller for developing with toner an electrostatic latent image formed on said electrophotographic photosensitive drum;

a developing roller gear provided at one longitudinal end of said developing roller, said developing roller gear receiving a driving force for rotating said developing roller from said drum gear through engagement with said drum gear;

a cleaning container supporting said electrophotographic photosensitive drum;

a toner developing container supporting said developing roller;

a coupling member for rotatably coupling said cleaning container and the said toner developing container;

an urging member for urging said cleaning container and said toner developing container which are coupled by said coupling member, in directions for engagement between said drum gear and said developing roller gear; and a tape continuously stuck on a surface of said cleaning container and a surface of said toner developing container to maintain, against an urging force of said urging member, a state in which said drum gear and said developing roller gear are out of engagement from each other or a state in which a pin clearance between said drum gear and said roller gear is larger than that during an image forming operation.

20. A process cartridge according to claim 19, wherein said coupling member is a pin rotatably coupling said cleaning container and said toner developing container.

21. A process cartridge according to claim 20, wherein said developing roller gear and said electrophotographic photosensitive drum gear are disengaged from each other by applying forces to set said toner developing container and said cleaning container toward each other at opposite portions thereof which are across said pin from portions where said gears are engageable.

22. A process cartridge according to claim 21, wherein a disengaged state of said developing roller gear and said electrophotographic photosensitive drum gear, is maintained by the tape stuck continuously on said toner developing container and said cleaning container at the opposite portions.

23. A process cartridge according to claim 22, wherein said tape is peelable or cuttable.

24. A process cartridge according to claim 23, wherein said tape is adhesive.

25. A process cartridge according to any one of claims 22–24, wherein said tape is a single tape extending in a longitudinal direction of said developing roller substantially at a central portion of said process cartridge.

26. The process cartridge according to any one of claim 22–24, wherein said tape is provided with a grip at one end thereof.

27. A process cartridge according to any one of claims 22–24, wherein said tape is provided on a side which can be seen from the outside with an indication to be peeled off or cut before start of use.

28. A process cartridge according to any one of claims 19–24, wherein said developing roller gear and said electrophotographic photosensitive drum gear are kept disengaged from each other after said process cartridge is manufactured and before said process cartridge is mounted to the main assembly of said electrophotographic image forming apparatus.

29. A process cartridge according to claim 19, further comprising an opening for permitting passing of exposure light to which said electrophotographic photosensitive drum is to be exposed, between said cleaning container and said toner developing container at an end position across said coupling member from said electrophotographic photosensitive drum, wherein when said electrophotographic photosensitive drum gear and said developing roller gear are separated from each other, said opening is closed.

* * * * *

UNITED STATES PATENT AND TRADEMARK OFFICE

CERTIFICATE OF CORRECTION

PATENT NO. : 6,493,527 B1
DATED : December 10, 2002
INVENTOR(S) : Higeta et al.

It is certified that error appears in the above-identified patent and that said Letters Patent is hereby corrected as shown below:

Column 4,
Line 31, “a” should be deleted.

Column 5,
Line 24, “and” should read -- an --.
Line 62, “the of” should be deleted.

Column 7,
Line 31, “a felt” should read -- as felt --.
Line 48, “structure” should read -- structure, --.

Column 24,
Line 25, “claim” should read -- claims --.

Signed and Sealed this

Eighteenth Day of November, 2003

JAMES E. ROGAN
*Director of the United States Patent and Trademark Office*